US009511597B2

(12) United States Patent
Tsukahara et al.

(10) Patent No.: US 9,511,597 B2
(45) Date of Patent: Dec. 6, 2016

(54) LIQUID SUPPLY DEVICE WITH LIQUID CONTAINER AND LIQUID INTRODUCTION PART TO BE CONNECTED THEREWITH

(71) Applicant: SEIKO EPSON CORPORATION, Tokyo (JP)

(72) Inventors: Katsutomo Tsukahara, Nagano (JP); Tokujiro Okuno, Fukuoka (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/656,901

(22) Filed: Mar. 13, 2015

(65) Prior Publication Data

US 2015/0259127 A1 Sep. 17, 2015

(30) Foreign Application Priority Data

Mar. 14, 2014 (JP) ..... 2014-051915

(51) Int. Cl.
*B41J 2/175* (2006.01)

(52) U.S. Cl.
CPC ..... *B41J 2/17553* (2013.01); *B41J 2/1752* (2013.01); *B41J 2/17513* (2013.01); *B41J 2/17523* (2013.01); *B41J 2002/17516* (2013.01); *Y10T 137/9029* (2015.04)

(58) Field of Classification Search
CPC ... B41J 2/17553; B41J 2/1752; B41J 2/17513; B41J 2/17523; B41J 2002/17516; Y10T 137/9029
See application file for complete search history.

(56) References Cited

U.S. PATENT DOCUMENTS 6,074,042 A * 6/2000 Gasvoda ..... B41J 2/17509 347/50
2007/0126824 A1* 6/2007 Hibbard ..... B41J 2/17513 347/86
2008/0316284 A1* 12/2008 Osawa ..... B41J 2/175 347/85
2014/0063139 A1* 3/2014 Iwamuro ..... B41J 2/17503 347/85

FOREIGN PATENT DOCUMENTS

JP 2009-202346 A 9/2009

* cited by examiner

*Primary Examiner* — Bradley Thies
(74) *Attorney, Agent, or Firm* — Global IP Counselors, LLP

(57) ABSTRACT

A liquid supply device includes a liquid container having a liquid containing part and a liquid supply part facing a first direction intersecting a gravity direction when supplying liquid to a liquid consumption device, a first support part supporting the liquid supply part such that the liquid supply part is positioned further to an upper side in the gravity direction than the liquid containing part and the liquid supply part moves in the first direction and a direction opposite the first direction, a liquid introduction part attached to the liquid consumption device and configured to connect with the liquid supply part by the liquid supply part moving in the first direction by the first support part, and a positioning part arranged at the liquid introduction part and configured to position the liquid supply part in a direction intersecting the first direction when connecting with the liquid supply part.

10 Claims, 65 Drawing Sheets

F6N-F6N CROSS SECTION VIEW

F13-F13 CROSS SECTION VIEW

F13a-F13a PARTIAL CROSS SECTION VIEW

F20-F20 PARTIAL CROSS SECTION VIEW

F22A-F22A PARTIAL CROSS SECTION VIEW

F22B-F22B PARTIAL CROSS SECTION VIEW

F25A-F25A PARTIAL CROSS SECTION VIEW

F25B-F25B PARTIAL CROSS SECTION VIEW

F28-F28 CROSS SECTION VIEW

F29-F29 CROSS SECTION VIEW

F32-F32 CROSS SECTION VIEW

F25A-F25A PARTIAL CROSS SECTION VIEW

F5B-F5B PARTIAL CROSS SECTION VIEW

LIQUID SUPPLY DEVICE WITH LIQUID CONTAINER AND LIQUID INTRODUCTION PART TO BE CONNECTED THEREWITH

CROSS-REFERENCE TO RELATED APPLICATIONS

This application claims priority to Japanese Patent Application No. 2014-051915 filed on Mar. 14, 2014. The entire disclosure of Japanese Patent Application No. 2014-051915 is hereby incorporated herein by reference.

BACKGROUND

Technical Field

The present invention relates to technology for a liquid supply device capable of supplying liquid to a liquid consumption device.

Related Art

In the past, as technology for supplying ink to a printer as a liquid consumption device, external ink supply devices were known which supplied ink from outside the printer (as in Unexamined Patent Publication No. 2009-202346, for example).

With the technology of Unexamined Patent Publication No. 2009-202346 noted above, the external ink supply device is equipped with an ink bag for housing ink, a connection part for retrieving ink of the ink bag (liquid outlet part or liquid supply part), and an ink supply tube (liquid introduction part) for supplying ink via the connection part to a printer. With this external ink supply device, the connection part is positioned at the downward side of the vertical direction of the ink bag. Because of this, there is the problem that it is difficult to attach and detach the ink supply tube with the connection part.

This kind of problem is not limited to ink supply devices for supplying ink to printers, and is a problem common to liquid supply devices that can supply liquid to liquid consumption devices.

SUMMARY

Therefore, the present invention has as its first object to provide technology that allows the liquid outlet part and the liquid introduction part to be connected easily. Also, the present invention has as its second object to provide technology with which it is possible to perform connection of the liquid outlet part and the liquid introduction part well. Also, there is a desire to lower the cost, make manufacturing easier, and improve usability compared to the prior art technology.

The present invention was created to address at least a portion of the problems described above, and can be realized as the following modes.

With one mode of the present invention, a liquid supply device configured to supply liquid to a liquid consumption device is provided. This liquid supply device is equipped with a liquid container including a liquid containing part configured to house the liquid, and a liquid supply part in communication with an interior of the liquid containing part, facing a first direction that is a direction intersecting a gravity direction when supplying the liquid to the liquid consumption device, a first support part supporting the liquid supply part of the liquid container such that the liquid supply part is positioned further to an upper side in the gravity direction than the liquid containing part, and such that the liquid supply part moves in the first direction and in a direction opposite to the first direction, a liquid introduction part attached to the liquid consumption device, and configured to be connected with the liquid supply part by the liquid supply part moving in the first direction by movement of the first support part, and arranged a positioning part arranged at the periphery of the liquid introduction part and configured to position the liquid supply part in a direction intersecting the first direction when connecting with the liquid supply part.

With the liquid container of this mode, the first support part supports the liquid supply part so as to be positioned further to the upper side in the gravity direction than the liquid containing part, and so as to be able to move the liquid supply part along a first direction that intersects the gravity direction. By doing this, it is possible to reduce the possibility of not being able to connect the liquid supply part to the liquid introduction part because the liquid containing part becomes an obstacle. Specifically, it is easy to connect the liquid supply to the liquid introduction part. Also, with the positioning part, it is possible to perform positioning of the liquid supply part in the direction intersecting the first direction in relation to the liquid introduction part, so it is possible to perform the connection of the liquid supply part with the liquid introduction part well.

The liquid supply device according to the mode noted above can further be equipped with a second support part supporting the liquid introduction part, wherein the second support part supports the liquid introduction part displaceably in a direction intersecting the first direction.

With the liquid supply device of this mode, when connecting the liquid introduction part to the liquid supply part, it is easier for the liquid introduction part to be displaced following the movement of the liquid supply part. By doing this, it is possible to perform connection of the liquid supply part with the liquid introduction part even better.

The liquid supply device according to the mode noted above can be urged toward the liquid supply part.

With the liquid supply device of this mode, it is possible to inhibit the liquid introduction part from coming off from the liquid supply part, so it is possible to reduce the possibility of connection failures occurring with the liquid introduction part and the liquid supply part.

The liquid supply device according to the mode noted above wherein the liquid supply part has a first side far from the liquid introduction part and a second side near the liquid introduction part, and the first support part can support the first side of the liquid supply part so as to be more greatly displaced in the direction intersecting the first direction than the second side.

With the liquid supply device of this mode, with the first support part, it is easy to perform positioning of the liquid supply part to the liquid introduction part before starting the connection of the liquid supply part and the liquid introduction part. Also, immediately before the connection is completed, the movement of the liquid supply part is not limited more than when connection starts, so it is possible to perform connection of the liquid supply part and the liquid introduction part well.

The liquid supply device according to the mode noted above can further have a flexible liquid flow tube which is in communication with the liquid introduction part, and is configured to supply the liquid of the liquid introduction part to the liquid consumption device, the liquid flow tube being positioned further to a lower side in the gravity direction than the liquid introduction part, and the liquid introduction part is insert-molded in a state with one end of the liquid flow tube inserted in a connection part of the liquid introduction part.

With the liquid supply device of this mode, it is possible to reduce the possibility of liquid leaking to the outside from the connection location of the liquid flow tube and the liquid introduction part. Specifically, when connecting the liquid flow tube to the connection part and fixing using a spring, there is a possibility that the part fixed with the spring will creep, and that a crack will occur and liquid will leak out, but with the liquid supply device of this mode, it is possible to reduce the possibility of that kind of liquid leak.

With the liquid supply device according to the mode noted above, the liquid introduction part includes in the direction of the liquid flow from the liquid container to the liquid consumption device, an upstream side introduction part for which a flow path parallel to the first direction is formed, including an upstream side end portion of the liquid introduction part, and a downstream side introduction part extending downward in the gravity direction from the upstream side introduction part, including a downstream side end portion of the liquid introduction part.

With the liquid supply device of this mode, by having a downstream side introduction part extending in the direction intersecting the first direction (downward direction of the gravity direction), it is possible to inhibit the shape of the liquid supply device from becoming large in the first direction.

The liquid supply device according to the mode noted above further includes a holding member holding the liquid flow tube, and the holding member, in a liquid flow direction of the liquid reaching from the liquid introduction part to the liquid consumption device, holds the liquid flow tube such that, of the liquid flow tube, an upstream end side part from an upstream end of the liquid flow tube to a part where the holding member is positioned extends along the gravity direction.

With the liquid supply device of this mode, even when there is an arrangement such that of the liquid flow tube, the downstream side is more curved than the upstream end side part, it is possible to maintain the shape of the upstream end side part along the gravity direction. By doing this, for example, it is possible to reduce the possibility of the other members of the liquid supply device (e.g. the second support part) being affected by the downstream side of the liquid flow tube.

The liquid supply device according to the mode noted above further includes a flexible liquid flow tube which is in communication with the liquid introduction part, and is configured to supply the liquid of the liquid introduction part to the liquid consumption device, the liquid flow tube being positioned further to a lower side in the gravity direction than the liquid introduction part, and a holding member holding the liquid flow tube. The holding member, in a flow direction of the liquid reaching from the liquid introduction part to the liquid consumption device, holds the liquid flow tube such that, of the liquid flow tube, an upstream end side part from an upstream end of the liquid flow tube to a part where the holding member is positioned extends along the gravity direction.

With the liquid supply device of this mode, even when there is an arrangement such that of the liquid flow tube, the downstream side is curved more than the upstream end side part, it is possible to maintain the shape of the upstream end side part along the gravity direction. By doing this, for example, it is possible to reduce the possibility of the other members of the liquid supply device (e.g. the second support part) being affected by the downstream side of the liquid flow tube.

The plurality of structural elements that each of the modes of the present invention described above have are not all essential, and in order to address a portion or all of the problems described above, or to achieve a portion or all of the effects noted in the specification, it is possible to modify, eliminate, replace with a new other structural element, or do a partial elimination of the limiting content as appropriate for a portion of the structural elements among the plurality of structural elements. Also, to address a portion or all of the problems described above, or to achieve a portion or all of the effects noted in the specification, it is possible to combine a portion or all of the technical features included in one mode of the present invention described above with a portion or all of the technical features included in another mode of the present invention described above, and use that as one independent mode of the present invention.

For example, one mode of the present invention can also be realized as a device equipped with one or more element among the plurality of elements of the liquid container, the first support part, and the liquid introduction part. Specifically, this device is acceptable having the liquid container, or cannot having it. Also, this device is acceptable having the liquid supply first support part, or cannot having it. This device is also acceptable having the liquid introduction part, or cannot having it. With this kind of mode, it is possible to address at least one of the various problems of making the device smaller, lowering costs, saving resources, making manufacturing easier, improving usability and the like. It is also possible to apply part or all of the technical features of each mode of the liquid container described above to this device.

The present invention can be realized in various modes, and for example, other than the liquid supply device, it is possible to be realized as a method of manufacturing the liquid supply device, as a liquid consumption system equipped with the liquid supply device and the liquid consumption device, and the like.

BRIEF DESCRIPTION OF THE DRAWINGS

Referring now to the attached drawings which form a part of this original disclosure.

DETAILED DESCRIPTION OF EXEMPLARY EMBODIMENTS

A. Embodiment

A-1. Liquid Consumption System Configuration

Figure 1:
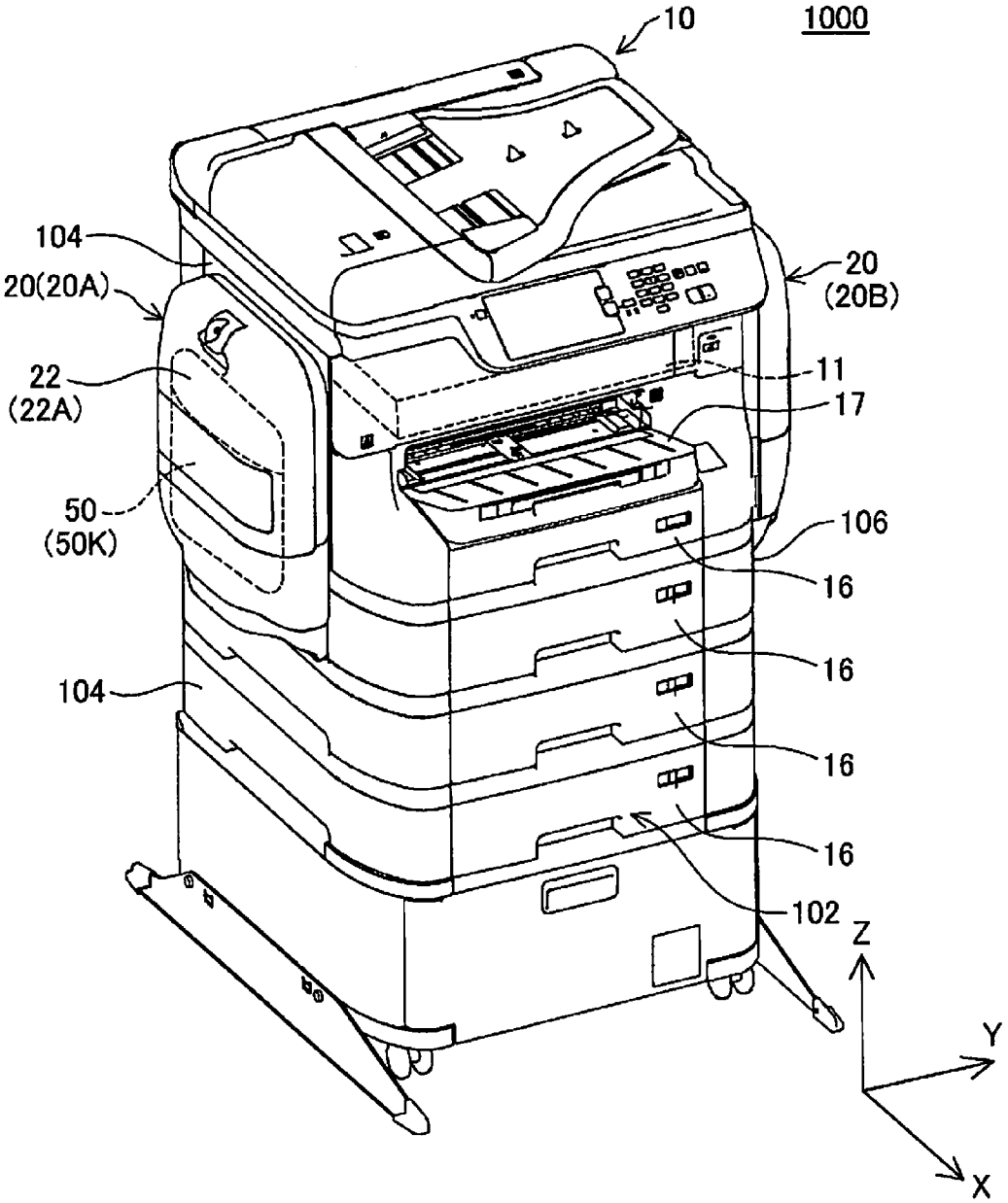
FIG. 1 is a first perspective view showing the schematic structure of the liquid consumption system.
Figure 2:
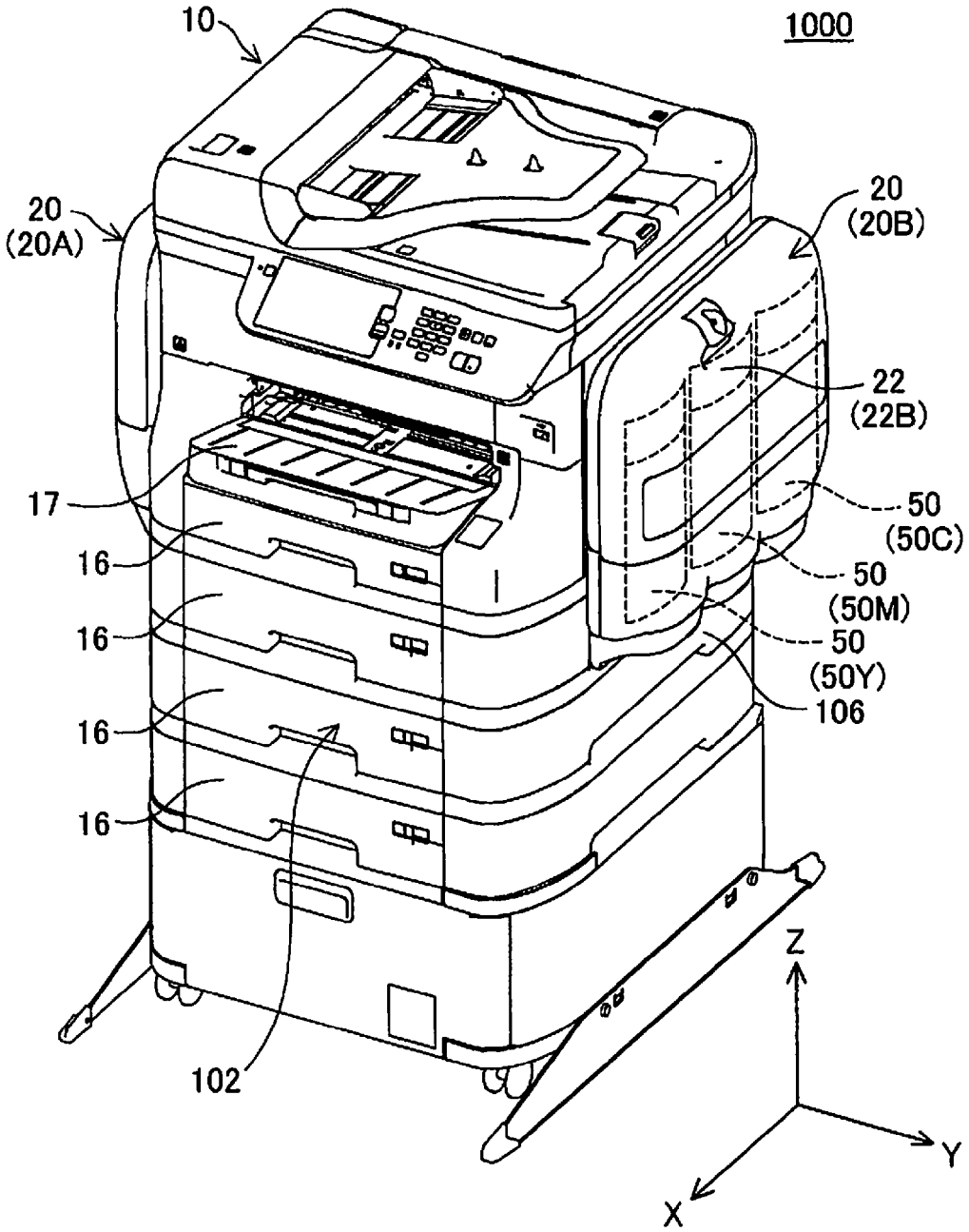
FIG. 2 is a second perspective view showing the schematic structure of the liquid consumption system.
Figure 3:
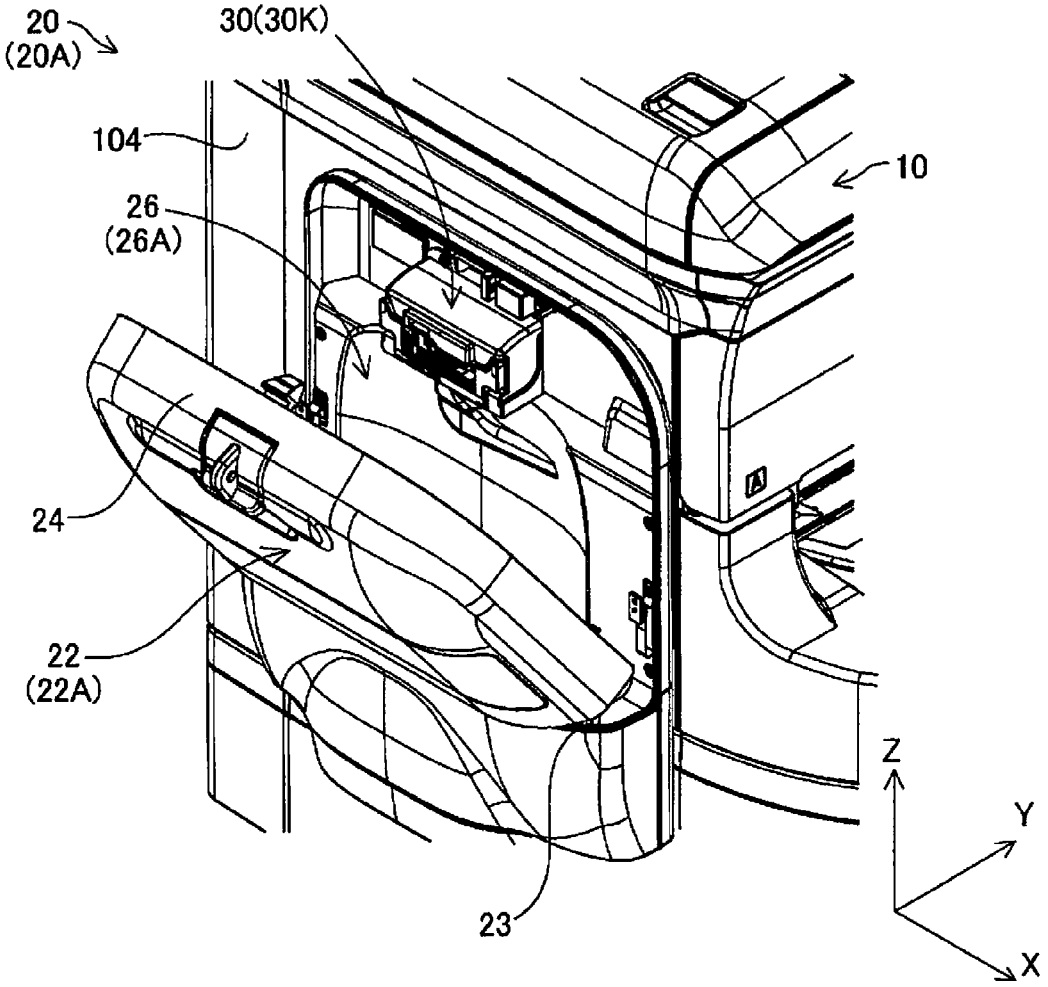
FIG. 3 is a first drawing for describing the liquid supply device.
Figure 4:
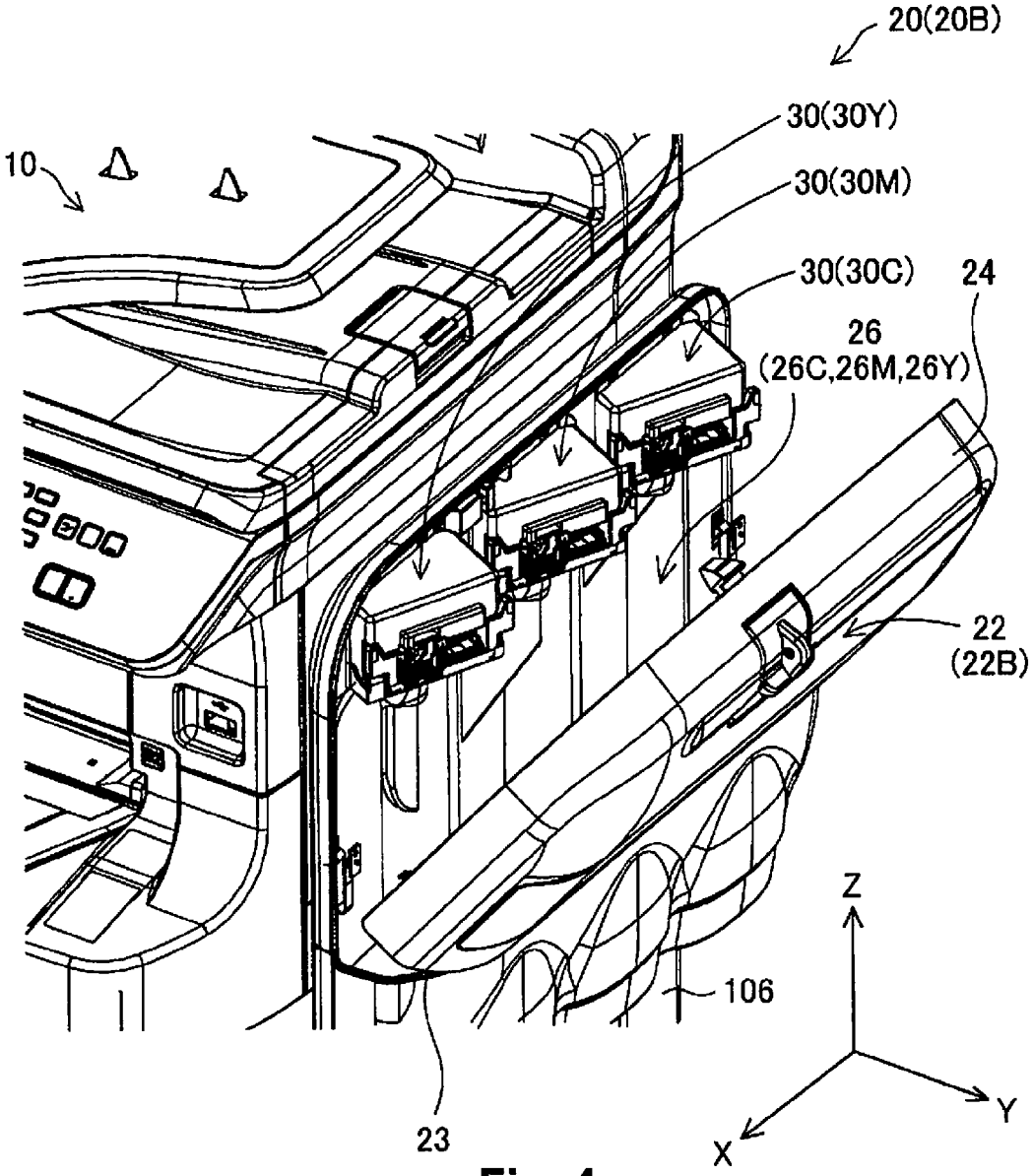
FIG. 4 is a second drawing for describing the liquid supply device.
Figure 5A:
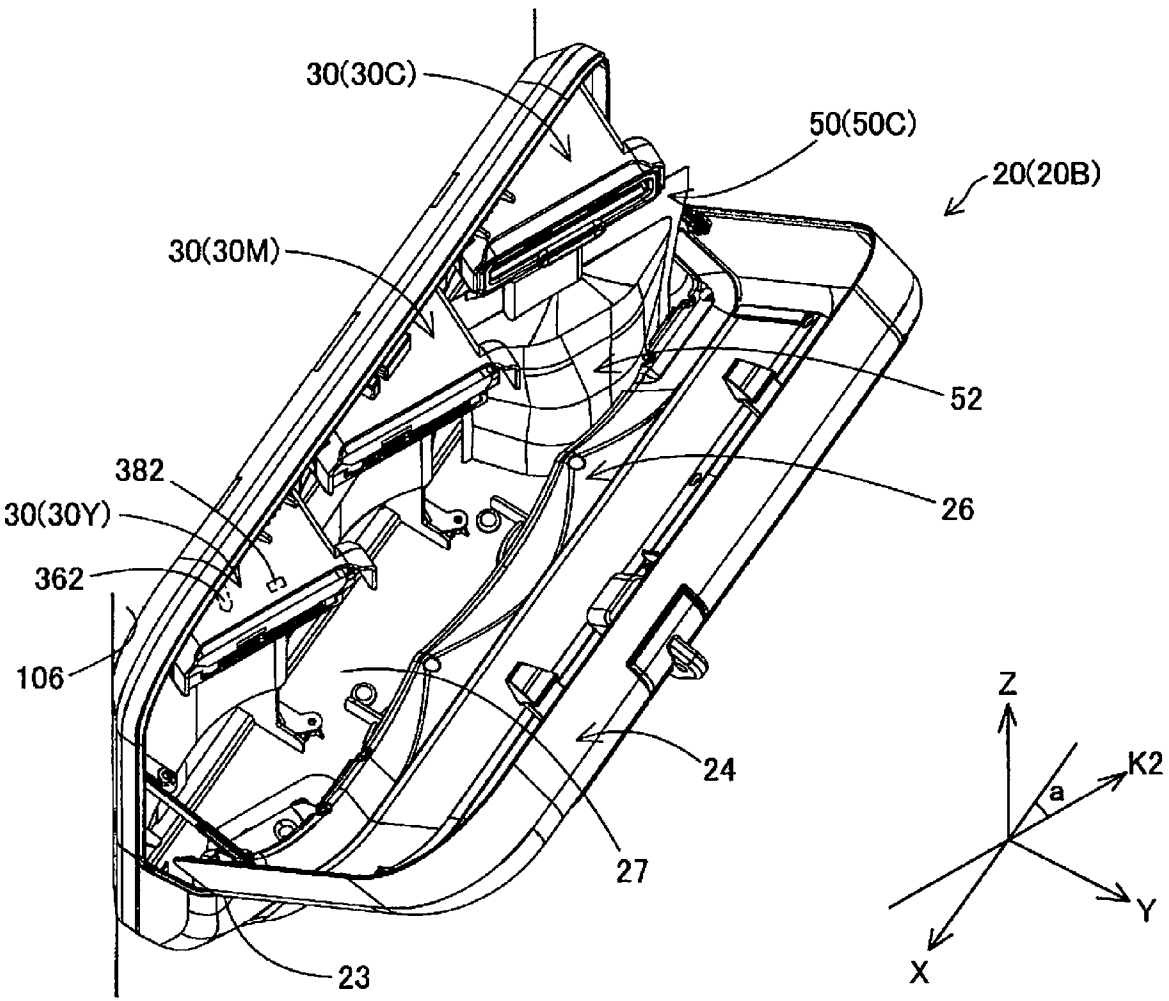
FIG. 5A is a third drawing for describing the liquid supply device.

FIG. 1 is a first perspective view showing the schematic structure of the liquid consumption system 1000. FIG. 2 is a second perspective view showing the schematic structure of the liquid consumption system 1000. FIG. 3 is a first drawing for describing the liquid supply device 20. FIG. 4 is a second drawing for describing the liquid supply device 20. FIG. 5A is a third drawing for describing the liquid supply device 20. With FIG. 3 and FIG. 4, a state is shown with a liquid container 50 described later removed. Also, with FIG. 5A, shown is a state with one liquid container 50 attached. In FIG. 1 through FIG. 5A, the XYZ axes are drawn orthogonal to each other.

As shown in FIG. 1, a liquid consumption system 1000 is equipped with a printer 10 as a liquid consumption device and two liquid supply devices 20. In the use mode of the liquid consumption system 1000, the printer 10 is arranged in a horizontal plane defined by the X axis direction and the Y axis direction. Specifically, the Z axis direction becomes the vertical direction (gravity direction, up-down direction). Also, the −Z axis direction becomes the vertical downward direction, and the +Z axis direction becomes the vertical upward direction. The liquid supply device 20 supplies ink as the liquid to the printer 10. The liquid container 50 (liquid housing container unit 50) that the liquid supply device 20 is equipped with can be connected (mounted) so as to be attachable and detachable with the printer 10.

The printer 10 is an inkjet printer. The printer 10 is equipped with a recording mechanism 11, a paper feed tray 16, and an ejection tray 17. A plurality of the paper feed trays 16 are provided at different height positions in the vertical direction. The paper feed trays 16 are provided on a device first surface (device front surface, front surface) 102 as the front surface of the printer 10. Housed in the paper feed trays 16 are recording media (e.g. paper) on which an image such as text or the like will be printed (recorded) by the printer 10.

The recording mechanism 11 is equipped with a recording head (not illustrated) that discharges ink. The recording head is in communication with the liquid supply device 20 via a flow tube such as a tube or the like. The recording head performs recording (printing) by using ink supplied from the liquid supply device 20 and discharging the ink on the recording media. The recorded recording media is ejected to the ejection tray 17.

Two liquid supply devices 20 supply ink to the printer 10 via a liquid introduction part 362. The two liquid supply devices 20 are provided on a device second surface (also called the device first side surface or device first side wall) 104 and a device third surface (also called the device second side surface or device second side wall) 106 that intersect with a device first surface of the printer 10 (also called the device front surface or device front wall) 102. The device first surface 102 through the device third surface 106 are respectively roughly perpendicular surfaces to the installation surface in the printer 10 use state. The device second surface 104 and the device third surface 106 face opposite. Here, the liquid supply device 20 provided on the device second surface 104 is also called first liquid supply device 20A, and the liquid supply device 20 provided on the device third surface 106 is also called the second liquid supply device 20B. When using without distinguishing between the first and second liquid supply devices 20A and 20B, they are simply called liquid supply device 20.

As shown in FIG. 1, the first liquid supply device 20A is equipped with a cover member 22 as one liquid container housing unit, one liquid container 50, and one detachable unit 30 (FIG. 3). As shown in FIG. 2, the second liquid supply device 20B is equipped with a cover member 22B as one liquid container housing unit, three liquid housing bodies 50, and three detachable units 30 corresponding to each liquid container 50 (FIG. 4). Here, when using distinguishing between the two cover members 22, the codes 22A and 22B are used. Also, when distinguishing between four liquid housing bodies 50, code numbers 50K, 50C, 50M, and 50Y are used. Also, when distinguishing between four detachable units 30, codes 30K, 30C, 30M, and 30Y are used. The numbers of cover members 22, liquid housing bodies 50, and detachable units 30 are not limited to those noted above. For example, there can be three or fewer or five or more liquid housing bodies 50. Also, there can be a number of detachable units 30 provided corresponding to the number of liquid housing bodies 50. Also, there can be one, or three or more cover members 22. The detachable units 30 can be regarded as a constitutional element of the liquid supply device 20, or can be regarded as a constitutional element of the printer 10.

Mutually different types of ink are housed (filled) in the four liquid housing bodies 50. With this embodiment, yellow (Y), magenta (M), cyan (C), and black (K) inks are housed in respectively different liquid housing bodies 50. The liquid container 50K includes a liquid containing part in which black ink is housed, the liquid container 50C includes a liquid containing part in which cyan ink is housed, the liquid container 50M includes a liquid containing part in which magenta ink is housed, and the liquid container 50Y includes a liquid containing part in which yellow ink is housed. As shown in FIG. 3 and FIG. 4, the liquid housing bodies 50 are housed in housing space part 26 for housing liquid housing bodies 50 partitioned by a cover member 22. In specific terms, the liquid container 50K is housed in housing space part 26A (FIG. 3), and the liquid housing bodies 50C, 50M, and 50Y are housed in the housing space part 26B (FIG. 4). Also, the detachable unit 30 is arranged inside the housing space part 26.

The detachable units 30 shown in FIG. 3 and FIG. 4 are mounted so as to be freely attachable and detachable with the liquid housing bodies 50. The detachable unit 30K is arranged on the inside of the cover member 22A, and the detachable units 30C, 30M, and 30Y are arranged on the inside of the cover member 22B. As shown in FIG. 3, the detachable unit 30K is provided on the device second surface 104 of the printer 10. As shown in FIG. 4, the detachable units 30C, 30M, and 30Y are provided on the device third surface 106 of the printer 10. When the liquid container 50 is mounted on the detachable unit 30, the ink housed in the liquid container 50 is supplied to the recording head of the printer 10 by a supply mechanism (not illustrated) having a pump function that the printer 10 is equipped with.

As shown in FIG. 3, the cover member 22A is attached to the device second surface 104 which is the outer wall of the printer 10. As shown in FIG. 4, the cover member 22B is attached to the device third surface 106 which is the outer wall of the printer 10. As shown in FIG. 3 and FIG. 4, the cover member 22 is constituted to be able to freely open and close by having one end portion (bottom part) 23 of the vertical downward side as a fulcrum and the other end portion (top part) 24 of the vertical upward side rotate. After the ink housed in the liquid container 50 is consumed, the user opens the cover member 22 and removes the used liquid container 50 from the detachable unit 30. Then, the user closes the cover member 22 after a new liquid container 50 is mounted in the detachable unit 30.

As shown in FIG. 5A, the cover member 22 has a bottom surface 27 that forms the bottom part of the housing space part 26. The bottom surface 27 is positioned further to the gravity direction lower side than the detachable unit 30. The bottom surface 27 is a part that the bottom part of the liquid container (in more detail, the bottom part of the liquid containing part 52) touches. It is also possible to have a protruding part provided on the bottom surface 27, and have the protruding part and the bottom part of the liquid container 50 touch.

Also, for example as shown with the detachable unit 30Y, the detachable unit 30 is equipped with the liquid introduction part 362 as the liquid supply connection part, and an electrical connection part (supply side electrical connection part or device side electrical connection part) 382. A liquid supply part 57 (FIG. 9) of the liquid container 50 is connected to the liquid introduction part 362. The ink of the liquid container 50 is supplied to the liquid introduction part 362 via the liquid supply part 57. The ink supplied to the liquid introduction part 362 is supplied to the recording head of the recording mechanism 11 (FIG. 1). A circuit substrate 582 (FIG. 9) as a liquid container side electrical connection part is electrically connected to the electrical connection part 382 by contacting it. The liquid introduction part 362 and the electrical connection part 382 are arranged aligned along a K2 axis direction. The K2 axis direction is a direction that is orthogonal to the Z axis direction, and parallel to the plane (horizontal plane) defined by the X axis direction and the Y axis direction. A substrate unit 58 described later can also be regarded as the liquid container side electrical connection part.

As shown in FIG. 5A, when the liquid introduction part 362 and the electrical connection part 382 are seen from the device first surface 102, they are respectively arranged at visible positions. In specific terms, the K2 axis direction in which the liquid introduction part 362 and the electrical connection part 382 are aligned, and the direction perpendicular to the device first surface 102 (X axis direction) cross at an angle a that is greater than zero degrees and 90 degrees or less. This angle a is an angle formed by rotating to the left from the K2 axis to the X axis when the liquid supply device 20 is arranged at the device third surface 106 (FIG. 2) positioned at the right side in relation to the device third surface 106 (FIG. 2). Also, this angle a is an angle formed by rotating to the right from the K2 axis to the X axis when the liquid supply device 20 is arranged on the device second surface 104 (FIG. 1) positioned at the left side in relation to the device first surface 102. Said another way, of the liquid introduction part 362 and the electrical connection part 382, one (for example the liquid introduction part 362) arranged at the side closer to the device first surface 102 is positioned further to the outside (e.g. the +Y axis direction side) than the outer wall on which each part 362 and 382 is supported (e.g. the device third surface 106) than the other one (e.g. the electrical connection part 382) arranged at the side farther in relation to the device first surface 102.

By doing this, when the printer 10 is seen from the device first surface 102, the user is able to visually recognize the liquid introduction part 362 and the electrical connection part 382, so it is easy to recognize the connection position of the liquid container 50 and the detachable unit 30. Also, it is preferable that this angle a be 15 degrees or more and 60 degrees or less, and more preferable that it be 20 degrees or more and 50 degrees or less. By doing that, it is possible to easily recognize the connection position, and also possible to inhibit the housing space part 26 from becoming large in the Y axis direction, so it is possible to use the space of the housing space part 26 efficiently, and to arrange the detachable unit 30 in the housing space part 26.

The first liquid supply device 20A (FIG. 3) for mounting the liquid container 50K that houses black ink can have the angle a be zero degrees, and the second liquid supply device 20B (FIG. 4) for mounting the liquid housing bodies 50C, 50M, and 50Y for housing color inks like yellow and the like can fulfill a range for the angle a (greater than zero degrees and 90 degrees or less). Specifically, the direction in which the liquid introduction part 362 and the electrical connection part 382 of the first liquid supply device 20A are aligned can be parallel to the outer wall (e.g. the device second surface 104 in FIG. 1). Typically the liquid container 50K that houses the black ink is filled with a larger volume of ink than the other liquid housing bodies 50C, 50M, and 50Y that house colored inks. Thus, the outline of the liquid container 50K is larger than the other liquid housing bodies 50C, 50M, and 50Y. However, each part of the liquid container 50K corresponding to the liquid introduction part 362 and the electrical connection part 382 of the first liquid supply device 20A is also parallel to the device second surface 104, so it is possible to inhibit there being a big difference between the outline shape of the first liquid supply device 20A and the second outline shape of the second liquid supply device 20B.

A-2. Detachable Unit 30 Schematic Structure

Figure 5B:
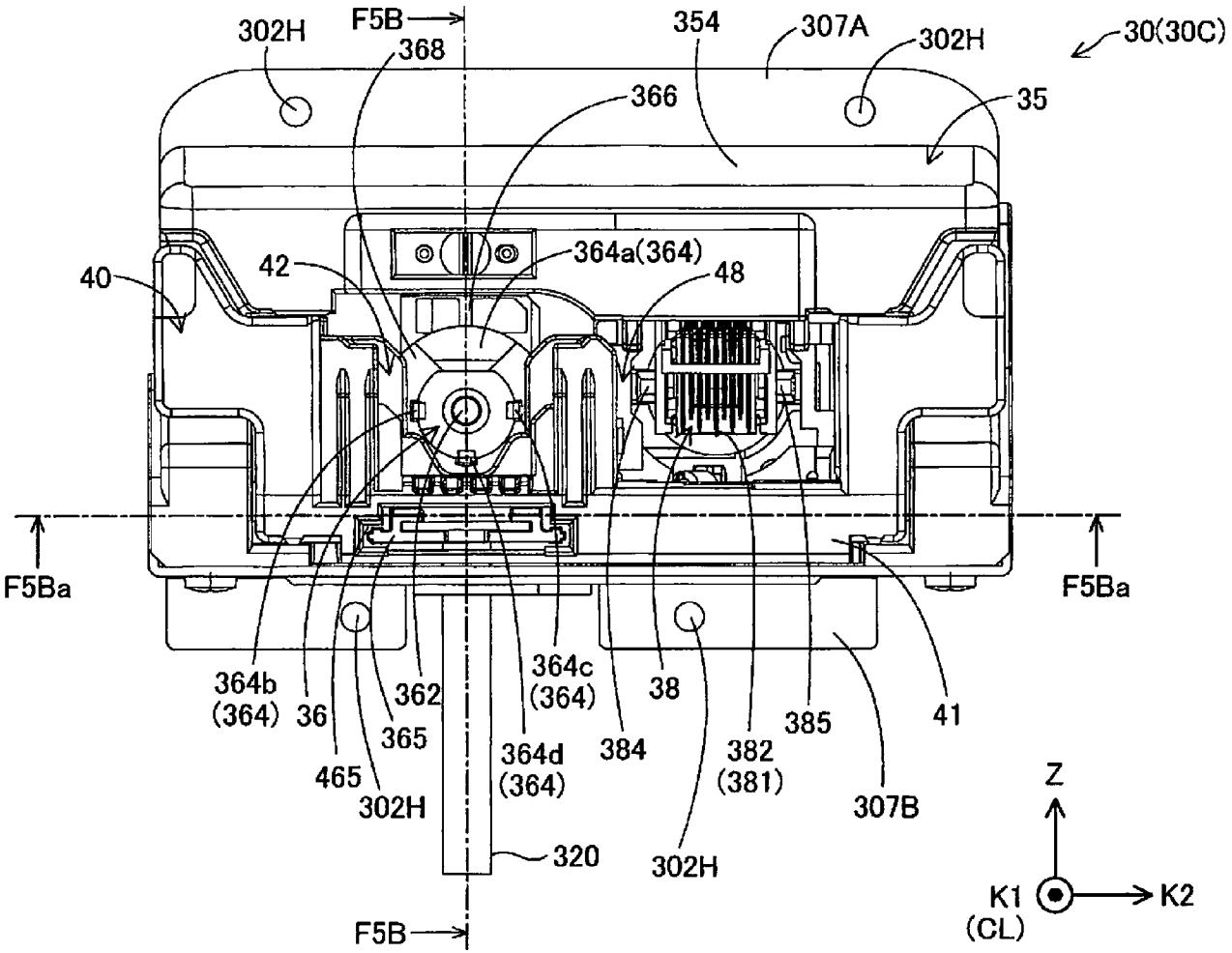
FIG. 5B is a front view of the detachable unit.
Figure 5C:
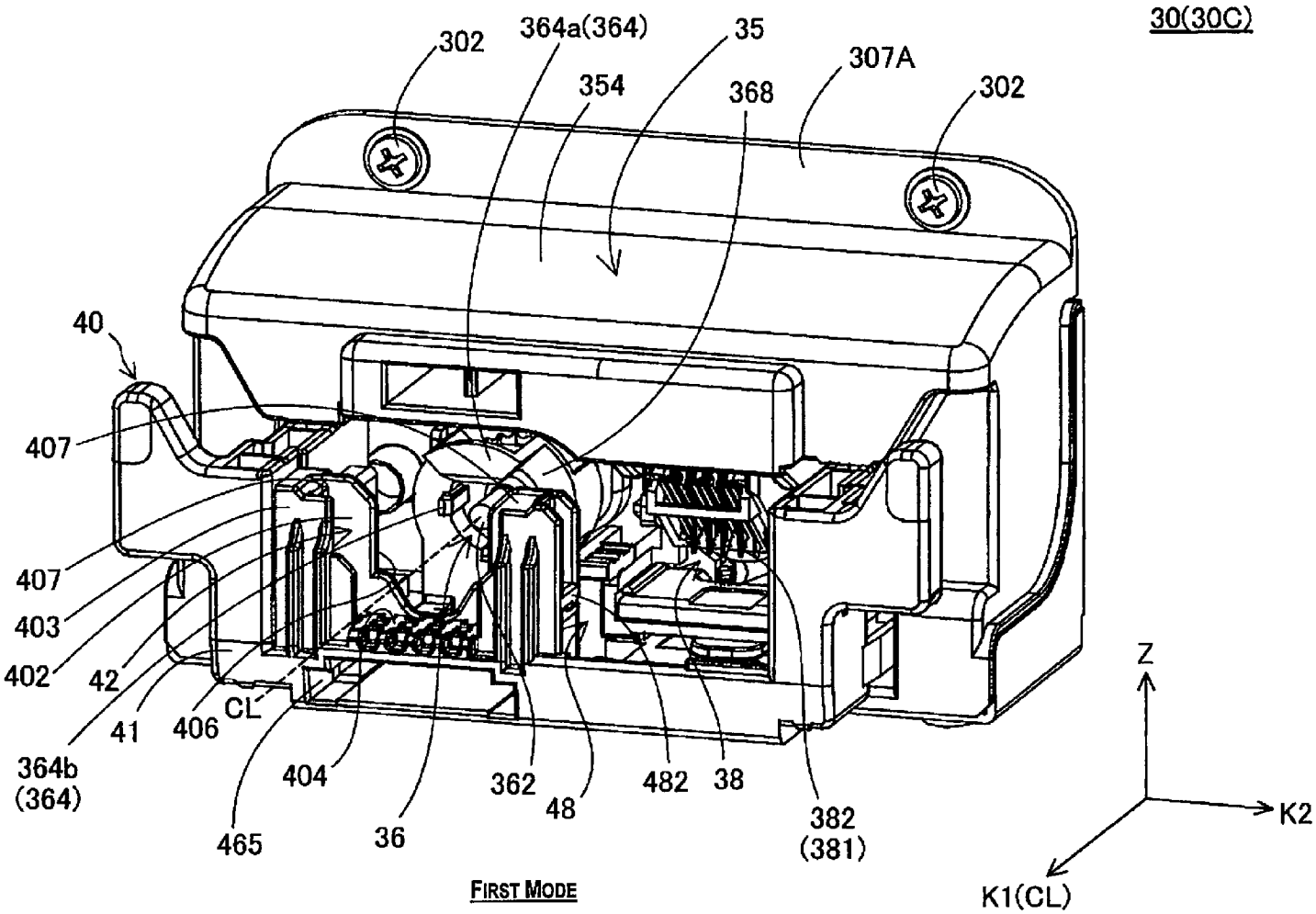
FIG. 5C shows the first mode with the movable member projecting in the outward direction in relation to the stationary member.
Figure 6A:
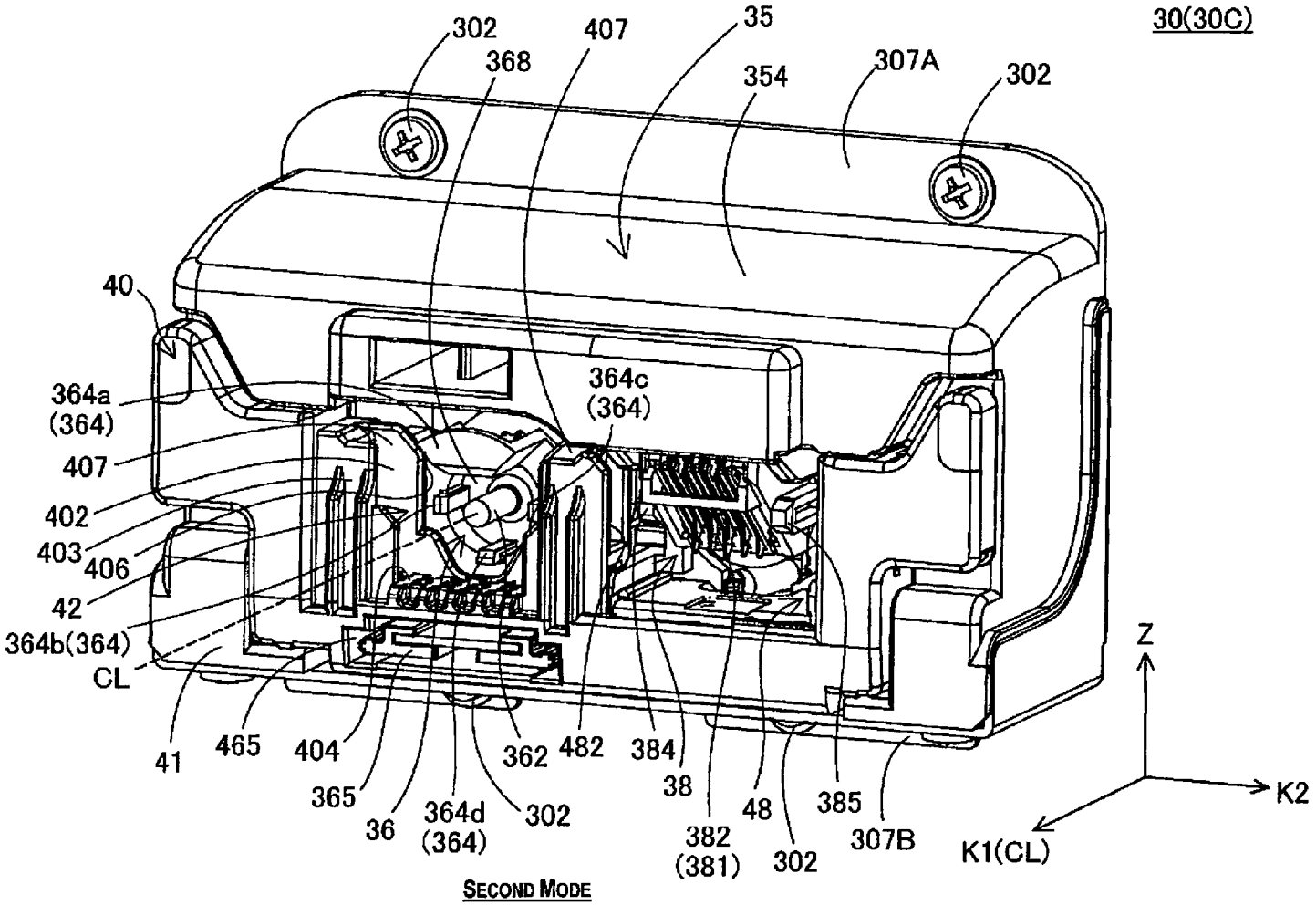
FIG. 6A shows the second mode with the movable member housed in the stationary member.
Figure 6B:
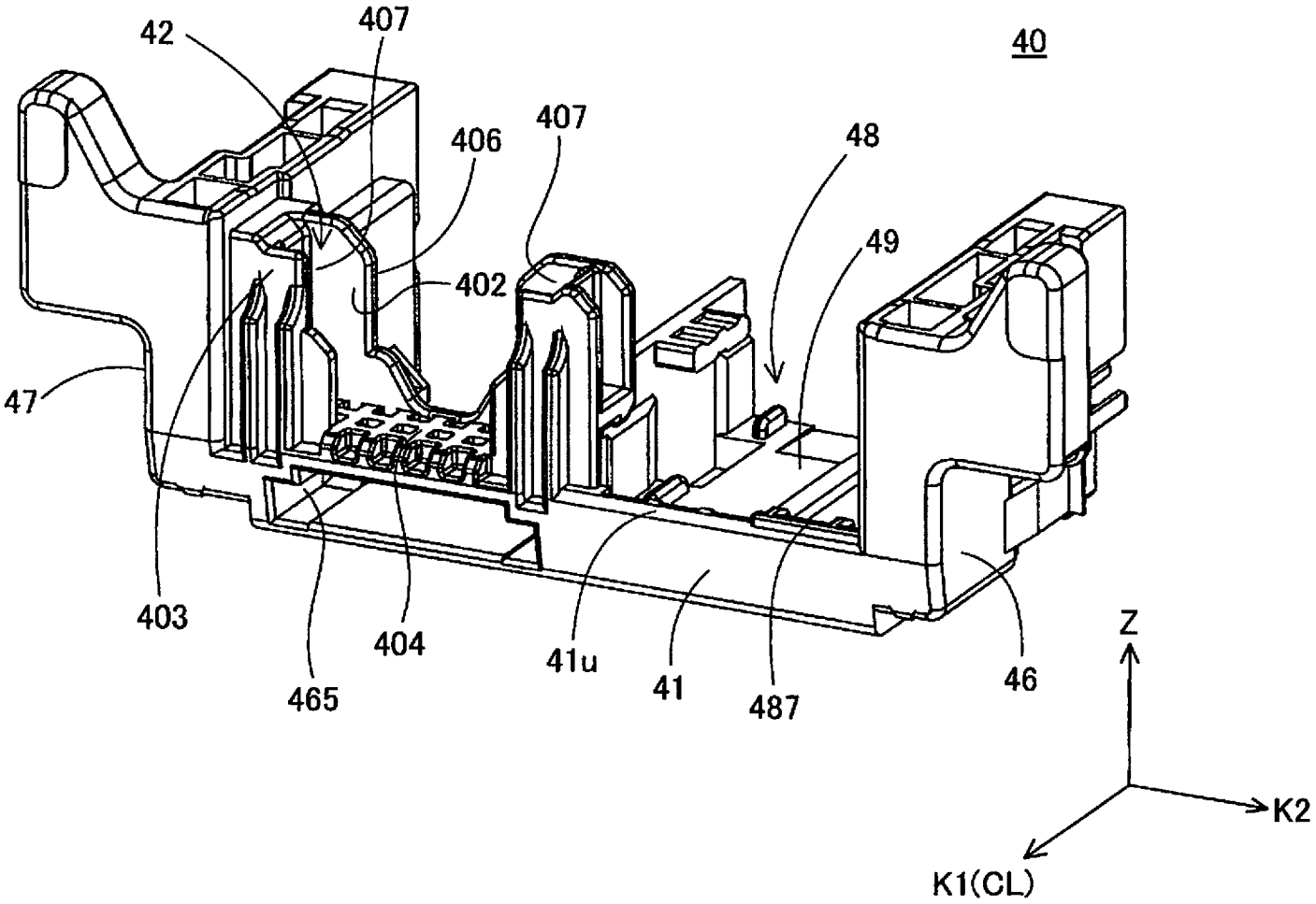
FIG. 6B is a first perspective view of the movable member.
Figure 6C:
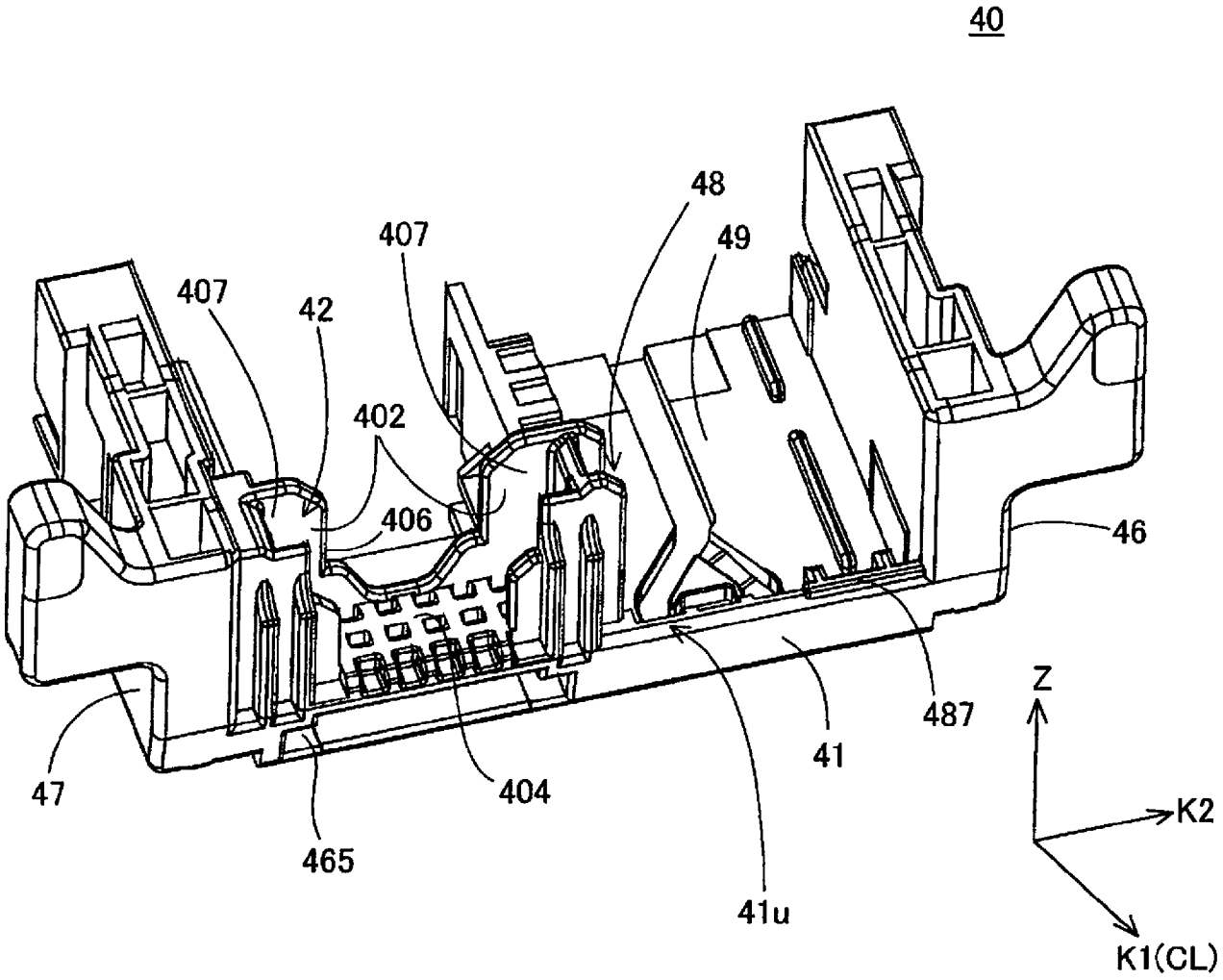
FIG. 6C is a second perspective view of the movable member.
Figure 6D:
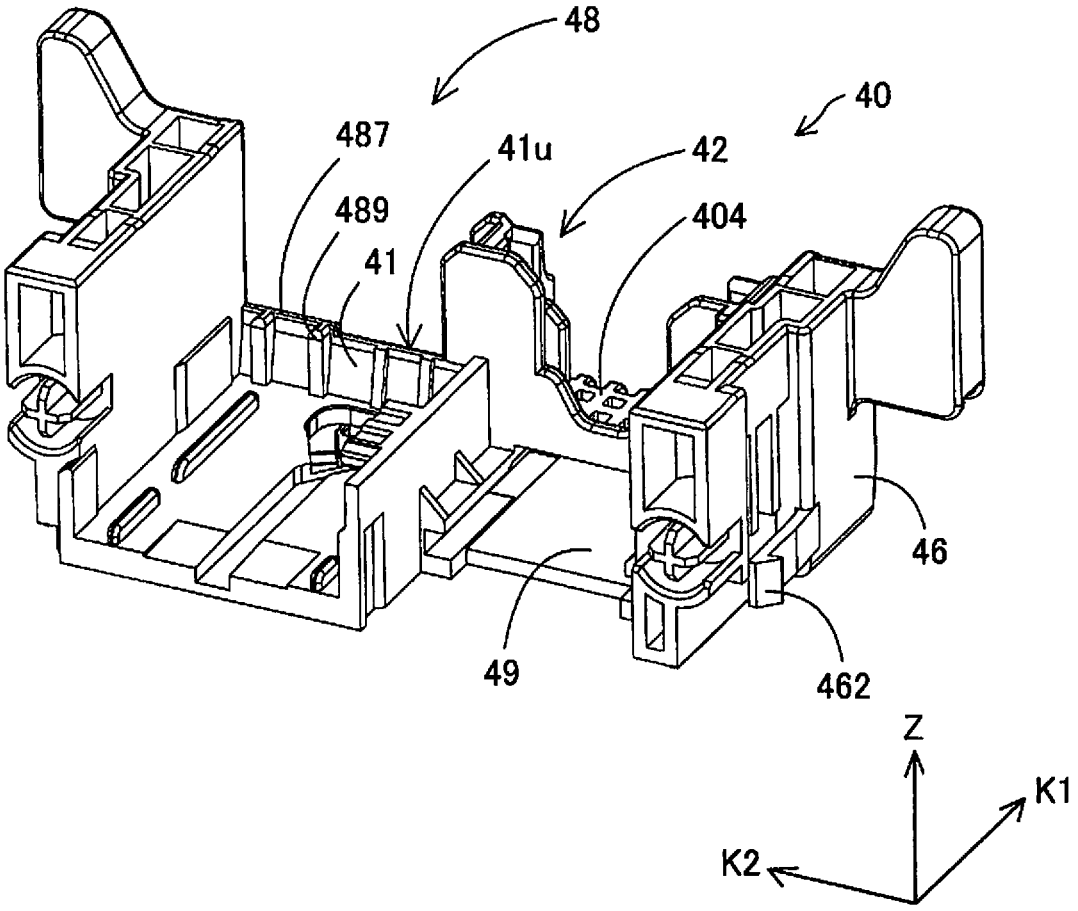
FIG. 6D is a third perspective view of the movable member.

FIG. 5B is a front view of the detachable unit 30. FIG. 5C is a first perspective view for describing the detachable unit 30. FIG. 6A is a second perspective view for describing the detachable unit 30. FIG. 5C shows the first mode (state when set) with the movable member 40 projecting in the outward direction in relation to the stationary member 35. FIG. 6A shows the second state (state when mounted) with the movable member 40 housed in the stationary member 35. FIG. 6B is a first perspective view of the movable member 40. FIG. 6C is a second perspective view of the movable member 40. FIG. 6D is a third perspective view of the movable member 40. FIG. 5B to FIG. 6D are for describing the constitution of the detachable unit 30C as an example, but the detachable unit 30C has the same constitution for the other detachable units 30K, 30M, and 30Y as well. As shown in FIG. 5C, the detachable unit 30 is equipped with a stationary member 35 and a movable member (first support part) 40. The movable member 40 can be moved in the +K1 axis direction and the −K1 axis direction (first direction, connection direction).

The liquid container 50 is mounted on the detachable unit 30 by executing the two operations below. The state of the liquid container 50 being mounted on the detachable unit 30 is also called the "mounted state (connected state)." The mounted state (connected state) is the state for which the liquid supply part 57 (liquid outlet part 57) described later of the liquid container 50 is connected to the liquid introduction part (liquid introduction needle) 362 of the detachable unit 30, and the circuit substrate 582 of the liquid container 50 is electrically connected to the electrical connection part 382 of the detachable unit 30. With the mounted state, the ink housed in the liquid container 50 is in a state that can be supplied to the printer 10 side.

First Operation

The user sets the liquid container 50 in the movable member 40 after putting the detachable unit 30 in the first state.

Second Operation

After the first operation, the user puts the detachable unit 30 in the second state by pushing forward the movable member 40 to the stationary member 35 side via the liquid container 50.

With the second state of the detachable unit 30, the movable member 40 has its movement to the +K1 axis direction side in relation to the stationary member 35 regulated by a locking mechanism. With the second state, by pushing the movable member 40 in the inside direction in relation to the stationary member 35 (the −K1 axis direction, first direction), the lock by the locking mechanism is released. By doing this, the movable member 40 is moved so as to project outward (+Z axis direction) in relation to the stationary member 35, and it is possible to switch the state of the detachable unit 30 from the second state to the first state.

As shown in FIG. 5B, the stationary member 35 has a first attachment wall 307A projecting in the gravity upward direction, and a second attachment wall 307B projecting in the gravity downward direction. Two through holes 302H are formed on the first attachment wall 307A, and two through holes 302H are formed on the second attachment wall 307B. A screw 302 (FIG. 5C) which is a fixing member is inserted in each through hole 302H, and the detachable unit 30 (in more detail, the stationary member 35) is fixed to surfaces 104 and 106 of the printer 10 (FIG. 3 and FIG. 4) by four screws 302. In more detail, the detachable unit 30K (FIG. 3) is fixed to the second surface 104 by a plurality of screws 302, and the detachable units 30C, 30M, and 30Y (FIG. 4) are fixed to the third surface 106 by a plurality of screws 302.

As shown in FIG. 5B, the stationary member 35 is equipped with a liquid introduction structure 36 and a contact point structure (electrical connection unit) 38. The liquid introduction structure 36 and the contact point structure 38 are respectively supported by the outer wall of the printer 10 (e.g. the device third surface 106) via the stationary member 35 by being fixed to the stationary member 35.

The liquid introduction structure 36 and the contact point structure 38 are arranged aligned along the K2 axis direction. Also, the liquid introduction part (liquid supply connection part) 362 of the liquid introduction structure 36 and the electrical connection part (device side electrical connection part) 382 of the contact point structure 38 are arranged adjacent in the K2 axis direction. Of the K2 axis direction, the direction facing from the liquid introduction structure 36 toward the contact point structure 38 is the +K2 axis direction, and the direction facing from the liquid introduction structure 38 to the contact point structure 36 is the −K2 axis direction. Also, with the detachable unit 30, the Z axis direction is also called the "height direction," the K1 axis direction is also called the "width direction," and the K2 axis direction is also called the "depth direction."

The liquid introduction structure 36 includes a liquid introduction main unit part 368, a liquid introduction part 362, and a supply part positioning part 364. By a liquid supply part described later that the liquid container 50 has being connected to the liquid introduction part 362, ink housed in the liquid container 50 is supplied. The liquid introduction part 362 is in communication with the recording head of the printer 10 via a liquid flow tube 320. The liquid flow tube 320 is a flexible hose. The liquid introduction part 362 is connected to the liquid supply part 57 by the liquid supply part (liquid outlet part) 57 (FIG. 9) of the liquid container 50 moving in the −K1 axis direction (first direction) by the movement of the movable member 40.

As shown in FIG. 5C, the liquid introduction part 362 is in a needle form for which ink can be supplied into the interior. The liquid introduction part 362 extends along a central axis CL. The direction along this central axis CL (direction in which the liquid introduction part 362 extends) is the K1 axis direction. The K1 axis direction is orthogonal to the Z axis direction and the K2 axis direction. The plane defined by the K1 axis direction and the K2 axis direction and the plane defined by the X axis direction and the Y axis direction shown in FIG. 1 are parallel. Of the K1 axis directions, the direction facing to the outside of the printer 10 is the +K1 axis direction, and the direction facing to the inside of the printer 10 is the −K1 axis direction. The liquid introduction part 362 and the supply part positioning part 364 are provided on the liquid introduction main unit part 368 so as to protrude to the +K1 axis direction side from the liquid introduction main unit part 368.

As shown in FIG. 5B, the supply part positioning part 364 is arranged at the periphery of the liquid introduction part 362 with the central axis CL (FIG. 5C) as the center. The supply part positioning part 364 performs positioning of the liquid supply part 57 in the direction crossing the K1 axis direction (with this embodiment, the direction along the plane parallel to the Z axis direction and the K2 axis direction) when the liquid supply part (liquid outlet part) 57 and the liquid introduction part 362 are connected.

The supply part positioning part 364 has a first supply part positioning part 364*a*, a second supply part positioning part 364*b*, a third supply part positioning part 364*c*, and a fourth supply part positioning part 364*d*. The first through fourth supply part positioning parts 364*a* to 364*d* are members that respectively project from the liquid introduction main unit part 368. The first supply part positioning part 364*a* projects further to the K1 axis direction side than the other supply part positioning parts 364*b* to 364*d*. Also, the first supply part positioning part 364*a* is positioned directly above the liquid introduction part 362, and projects further to the +K1 axis direction side than the liquid introduction part 362. Specifically, the first supply part positioning part 364*a* is arranged so as to cover the top side of the liquid introduction part 362.

The first supply part positioning part 364*a* is positioned further to the gravity upward direction (+Z axis direction) side than the liquid introduction part 362. The second supply part positioning part 364*b* is positioned further to the −K2 axis direction side than the liquid introduction part 362. The third supply part positioning part 364*c* is positioned further to the +K2 axis direction side than the liquid introduction part 362. The fourth supply part positioning part 364*d* is positioned further to the gravity downward direction (−Z axis direction) side than the liquid introduction part 362. The first and fourth supply part positioning parts 364*a* and 364*d* face opposite sandwiching the liquid introduction part 362 in the gravity direction. The second and third supply part positioning parts 364*b* and 364*c* face opposite sandwiching the liquid introduction part 362 in the K2 axis direction.

The first through fourth supply part positioning parts 364*a* to 364*d* respectively have a flat plane facing opposite the liquid introduction part 362. Positioning of the liquid supply part 57 in the perpendicular surface direction to the K1 axis direction in relation to the liquid introduction part 362 is performed by having the liquid supply part 57 of the liquid container 50 abut this plane.

As shown in FIG. 5B and FIG. 6A, the liquid introduction main unit part 368 further has a guide part 365 positioned further to the gravity downward direction side than the liquid introduction part 362. The guide part 365 is a plate shaped member extending in the +K1 axis direction from the bottom end part of the liquid introduction main unit part 368. The guide part 365 is arranged inside an induction part 465 which is a through hole described later that the movable member 40 is equipped with. The guide part 365 is provided with a small amount of looseness in the Z axis direction inside the induction part 465. By doing this, when the movable member 40 moves in the K1 axis direction, it is possible to do fine adjustment of the position of the movable member 40 in relation to the liquid introduction part 362 in the Z axis direction. The details of this will be described later.

As shown in FIG. 5B to FIG. 6A, the contact point structure 38 is equipped with the electrical connection part (main unit side electrical connection part) 382 which includes a plurality of (with this embodiment, nine) device side terminals 381, and a plurality of (with this embodiment, two) device side substrate positioning parts 384 and 385. In the mounted state of the liquid container 50, the device side terminals 381 of the electrical connection part 382 are electrically connected by contacting the circuit substrate of the liquid container 50. By doing this, it is possible to communicate various types of information (e.g. the ink color and manufacturing date of the liquid container 50) between the circuit substrate of the liquid container 50 and the printer 10. The device side terminal 381 is formed by a metal plate spring that is elastically deformable. The device side substrate positioning parts 384 and 385 are arranged so as to sandwich the device side terminal 381 of the electrical connection part 382 in the K2 axis direction (direction in which the liquid introduction structure 36 and the contact point structure 38 are aligned). When the liquid container 50 is mounted on the detachable unit 30, the device side substrate positioning parts 384 and 385 perform the final positioning of the circuit substrate of the liquid container 50 in relation to the electrical connection part 382. The device side substrate positioning parts 384 and 385 are members that extend along the K1 axis direction. The details of the device side substrate positioning parts 384 and 385 will be described later.

The stationary member 35 has a protecting member 354 as the cover part. The protecting member 354 is arranged to as to cover at least the top part of the liquid introduction structure 36. Specifically, the protecting member 354 is positioned on the upper side of the liquid introduction part 362 of the liquid introduction structure 36 and the electrical connection part 382 of the contact point structure 38, and is arranged so as to project from the wall surface of the printer 10 (e.g. the device third surface 106 in FIG. 2) to the +K1 axis direction side (direction opposite to the first direction). By doing this, when opening and closing the cover member 22 or the like, it is possible to reduce the possibility of foreign matter such as debris or the like that penetrates inside the housing space part 26 from the upper side of the detachable unit 30 adhering to the liquid introduction part 362 or the electrical connecting part 382. By doing this, it is possible to reduce the possibility of foreign matter mixing into the ink supplied to the printer 10 from the liquid container 50. It is also possible to reduce the possibility of foreign matter adhering to the electrical connection part 382. By doing this, it is possible to inhibit the occurrence of connection failures between the electrical connection part 382 and the circuit substrate of the liquid container 50 described later. Also, using the protecting member 354, it is possible to reduce the possibility of the user directly touching the liquid introduction part 362 and the electrical connection part 382. By doing this, it is possible to reduce the possibility of damage to the liquid introduction part 362 and the electrical connection part 382.

As shown in FIG. 5C, the movable member 40 is constituted to be able to move along the K1 axis direction in relation to the stationary member 35. The movable member 40 is equipped with a base part 41, a supply part supporting part 42, and a substrate support part 48. The base part 41 forms the front surface (front wall) positioned at the +K1 axis direction side of the movable member 40. The base part 41 is roughly parallel to the Z axis direction and the K2 axis direction. The supply part supporting part 42 and the substrate support part 48 are respectively connected to the base part 41. The supply part supporting part 42 and the substrate support part 48 are respectively members that extend in the +Z axis direction side (upper side) from the base part 41. The induction part 465 which is a hole that pierces through the K1 axis direction is formed on the base part 41. The induction part 465 is formed directly under the supply part supporting part 42.

The supply part supporting part 42 is a member for determining the position of the liquid container 50 (in more detail, the liquid supply part) in relation to the liquid introduction part. Also, the supply part supporting part 42 supports a housing part support assembly 51 so that the liquid containing part 52 is positioned further to the gravity downward direction side than the housing part support assembly 51 by contacting the housing part support assembly 51 described later of the liquid container 50. When the detachable unit 30 is seen along the K1 axis direction, the supply part supporting part 42 is provided at a position overlapping the liquid introduction part 362. The supply part supporting part 42 is provided so as to form a concave shape facing the −Z axis direction. The supply part supporting part 42 has groove parts 407 formed on both sides in the K2 axis direction. By the positioning part described later of the liquid container 50 being pushed into the groove part 407, the movement of the liquid supply part that the liquid container 50 is equipped with is regulated, and the positioning of the liquid container 50 in relation to the detachable unit 30 is performed to a certain degree. Specifically, by a plurality of surface parts (e.g. a first support surface part 402, a second support surface part 403, and a third support surface part 404) that do partition formation of the supply part supporting part 42, the movement of the liquid supply part that the liquid container 50 is equipped with is regulated. Of the supply part supporting part 42, a notch part 406 is formed on the first support surface part 402 positioned at the liquid introduction part 362 side. The notch part 406 has a concave shape opened at the +Z axis direction side. When the detachable unit 30 is seen along the K1 axis direction, the notch part 406 is provided at a position overlapping the liquid introduction part 362. In the first state for which the movable member 40 is moved furthest to the +K1 axis direction in relation to the stationary member 35, the notch part 406 is positioned further to the +K1 axis direction side than the liquid introduction part 362. As shown in FIG. 6A, in the second state, the tip end of the liquid introduction part 362 is positioned inside the notch part 406.

The substrate support part 48 is a member for determining the position of the liquid container 50 (in more detail, the circuit substrate) in relationship to the contact point structure 38. When the detachable unit 30 is viewed along the K1 axis direction, the substrate support part 48 is provided at a position overlapping with the contact point structure 38. The substrate support part 48 is provided so as to form a concave shape facing the −Z axis direction. The movement of the circuit substrate of the liquid container 50 is regulated by a plurality of surface parts (e.g. the first substrate support surface part 482) that do partition formation of the substrate support part 48.

As shown in FIG. 6D, a portion of a bottom part 41*u* (the top part of the base part 41) of the substrate support part 48 forms a device side rotation regulating part 487. The device side rotation regulating part 487 is a member that projects further to the +Z axis direction side than the other part of the bottom part 41*u*. The device side rotation regulating part 487 regulates the rotation of the liquid container 50 by abutting the liquid container 50. Also, the substrate support part 48 has a device side regulating part 489 provided on the back surface of the base part 41. The device side regulating part 489 is a rib formed along the top part from the bottom part of the back surface of the base part 41. The device side regulating part 489 regulates the movement of the liquid container 50 in the +K1 axis direction (direction opposite to the first direction) by abutting the liquid container 50.

As shown in FIG. 6B to FIG. 6D, the movable member 40 further has a first side surface (first side wall) 46, a second side surface (second side wall) 47, and a bottom part 49 (bottom wall 49). The base part 41, the first side surface 46, and the second side surface 47 are respectively members that extend in the +Z axis direction side. The first side surface 46 and the second side surface 47 face mutually opposite each other. The first side surface 46 and the second side surface 47 are roughly parallel to the Z axis direction and the K1 axis direction. The bottom part 49 is roughly parallel to the K1 axis direction and the K2 axis direction.

As shown in FIG. 6D, a latching hook 462 is arranged on the first side surface 46. Also, a latching hook 472 (FIG. 6G) is formed on the second side surface in the same manner as the first side surface 46. The latching hooks 462 and 472 prevent excessive movement of the movable member 40 to the +K1 axis direction side by latching with the stationary member 35. By doing this, it is possible to prevent the movable member 40 from coming off the stationary member 35.

A-3. Schematic Structure of Liquid Introduction Structure 36

Figure 6E:
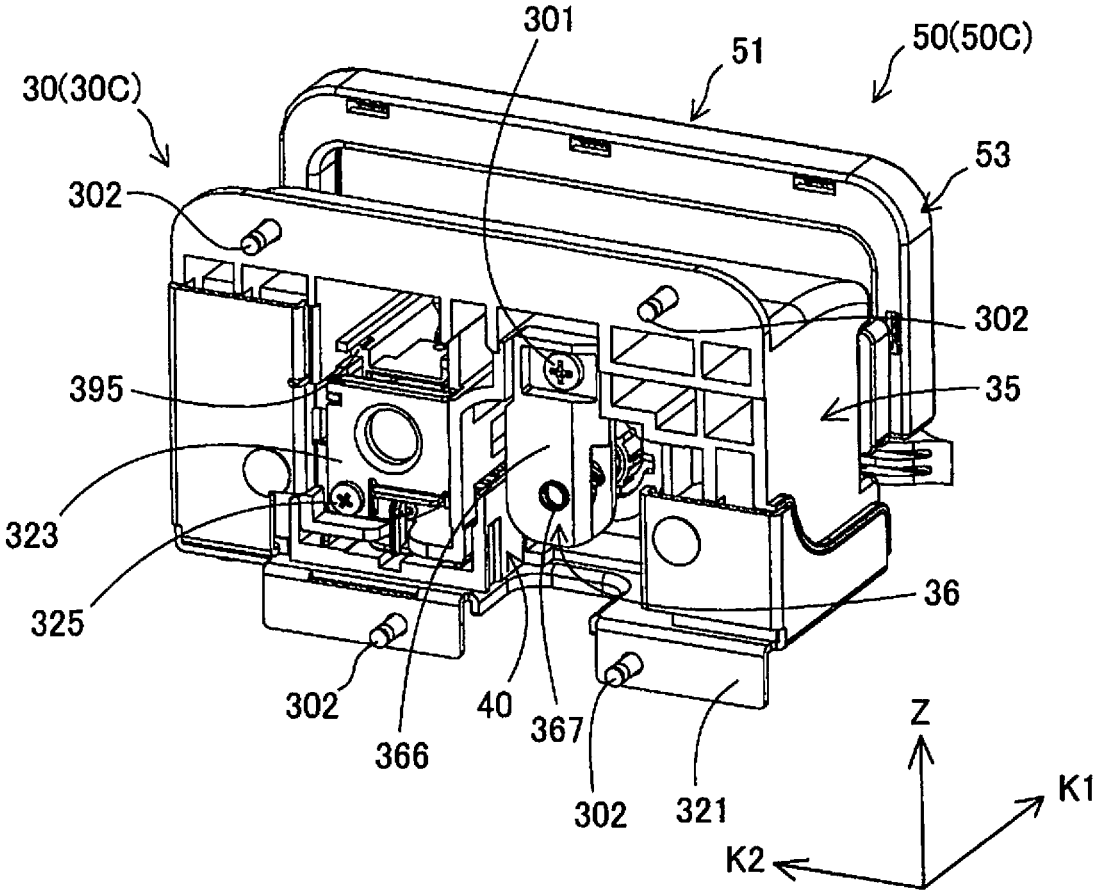
FIG. 6E is a perspective view of the detachable unit.
Figure 6F:
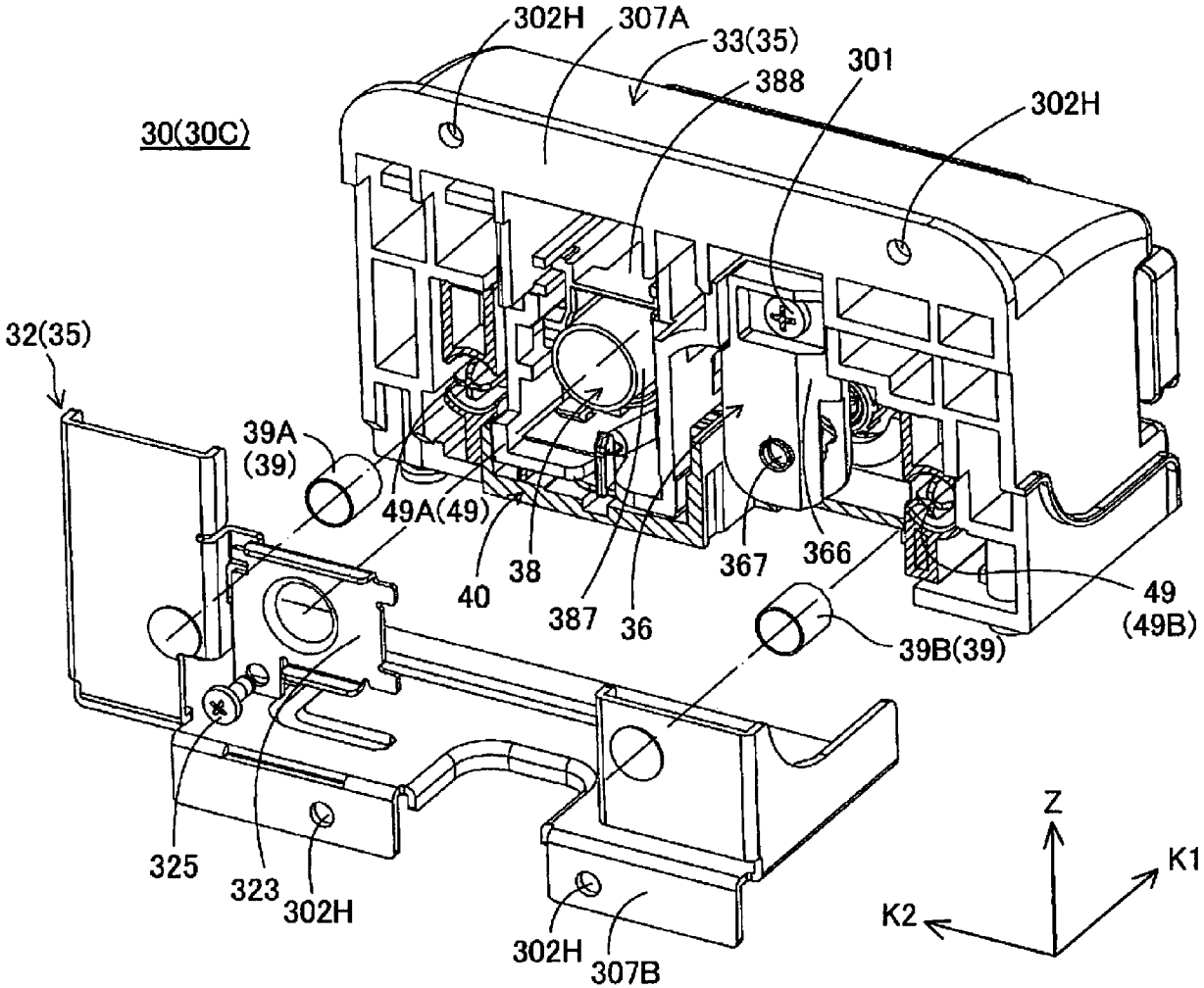
FIG. 6F is an exploded perspective view of the detachable unit.
Figure 6G:
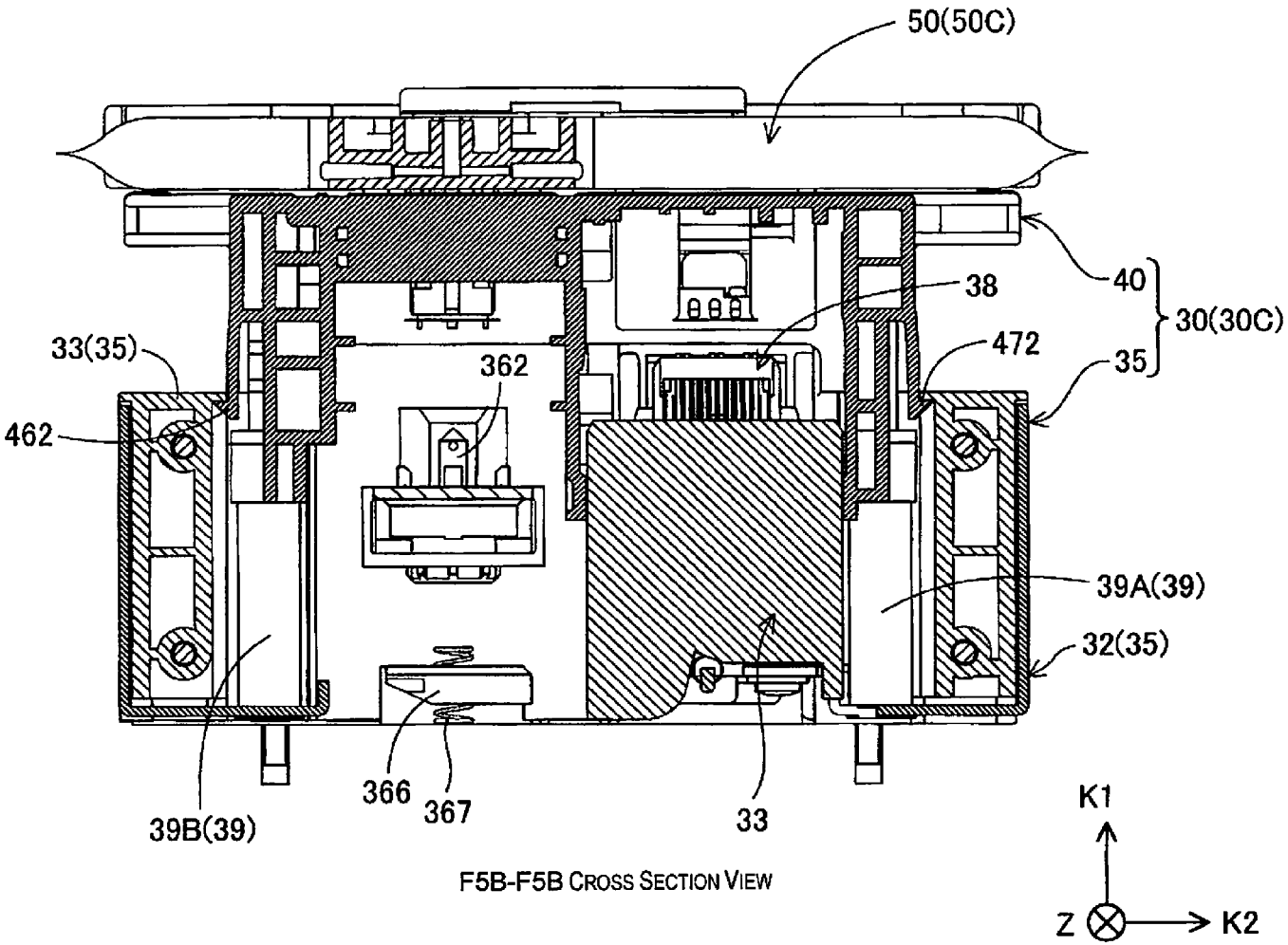
FIG. 6G is a cross section view of F5Ba-F5Ba of FIG. 5F.

FIG. 6E is a perspective view of the detachable unit 30. FIG. 6F is an exploded perspective view of the detachable unit 30. FIG. 6G is a cross section view of F5Ba-F5Ba of FIG. 5. For easier understanding, in FIG. 6E, shown is the housing part support assembly 51 equipped in the liquid container 50 set in the detachable unit 30. Also, for easier understanding, in FIG. 6F, single hatching is applied to the −K axis direction side end surface of the movable member 40. Also, in FIG. 6G, for easier understanding, the liquid container 50 is also shown.

As shown in FIGS. 6E and 6F, the liquid introduction structure 36 is attached by screw 361 to stationary member 35 (in more detail, the second stationary member 33). The liquid introduction structure 36 has a stationary structure 366 as a second support part attached directly to the stationary member 35, and a coil spring 367 as an urging member.

The coil spring 367 is inserted through the stationary structure 366. One end portion of the coil spring 367 projects further to the −K1 axis direction side than the stationary structure 366, and the other end portion of the coil spring 367 projects further to the +K1 axis direction side than the stationary structure 366. The liquid introduction part 362 is energized to the +K1 axis direction side by the coil spring 367. The stationary structure 366 supports the liquid introduction structure 36 including the liquid introduction part 362 to be able to be displaced in a direction that intersects the first direction (−K1 axis direction). With this embodiment, the direction that intersects the first direction is the direction along the surface parallel to the K2 axis direction and the Z axis direction. The details of this are described later.

As shown in FIG. 6F, the stationary member 35 is equipped with a first stationary member 32, a second stationary member 33, and a sheet metal 323. A second attachment wall 307B is provided on the first stationary member 32, and a first attachment wall 307A is provided on the second stationary member 33. The first stationary member 32 is an auxiliary member for supporting the second stationary member 33. Two coil springs 39A and 39B are arranged as urging members between the first stationary member 32 and the movable member 40. The coil springs 39A and 39B are arranged at positions sandwiching the contact point structure 38 and the liquid introduction structure 36 in the K2 axis direction. When using the two coil springs 39A and 39B without distinguishing between them, the code number 39 is used.

One end of the coil spring 39 abuts the first stationary member 32, and the other end of the coil spring 39 abuts the movable member 40. Also, the spring bearing 49A of the movable member 40 is inserted in the other end portion side of the coil spring 39A, and the spring bearing 49B of the movable member 40 is inserted in the other end portion side of the coil spring 39B. When using the two spring bearings 49A and 49B without distinguishing between them, the code number 49 is used.

When the detachable unit 30 is in the second state shown in FIG. 6A, the coil spring 39 energizes the movable member 40 in the +K1 axis direction side. In the second state, the movable member 40 has its movement to the +K1 axis direction side regulated by a locking mechanism (not illustrated). By releasing the lock of the locking mechanism, the movable member 40 is pushed to the +K1 axis direction side by the energizing force of the coil spring 39, and the detachable unit 30 goes to the first state shown in FIG. 5C. As shown in FIG. 6G, the latching hooks 462 and 472 are latched to the stationary member 35 so that the movable member 40 does not move excessively to the +K1 axis direction side in relation to the stationary member 35. By doing that, falling out of the movable member 40 from the stationary member 35 is prevented.

As shown in FIG. 6E and FIG. 6F, the sheet metal 323 is attached to the second stationary member 33 by a screw 325.

A-4. Detailed Constitution of Contact Point Structure 38 and Detachable Unit 30

Figure 6H:
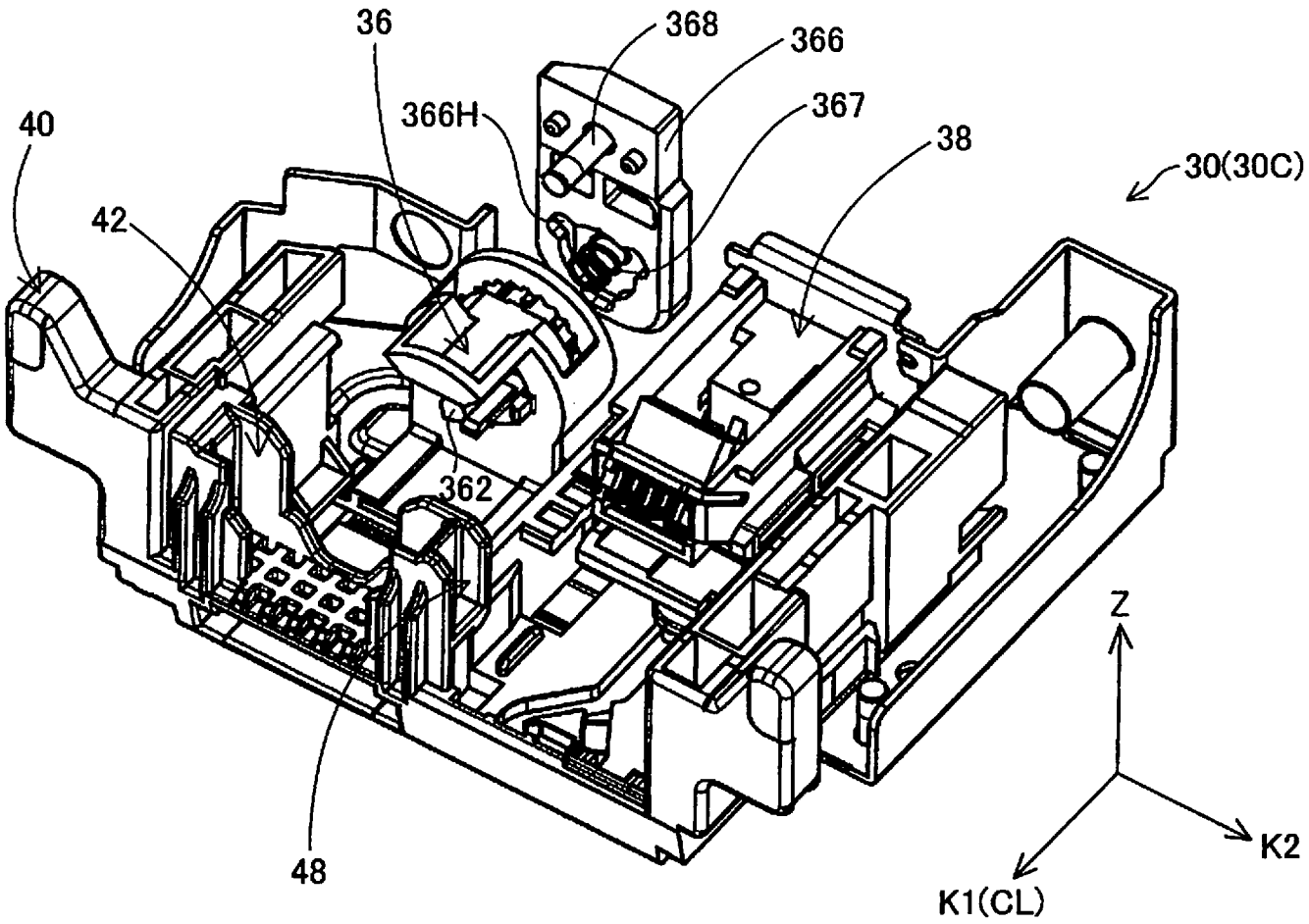
FIG. 6H is a partial perspective view of the detachable unit.
Figure 6I:
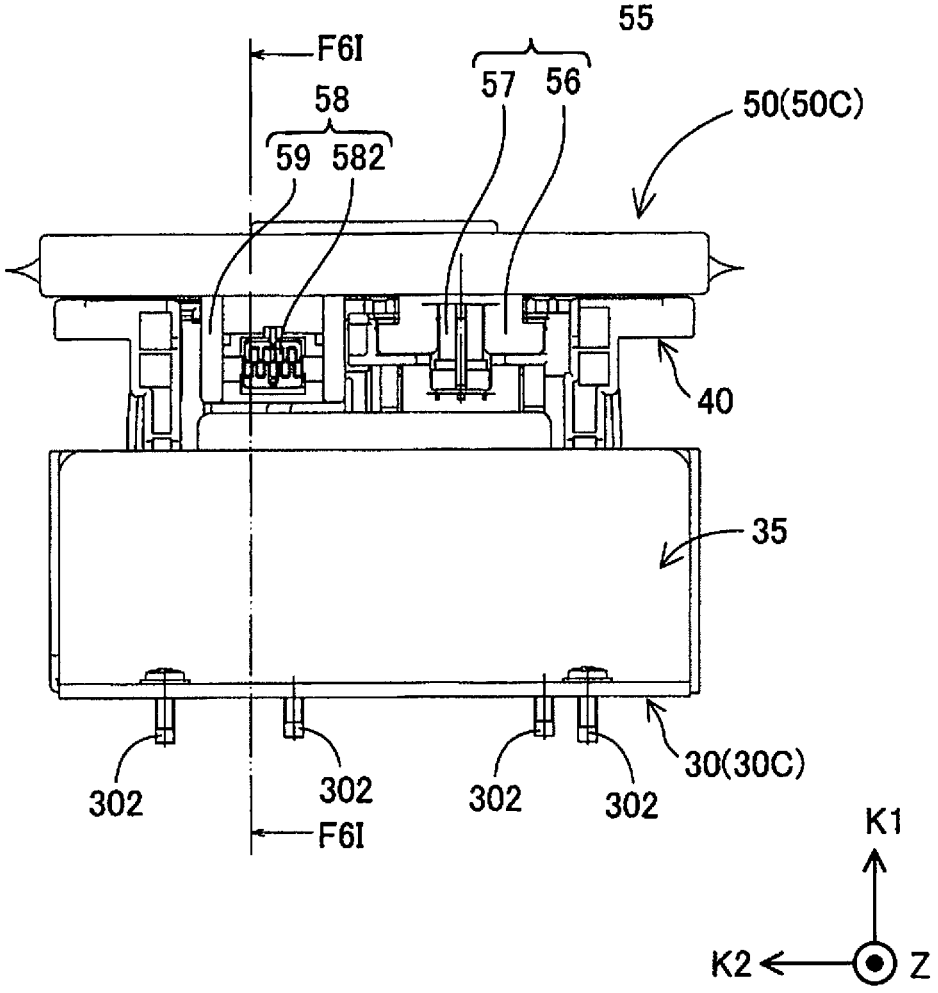
FIG. 6I is a top view of the detachable unit.
Figure 6J:
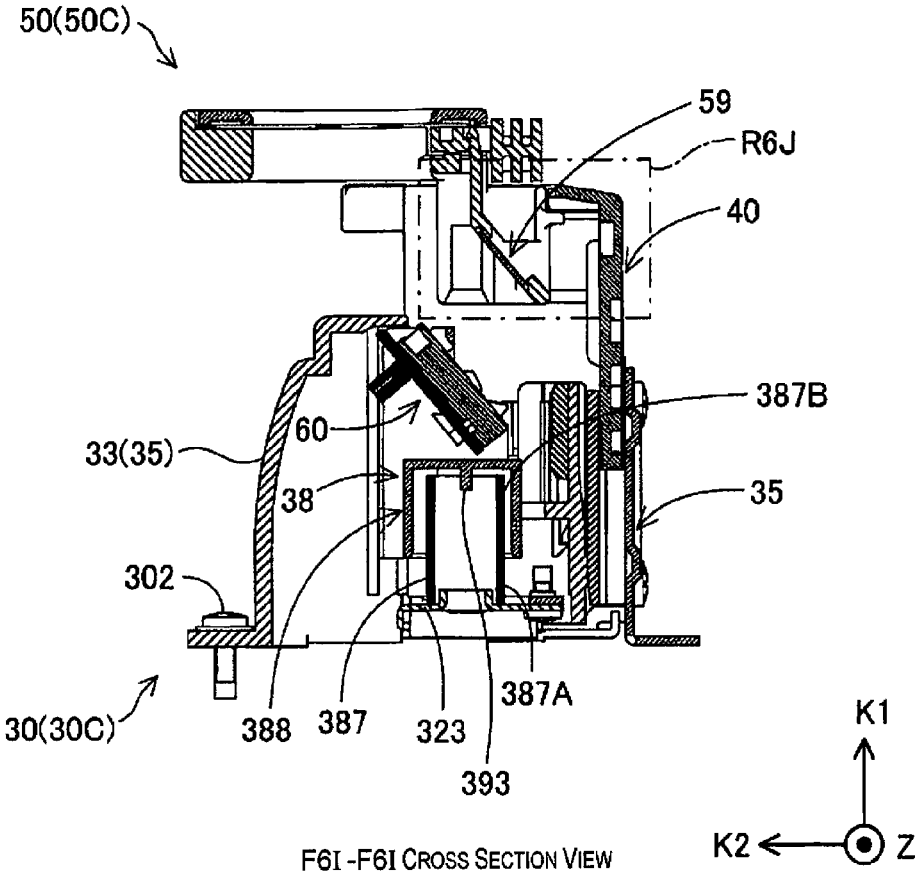
FIG. 6J is a cross section view of F6I-F6I of FIG. 6I.
Figure 6K:
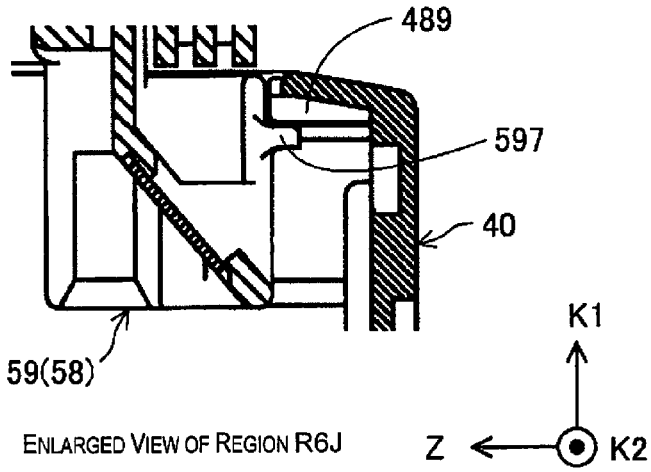
FIG. 6K is a partial enlarged view of region R6J of FIG. 6J.
Figure 6L:
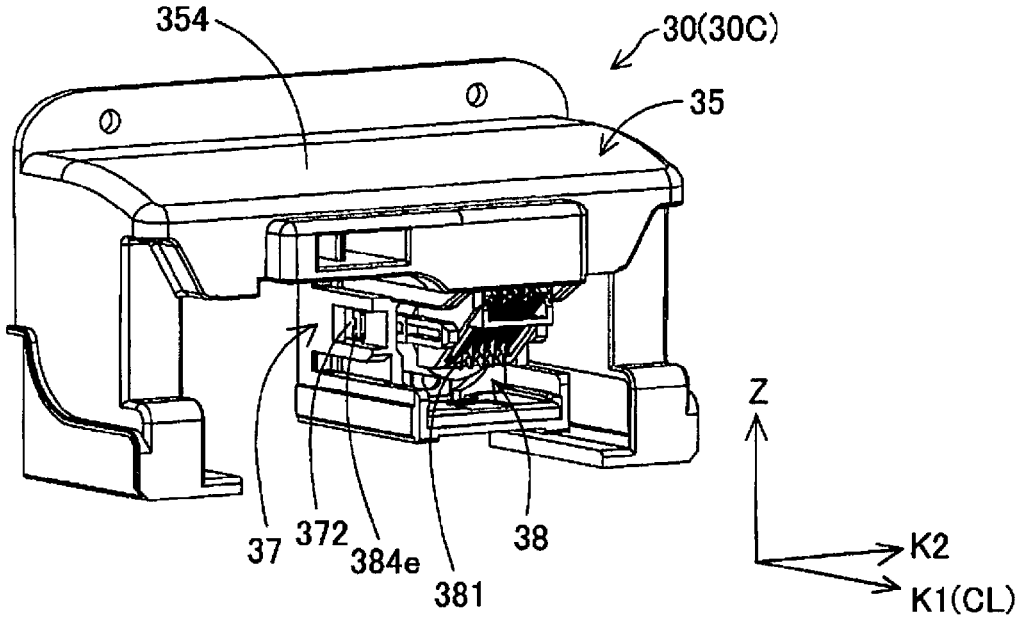
FIG. 6L is a perspective view with the contact point structure attached to the stationary member.
Figure 6M:
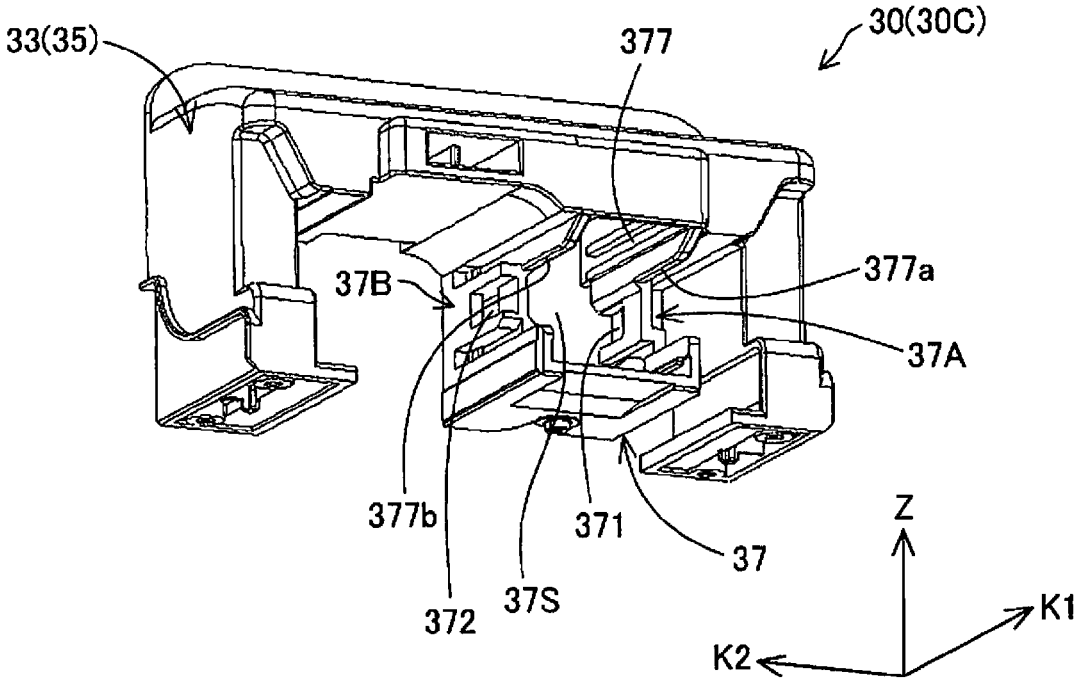
FIG. 6M is a perspective view of the stationary member.
Figure 6N:
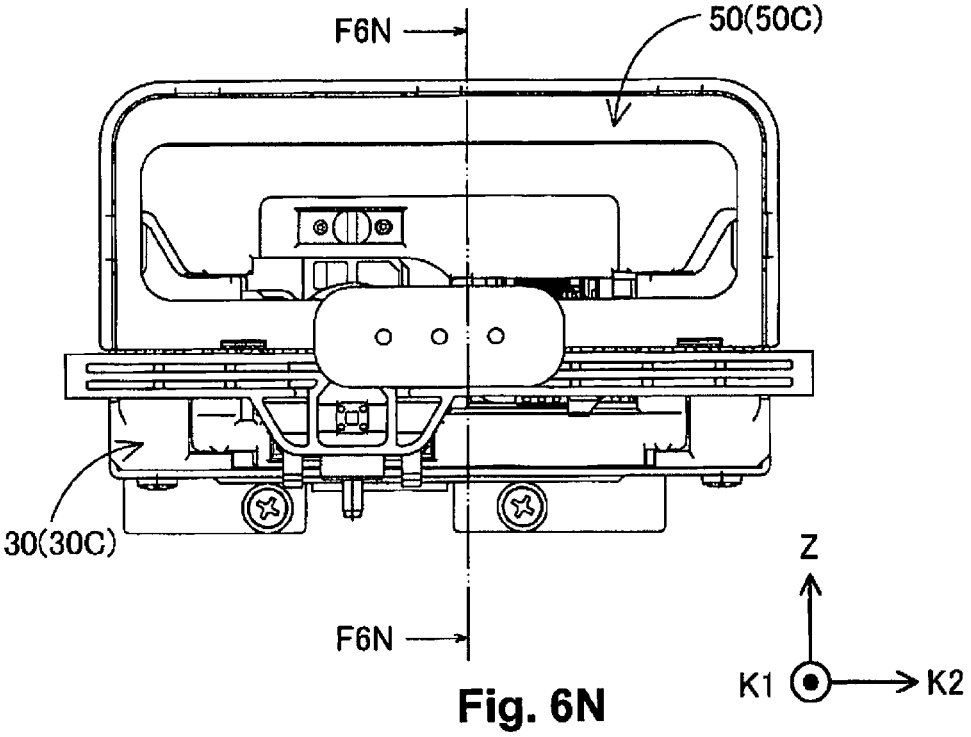
FIG. 6N is a front view of the detachable unit.
Figure 6O:
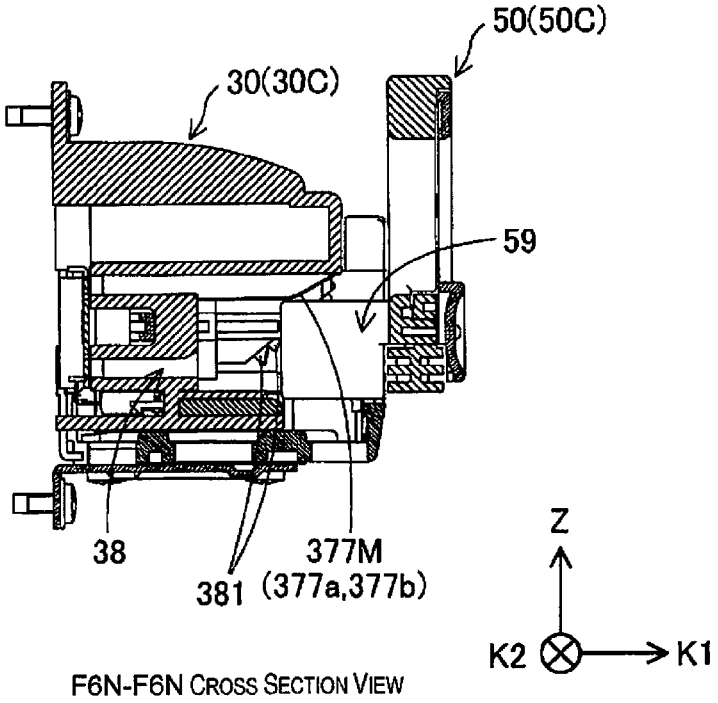
FIG. 6O is a cross section view of F6N-F6N of FIG. 6N.
Figure 6P:
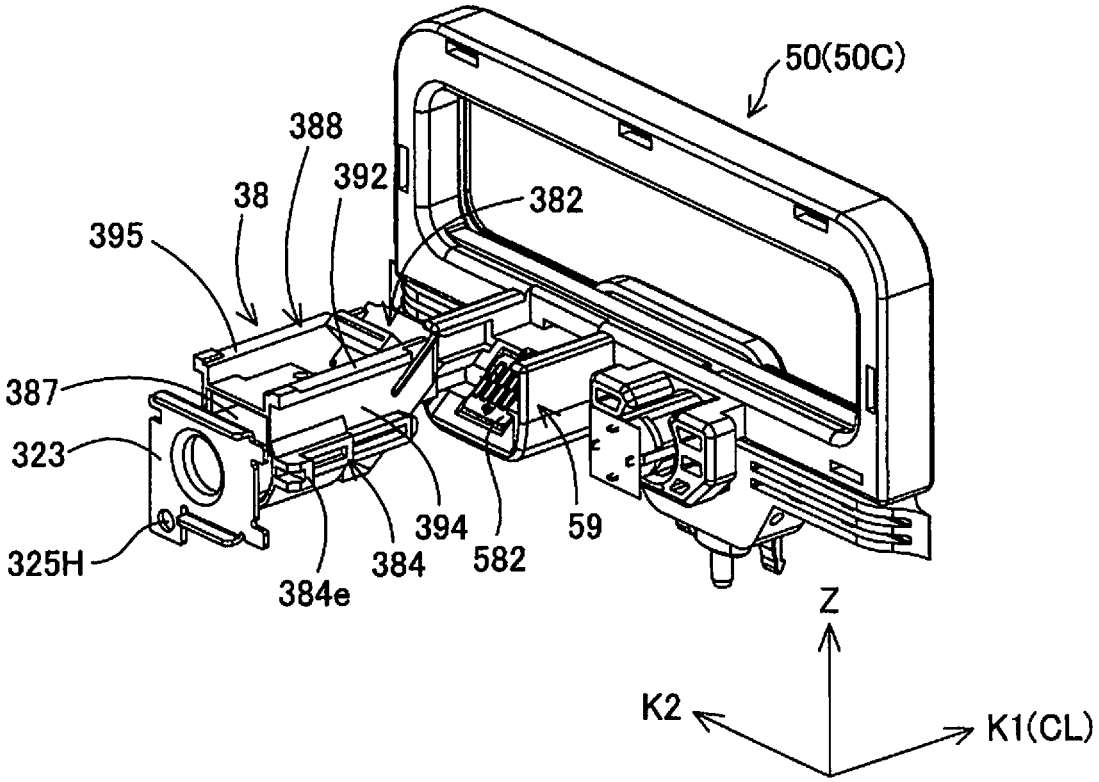
FIG. 6P is a perspective view of the contact point structure.
Figure 6Q:
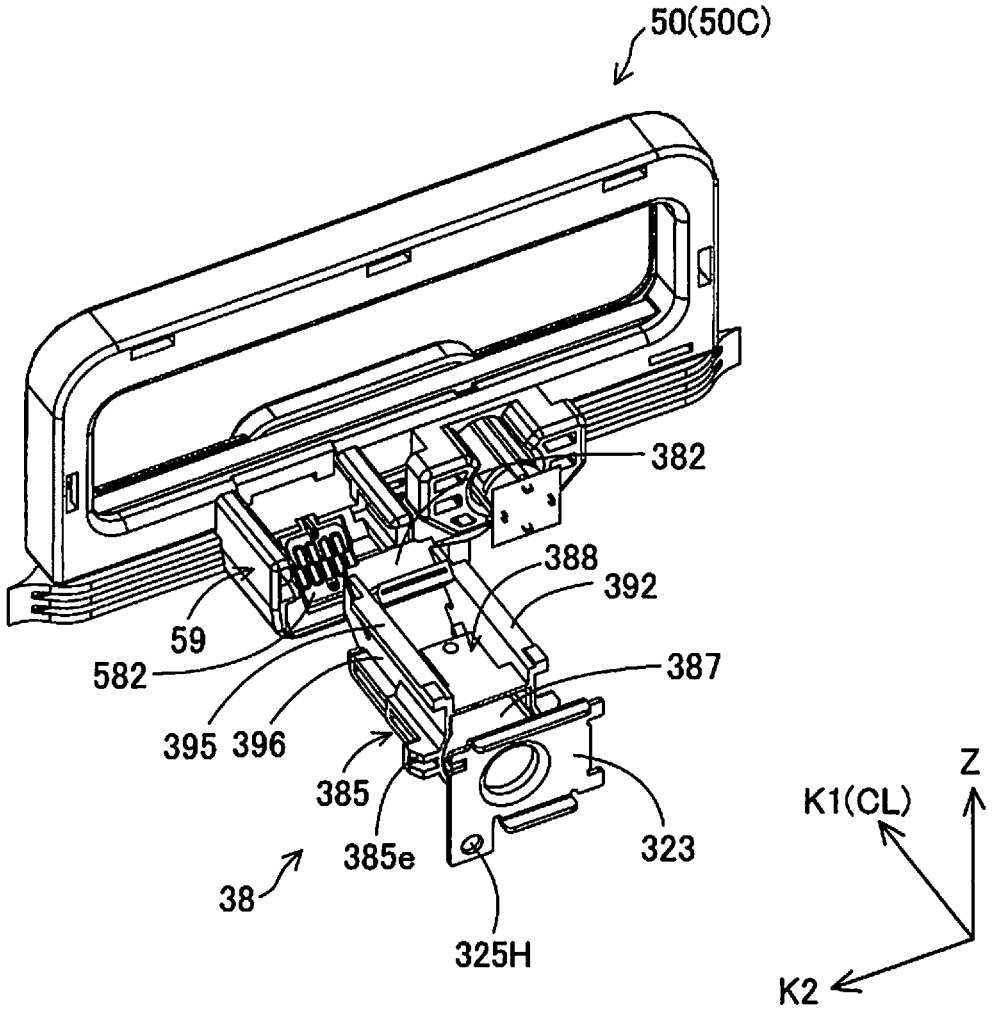
FIG. 6Q is a perspective view of the contact point structure.
Figure 6R:
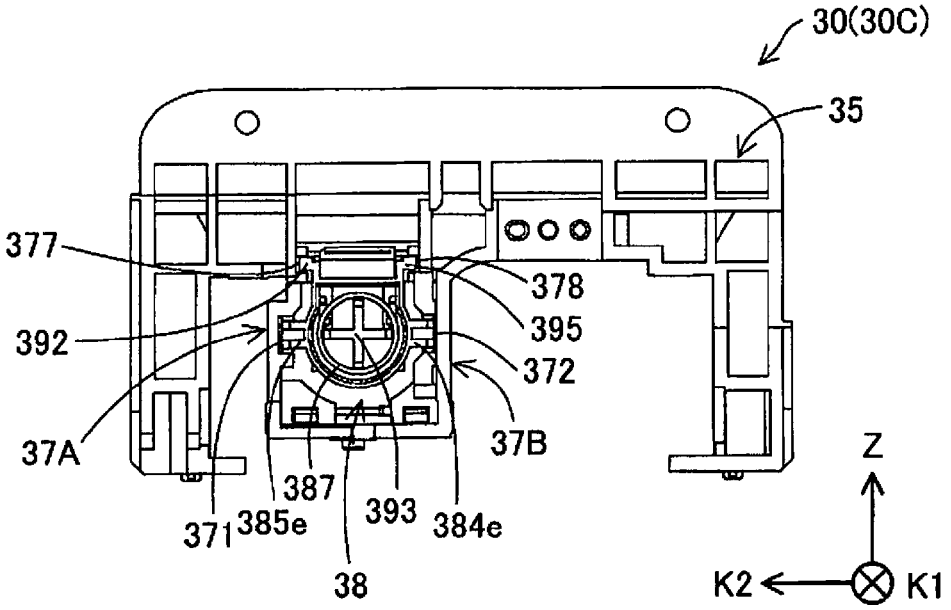
FIG. 6R is a rear view of FIG. 6E.
Figure 6S:
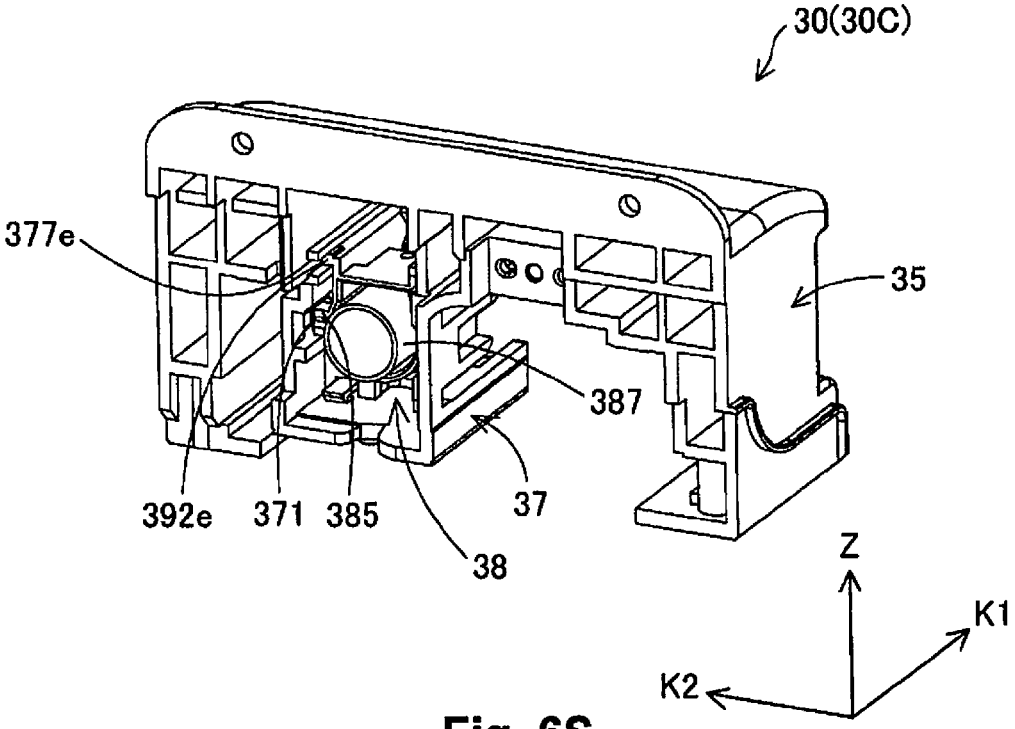
FIG. 6S is a perspective view of FIG. 6R.
Figure 6T:
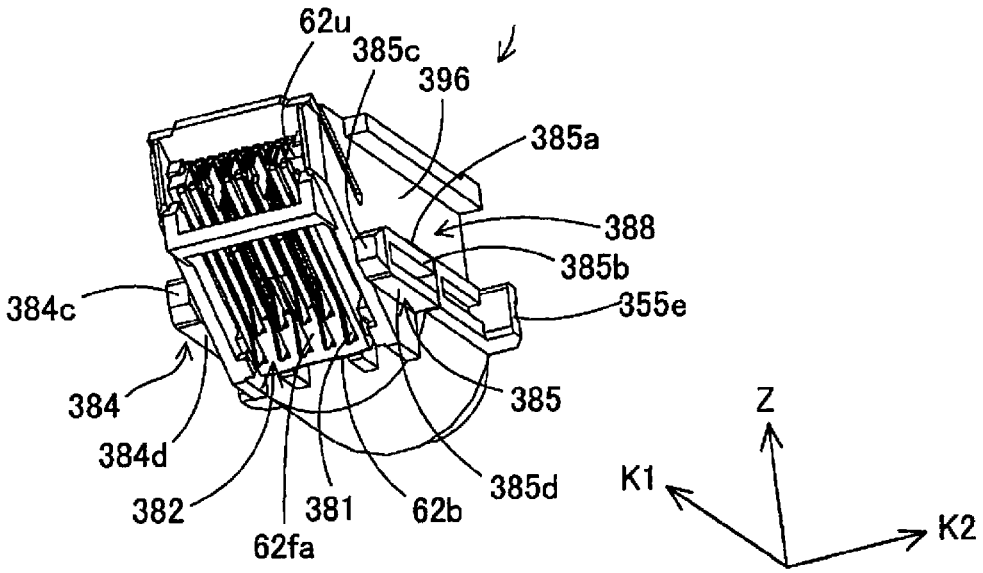
FIG. 6T is a perspective view of the contact point structure.
Figure 6U:
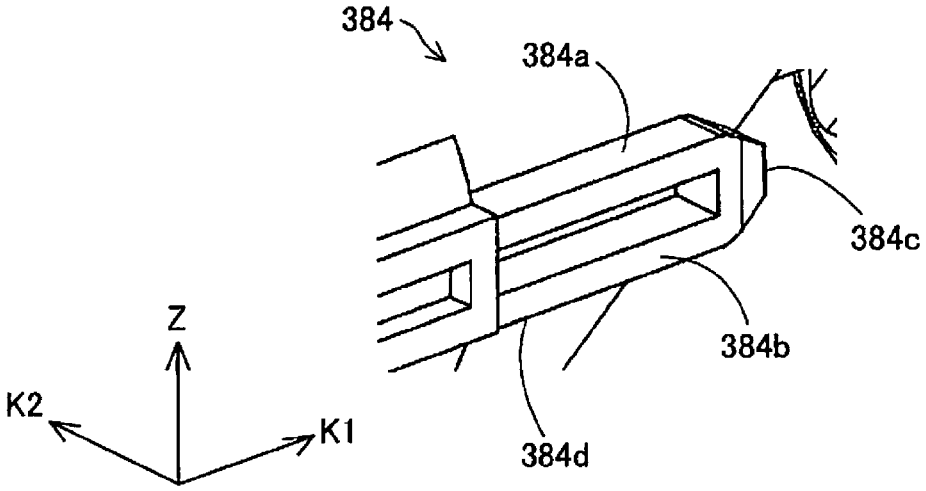
FIG. 6U is an enlarged view of the device side substrate positioning part of the contact point structure.
Figure 6V:
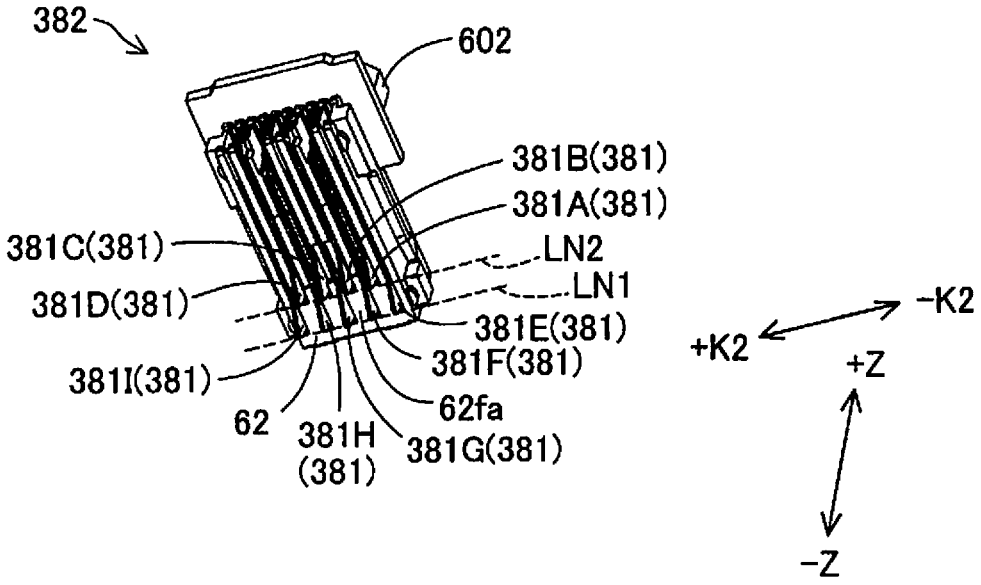
FIG. 6V is a perspective view of the electrical connection part.

In addition to FIG. 6E, FIG. 6F, and FIG. 6G, we will describe the detailed constitution of the contact point structure 38 and the detachable unit 30 using FIG. 6H to FIG. 6V. FIG. 6H is a partial perspective view of the detachable unit 30. FIG. 6I is a top view of the detachable unit 30. FIG. 6J is a cross section view of F6I-F6I of FIG. 6._FIG. 6K is a partial enlarged view of region R6J of FIG. 6J. FIG. 6L is a perspective view with the contact point structure 38 attached to the stationary member 35. FIG. 6M is a perspective view of the stationary member 35. FIG. 6N is a front view of the detachable unit 30. FIG. 6O is a cross section view of F6N-F6N of FIG. 6N. FIG. 6P is a perspective view of the contact point structure 38. FIG. 6Q is a perspective view of the contact point structure 38. FIG. 6R is a rear view of FIG. 6E. FIG. 6S is a perspective view of FIG. 6R. FIG. 6T is a perspective view of the contact point structure 38. FIG. 6U is an enlarged view of the device side substrate positioning part 384 of the contact point structure 38. FIG. 6V is a perspective view of the electrical connection part 382. The liquid container 50 is also shown in FIG. 6I. A portion of the liquid container 50 is shown in FIG. 6N, FIG. 6P, and FIG. 6Q. FIG. 6R omits illustrations of the sheet metal 323 of the coil spring 325 of FIG. 6E.

As shown in FIG. 6L and FIG. 6M, the second stationary member 33 has a stationary structure 37 to which the contact point structure 38 is attached. The contact point structure 38 is attached to the stationary structure 37 with a slight looseness provided. By doing this, the electrical connection part 382 of the contact point structure 38 can be displaced in the direction (with this embodiment, the direction along the surface parallel to the Z axis direction and the K2 axis direction) intersecting the first direction (−K1 axis direction). The details of this are described later.

As shown in FIG. 6M, the stationary structure 37 has a receiving space part 37S for receiving the contact point structure 38. Also, the stationary structure 37 has a first partition wall 37A and a second partition wall 37B for partitioning the receiving space part 37S. The first partition wall 37A forms a side surface of the −K2 axis direction side of the receiving space part 37S. The second partition wall 37B forms a side surface of the +K2 axis direction side of the receiving space part 37S.

The first partition wall 37A has a first attachment part 377 (right side first attachment part 377), a second attachment part 371 (right side second attachment part 371), and a device side upper side regulating part 377*a*. The first and second attachment parts 377 and 371 are parts for attaching the contact point structure 38. The first attachment part 377 is a groove facing the receiving space part 37S. The second attachment part 371 is a through hole for receiving a portion of the contact point structure 38. The second attachment part 371 can be any shape that receives a portion of the contact point structure 38, and can be a groove shape. The device side upper side regulating part 377*a* is a surface facing the gravity downward direction. The device side upper side regulating part 377*a* regulates the movement of the substrate unit 58 to the upper side of the gravity direction (Z axis direction) by 50 abutting the substrate unit 58 when the substrate unit 58 (FIG. 7) of the liquid container 50 is connected to the electrical connection part 382 of the contact point structure 38.

The second partition wall 37B has a different arrangement position than the first partition wall 37A, but has the same shape. Specifically, the second partition wall 37B has a first attachment part 378 (left side first attachment part) shown in FIG. 6R, a second attachment part 372 (left side second attachment part) shown in FIG. 6M, and a device side upper side regulating part 377*b* (FIG. 6M). The first attachment part 378 has the same constitution as the first attachment part 377 of the first partition wall 37A, and the second attachment part 372 has the same constitution as the second attachment part 371 of the first partition wall 37A. The device side upper side regulating part 377*b* has the same constitution as the first partition wall 37A. When using the two device side upper side regulating parts 377*a* and 377*b* without distinguishing between them, code number 377M is used.

As shown in FIG. 6O, the device side upper side regulating part 377M is positioned further to the gravity upward direction side than the device side terminal 381. The +K1 axis direction side end portion of the device side upper side regulating part 377M has a tapered shape. Also, the −K1 axis direction side end portion of the device side upper side regulating part 377M has a horizontal surface. Also, the +K1 axis direction side end portion of the device side upper side regulating part 377M is positioned further to the +K1 axis direction side than the device side terminal 381.

As shown in FIG. 6P, the contact point structure 38 is equipped with a coil spring 37 as an urging member, the electrical connection part 382 (FIG. 5B), and a holding member 388 that holds the electrical connection part 382.

As shown in FIG. 6J, a convex part (spring bearing) of the sheet metal 323 is inserted in the one end portion 387A side of the coil spring 387. By doing this, the one end portion 387A side of the coil spring 387 is supported by the sheet metal 323. The other end portion 387B of the coil spring 387 is arranged on the inside of the holding member 388. Also, as shown in FIG. 6J and FIG. 6R, a rib 393 is provided as a spring bearing on the inside of the holding member 388. The other end portion 387B of the coil spring 387 is arranged on the inside of the holding member 388 via an opening of the back surface wall (−K2 axis direction side wall) of the holding member 388. Also, the rib 393 is inserted in the other end portion 387B. By doing this, the other end portion 387B of the coil spring 387 is supported by the holding member 388. The coil spring 387 energizes the holding member 388 to the +K1 axis direction side.

As shown in FIG. 6P, FIG. 6Q, and FIG. 6T, the holding member 388 has a first side wall part 394 and a second side wall part 396. The first side wall part 394 and the second side wall part 396 face opposite. The first side wall part 394 is positioned at the +K2 axis direction side, and the second side wall part 396 is positioned at the −K2 axis direction side. The first side wall part 394 and the second side wall part 396 are surfaces along the roughly gravity direction (Z axis direction).

As shown in FIG. 6P and FIG. 6Q, the contact point structure 38 has the first contact point side positioning part (device side substrate positioning part) 384 and the second contact point side positioning part (device side substrate positioning part) 385 as positioning parts (device side substrate positioning parts). The first and second contact point side positioning parts 384 and 385 perform positioning between the circuit substrate 582 (in more detail, the liquid container side terminal 581 shown in FIG. 13) of the liquid container 50 and the device side terminal 381 of the electrical connection part 382. By this positioning, positioning is performed between the liquid container side terminal 581 and the device side terminal 381 in the +K1 axis direction (first direction) and the direction intersecting the +K1 axis direction (direction along the surface parallel to the axis direction and the K1 axis direction).

The first and second contact point side positioning parts 384 and 385 are arranged so as to sandwich the electrical connection part 382 in the K2 axis direction. The first and second contact point side positioning parts 384 and 385 differ only in that their arrangement positions are different, and they have the same shape.

The first and second contact point side positioning parts 384 and 385 are respectively members extending along the K1 axis direction (connection direction). As shown in FIG. 6P, the first contact point side positioning part 384 projects outward from the first side wall part 394. As shown in FIG. 6Q, the second contact point side positioning part 385 projects outward from the second side wall part 396.

As shown in FIG. 6P, the first contact point side positioning part 384 has a latching part 384*e* at the −K1 axis direction side end portion. As shown in FIG. 6Q, the second contact point side positioning part 385 has a latching part 385*e* at the −K1 axis direction side end portion. As shown in FIG. 6L and FIG. 6M, the latching part 384*e* is latched to the wall surface of the second attachment part 372, and the latching part 385*e* is latched to the wall surface of the second attachment part 371 (not illustrated). By doing this, movement of the holding member 388 energized to the +K1 axis direction side is done by the coil spring 387 (FIG. 6J) in the +K1 axis direction side is regulated.

As shown in FIG. 6U, the first contact point side positioning part 384 has first through fourth regulating parts 384*a* to 384*d* at the +K1 axis direction side end portion. The first through fourth regulating parts 384*a* to 384*d* perform positioning of the substrate unit 58 (FIG. 9) of the liquid container 50 in relation to the electrical connection part 382. This positioning is positioning in the first direction (+K1 axis direction) and the direction intersecting the first direction (direction parallel to the plane defined by the Z axis direction and the K2 axis direction).

As shown in FIG. 6U, the first regulating part 384*a* forms the top surface of the first contact point side positioning part 384. The second regulating part 384*b* forms the side surface of the first contact point side positioning part 384. As shown in FIG. 6T and FIG. 6U, the third regulating part 384*c* forms the tip end surface of the first contact point side positioning part 384. The fourth regulating part 384*d* forms the bottom surface of the first contact point side positioning part 384. The first regulating part 384*a* is positioned at the +Z axis direction side, the second regulating part 384*b* is positioned at the −K2 axis direction side, the third regulating part 384*c* is positioned at the +K1 axis direction side, and the fourth regulating part 384*d* is positioned at the −Z axis direction side. Each regulating part 384*a* to 384*d* is respectively roughly a flat plane.

As shown in FIG. 6T, the second contact point side positioning part 385 also has the same constitution as that of the first contact point side positioning part 384. Specifically, the second contact point side positioning part 385 has a first regulating part 385*a*, a second regulating part 385*b*, a third regulating part 385*c*, and a fourth regulating part 385*d*. The first through fourth regulating parts 385*a* to 385*d* perform positioning of the substrate unit 58 (FIG. 9) of the liquid container 50 in relation to the electrical connection part 382. The same as with that of the first contact point side positioning part 384, this positioning is positioning in the first direction (+K1 axis direction) and the direction intersecting the first direction (direction parallel to the plane defined by the Z axis direction and the K2 axis direction). The first regulating part 385*a* forms the top surface of the second contact point side positioning part 385. The second regulating part 385*b* forms the side surface of the second contact point side positioning part 385. The third regulating part 385*c* forms the tip end portion of the second contact point side positioning part 385. The fourth regulating part 385*d* forms the bottom surface of the first contact point side positioning part 385. The first regulating part 385*a* is positioned at the +Z axis direction side, the second regulating part 385*b* is positioned at the +K2 axis direction side, the third regulating part 385*c* is positioned at the +K1 axis direction side, and the fourth regulating part 385*d* is positioned at the −Z axis direction side. Each of the regulating parts 385*a* to 385*d* is respectively roughly a flat plane.

As shown in FIG. 6T, the electrical connection part 382 is held on the part positioned at the +K1 axis direction side of the holding member 388. As shown in FIG. 6V, the electrical connection part 382 includes a terminal holding part 62 held in the holding member 388, nine device side terminals 381A to 381I held in the terminal holding part 62, and a connector 602 held in the terminal holding part 62. When using the nine device side terminals 381A to 381I without distinguishing between them, the code number 381 is used.

As shown in FIG. 6T, the front surface 62*fa* of the terminal holding part 62 is slanted so that the bottom end part 62*b* is positioned further to the −K1 axis direction side than the top end part 62*u*. One end portion of the device side terminal 381 is exposed from the front surface 62*fa*. The other end portion of the device side terminal 381 is electrically connected to the connector 602 (FIG. 6V). The connector 602 is electrically connected to the control part of the printer 10 via wiring.

As shown in FIG. 6V, the plurality of device side terminals 381A to 381I constituting the device side terminal group are arranged so as to form two rows LN1 and LN2 at different positions in the Z axis direction. The rows LN1 and LN2 are parallel in the K2 axis direction.

As shown in FIG. 6P and FIG. 6Q, the first side wall part 394 has a support wall part 392 projecting in the +K2 axis direction side (outward side). The support wall part 392 is provided at the top part of the first side wall part 394. The support wall part 392 is a member extending along the K1 axis direction. The second side wall part 396 has a support wall part 395 projecting to the −K2 axis direction side (outward side). The support wall part 395 has the same shape as the support wall part 392 of the first side wall part 394.

The first contact point side positioning part 384, the second contact point side positioning part 385, the support wall part 392, and the support wall part 395 that the aforementioned holding member 388 is equipped with are members for supporting the holding member 388 on the second stationary member 33 so as to be able to be displaced in the inward direction of the surface perpendicular to the K1 axis direction. We will give a detailed description hereafter about this displaceable mechanism.

As shown in FIG. 6R, the support wall part 392 is inserted in the first attachment part 377 of the stationary structure 37, and the support wall part 395 is inserted in the first attachment part 378. Also, the latching part 385*e* is inserted in the second attachment part 371, and the latching part 384*e* is inserted in the second attachment part 372. The support wall parts 392 and 395 have a gap (looseness) at least in the gravity direction, and are inserted in the first attachment parts 377 and 378. The latching parts 385*e* and 384*e* have a gap (looseness) at least in the K2 axis direction, and are inserted in the second attachment parts 371 and 372. By doing this, the holding member 388 that holds the electrical connection part is attached to the stationary member 35 to be able to be displaced in the inward direction of the surface perpendicular to the K1 axis direction (Z axis direction and K2 axis direction).

As shown in FIG. 6K, by having a regulating part 597 as a projection that the circuit substrate holding part 59 of the liquid container 50 has described later abut the device side regulating part 489 provided on the movable member 40, movement of the liquid container 50 in the +K1 axis direction (direction opposite to the first direction) is regulated.

A-5. Constitution of the Liquid Container 50

Figure 7:
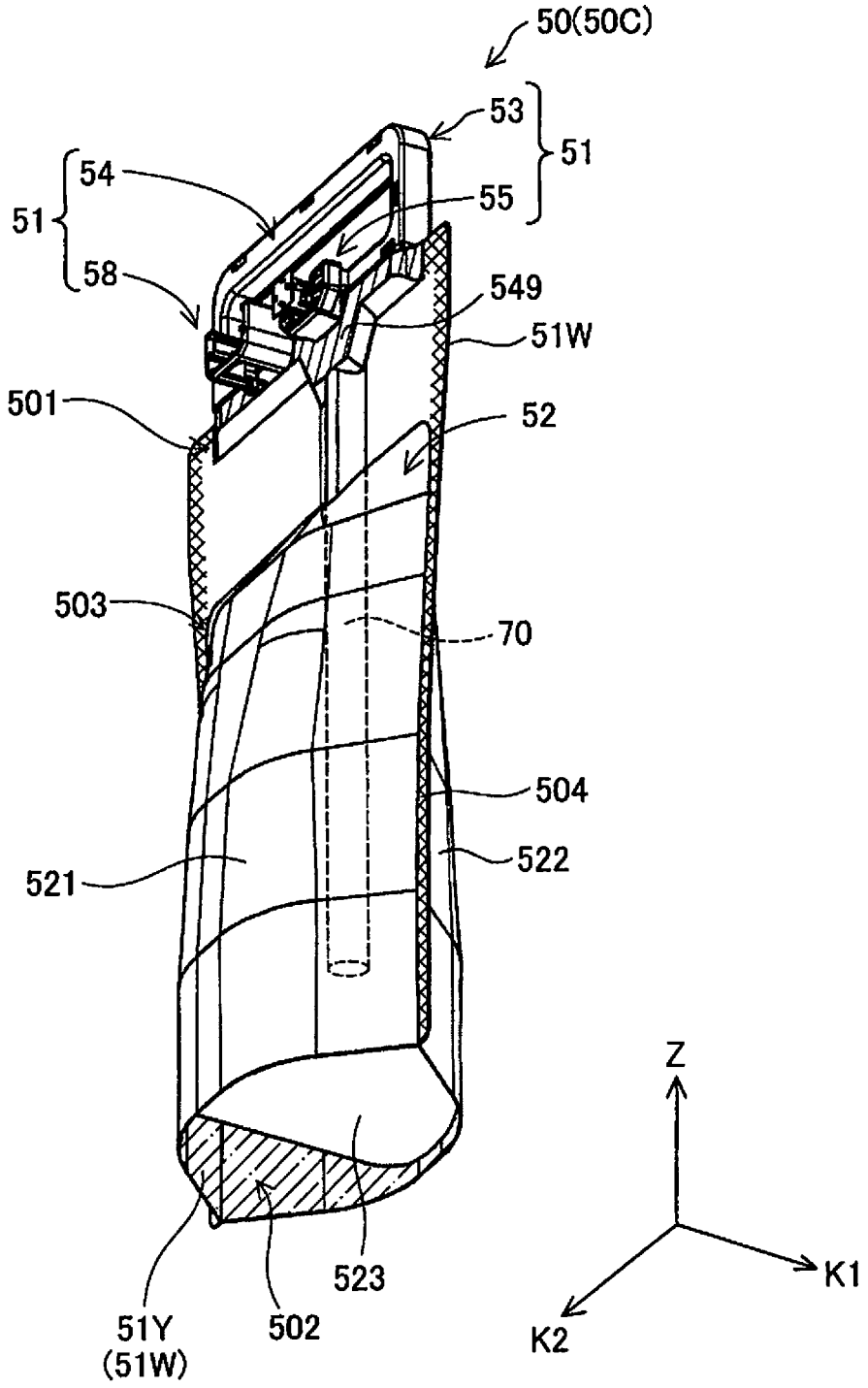
FIG. 7 is a first perspective view of the liquid container.
Figure 8:
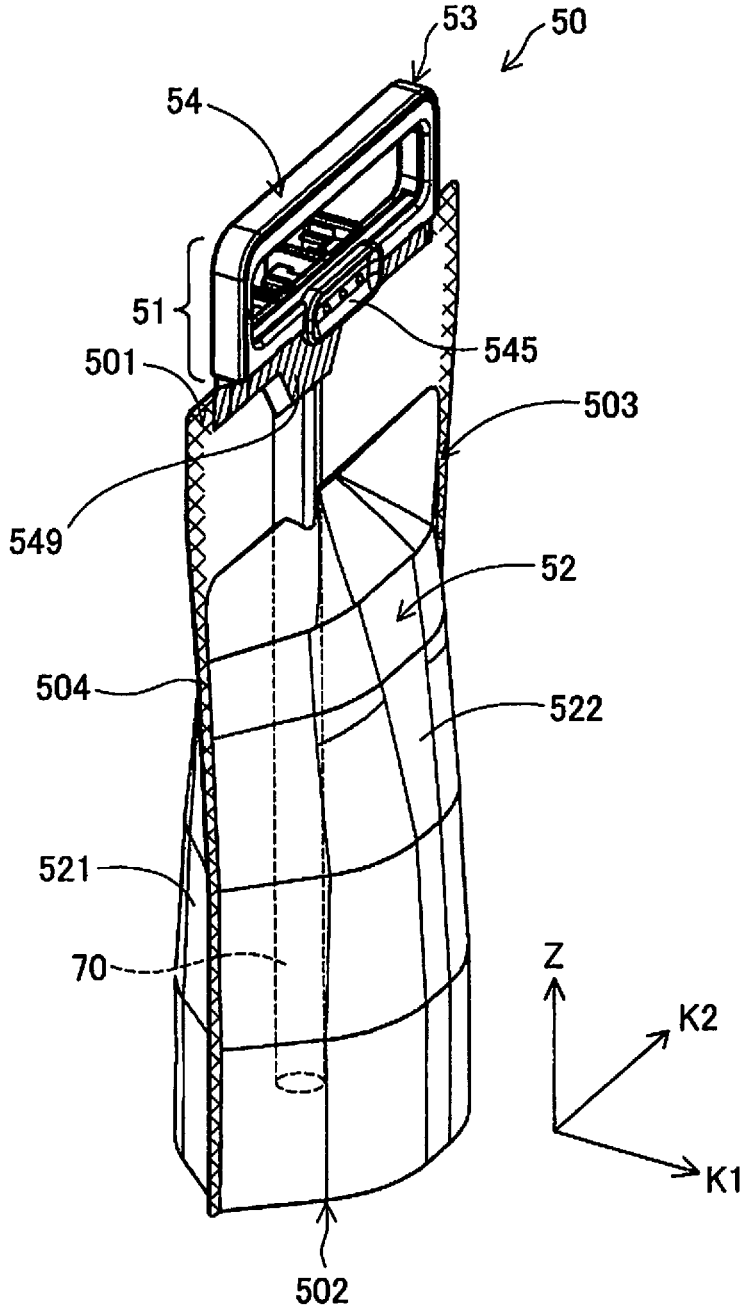
FIG. 8 is a second perspective view of the liquid container.

FIG. 7 is a first perspective view of the liquid container 50. FIG. 8 is a second perspective view of the liquid container 50. FIG. 7 and FIG. 8 show the Z axis, the K1 axis, and the K2 axis of the liquid container 50 in a state mounted on the detachable unit 30 (mounted state). Also, FIG. 7 and FIG. 8 show the liquid container 50 in a state (unused state, initial state) when filled with ink as the liquid, and before being mounted in the detachable unit 30 (before the ink is consumed by the printer 10). With the drawings hereafter as well, the mutually orthogonal Z axis, K1 axis, and K2 axis are shown as necessary. With the drawing from FIG. 7 and thereafter, a description will be given of a constitution with the liquid container 50C as an example, but the constitution for the liquid housing bodies 50K, 50M, and 50Y is the same as that for the liquid container 50C.

Also, the mutually orthogonal Z axis, K1 axis, and K2 axis can be defined as follows. In a state with the liquid container 50 connected to the printer 10, the Z axis direction is the gravity direction (vertical direction). The K1 axis direction which is the direction along the K1 axis is the horizontal direction. Also, the −K1 axis direction is the connection direction of the liquid container 50 (moving direction, first direction) when the liquid container 50 is connected to the printer 10. Specifically, as described later, when the liquid container 50 is connected to the printer 10, by a liquid supply unit 55 described later (FIG. 7) moving in the connection direction (−K1 axis direction), the liquid supply unit 55 (in detail, the liquid supply part 57) is connected to the liquid introduction part (liquid receiving part) 362 provided on the printer 10, and the substrate unit 58 (in detail, the electrical connection part 582) is connected to the electrical connection part 382 (FIG. 5C) provided on the printer 10. Also, the +K1 axis direction is the removal direction when removing the liquid container 50 from the printer 10. With this embodiment, the connection direction is the −K1 axis direction which is the horizontal direction, but the invention is not limited to this. The connection direction can also be a direction including the horizontal direction component. Also, the K2 axis direction is a direction orthogonal to the gravity direction (Z axis direction) and the K1 axis direction.

As shown in FIG. 7, the liquid container 50 is equipped with a liquid containing part (liquid containing bag) 52 and a housing part support assembly 51 attached to the liquid containing part 52. The liquid containing part 52 can house ink as the liquid. The liquid containing part 52 is attached to the housing part support assembly 51 in a state with the outer front surface exposed. Specifically, the liquid containing part 52 is constituted to be able to be visually recognized from outside without being housed in a case or the like. The liquid containing part 52 capacity decreases as the housed ink decreases.

The liquid containing part 52 has a first film 521, a second film 522, and a third film 523. The first through third films 521 to 523 partition the space part for housing the ink inside. Here, of the liquid containing part 52, the side on which the housing part support assembly 51 is attached is the one end (one end portion, upper end) 501 side, and the side facing opposite the one end 501 is the other end (other end portion, bottom end) 502 side. Also, of the liquid containing part 52, the one end side (+K2 axis direction side) is the first side end (first side end portion) 503, and the other end side (−K2 axis direction side) is the second side end (second side end portion) 504 side.

As shown in FIG. 7 and FIG. 8, in the liquid container mounted state, the first film 521 and the second film 522 constitute the side surface of the liquid containing part 52. Also, in the liquid container 50 mounted state, the third film 523 constitutes the bottom surface of the liquid containing part 52. The first film 521 and the second film 522 are arranged facing each other. The first film 521 and the second film 522 have a portion of the mutual peripheral region 51W welded. In detail, of the peripheral region 51W, the one end 501 side part, the first side end 503 side part, and the second side end 504 side part are welded. For easier understanding, in FIG. 7 and FIG. 8, cross hatching is applied to the part where the first and second films 521 and 522 are welded. Also, the housing part support assembly 51 is welded to the one end 501 of the liquid containing part 52 (in detail, the one end of the first and second films 521 and 522). Specifically, the housing part support assembly 51 is a member that can be attached to the one end 501 of the liquid containing part 52. For easier understanding, in FIG. 7 and FIG. 8, solid line single hatching is applied to the welded part of the housing part support assembly 51 and the first and second films 521 and 522.

As shown in FIG. 7, the peripheral region 51Y of the third film 523 and a portion of the peripheral region 51W of the first film 521 and the second film 522 are welded. Dot-dash line single hatching is applied to the part at which the third film 523 is welded to the first and second films 521 and 522. In this way, the liquid containing part 52 of this embodiment is a type adhered by welding or the like of three films 521, 522, and 523 (so-called pouch type having a bottom surface).

The first to third films 521 to 523 are respectively flexible members. As the ingredients (materials) of the first to third films 521 to 523, for example, polyethylene terephthalate (PET), nylon, polyethylene or the like can be used. It is also possible to form the first to third films 521 to 523 using a laminated structure with which a plurality of films constituted with these ingredients are laminated. With this kind of laminated structure, for example the outer layer can be formed using PET or nylon which are excellent in terms of impact resistance, and the inner layer can be formed using polyethylene which is excellent in terms of ink resistance. Furthermore, it is also possible to have one constitutional member of the laminated constitution be a film having a layer with aluminum or the like vapor-deposited. By doing this, it is possible to increase the gas barrier properties, so it is possible to inhibit changes in concentration of the ink housed in the liquid containing part 52, for example. In this way, it is possible to set any material for the liquid containing part 52.

Also, the shape and size of the liquid containing part 52 can be set freely. For example, the liquid containing part 52 housing black ink can be given a greater capacity (size) than the liquid containing part 52 housing the other color inks (e.g. cyan). Also, for example, the liquid containing part 52 is a type with the first to third films 521 to 523 welded or the like with this embodiment, for example, but it is also possible to be a type that omits the third film 523, and to adhere the first and second films 521 and 522 by welding or the like (a so-called pillow type). Here, as described above, the liquid containing part 52 and the operating member 53 are separate members. Thus, it is possible to change the type of liquid containing part easily (shape, size, and material) while using the same components for the operating member 53. Specifically, it is possible to set the shape, size, or material of the liquid containing part 52 according to the characteristics, volume or the like of the liquid housed in the liquid containing part, so it is possible to improve freedom of design.

The housing part support assembly 51 is equipped with the operating member (handle part) 53, the liquid supply unit 55, and the substrate unit 58. The operating member 53 is a frame shaped member that opens in the K1 axis direction. The operating member 53 has a gripping part 54 positioned at the end portion of the +Z axis direction side, and a pushing part 545 (FIG. 8) positioned at the −Z axis direction side end portion. The gripping part 54 is a part for supporting (gripping) the liquid container 50. The gripping part 54 extends along the K2 axis direction. The gripping part 54 of the operating member 53 is formed in the shape of a square with this embodiment, but it can also be formed in the shape of a "C" or the shape of a "T."

The pushing part 545 is a part that is pushed by the user when the liquid container 50 is connected to the printer 10. Specifically, the pushing part 545 is a part that is pushed manually. By pushing the pushing part 545 to the −K1 axis direction (connection direction) side, the movable member 40 (FIG. 6I) in which the liquid container 50 is set is moved to the −K1 direction side. The pushing part 545 is provided at the side opposite the side at which, of the operating member 53, the liquid supply unit 55 and the substrate unit 58 are provided. The pushing part 545 is provided projecting outward (+K1 axis direction) from the operating member 53. By doing this, it is possible to easily identify the pushing part 545 from other parts.

As shown in FIG. 7, the liquid supply unit 55 and the substrate unit 58 are respectively provided at the end portion of the −Z axis direction side of the operating member 53.

The liquid supply unit 55 and the substrate unit 58 are arranged aligned in the K2 axis direction. The liquid supply unit 55 has a function for supplying the ink housed in the liquid containing part 52 to the exterior (e.g. the liquid introduction part 362 in FIG. 5B). The substrate unit 58 has the function of electrically connecting to the device side terminal 381 of the contact point structure 38. The liquid supply unit 55 and the substrate unit 58 are provided projecting outward from the operating member 53 (−K1 axis direction). The projection direction of the liquid supply unit 55 and the substrate unit 58 are the same. The projection direction of the substrate unit 58 and the projection direction of the liquid supply part 57 are also acceptable if they are not the same, and are acceptable as long as they are roughly parallel. Also, the substrate unit 58 and the liquid supply part 57 project from the operating member 53 facing the same side in relation to the operating member 53 (−K1 axis direction side).

Figure 9:
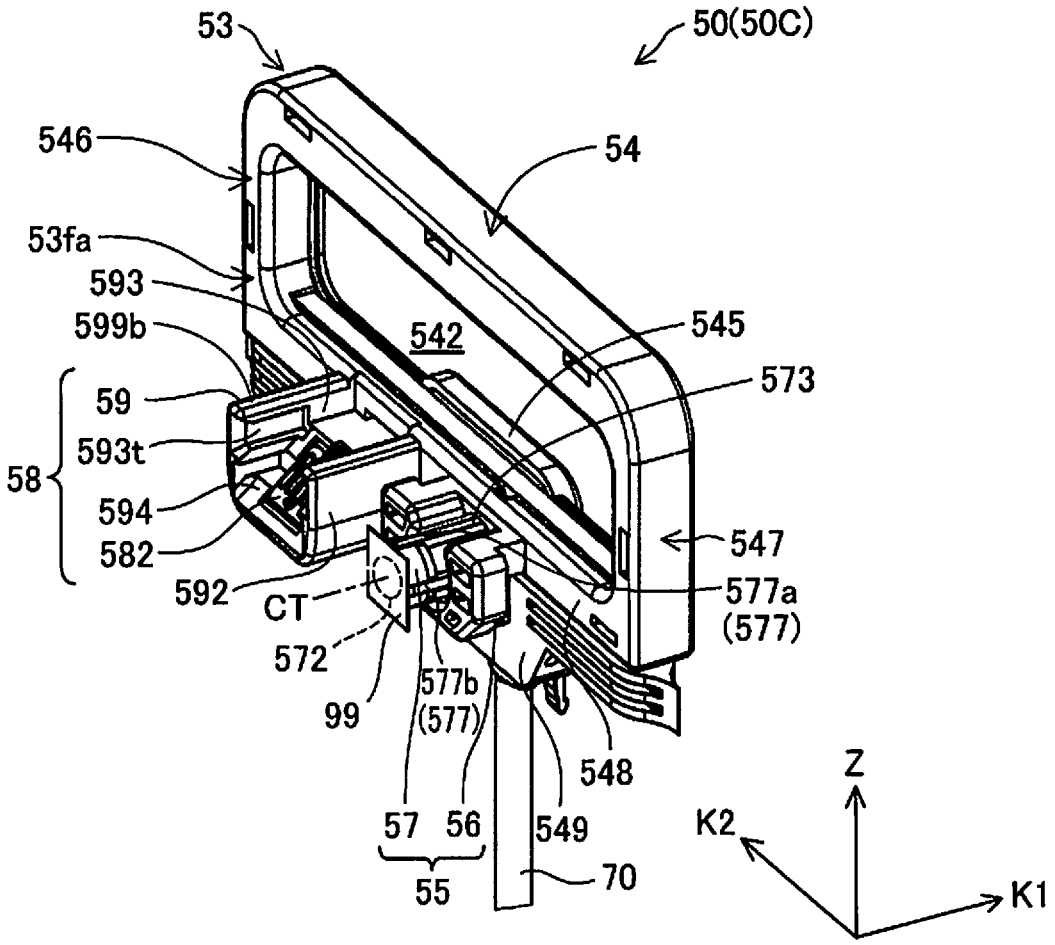
FIG. 9 is a first perspective view showing a part of the liquid container.
Figure 10:
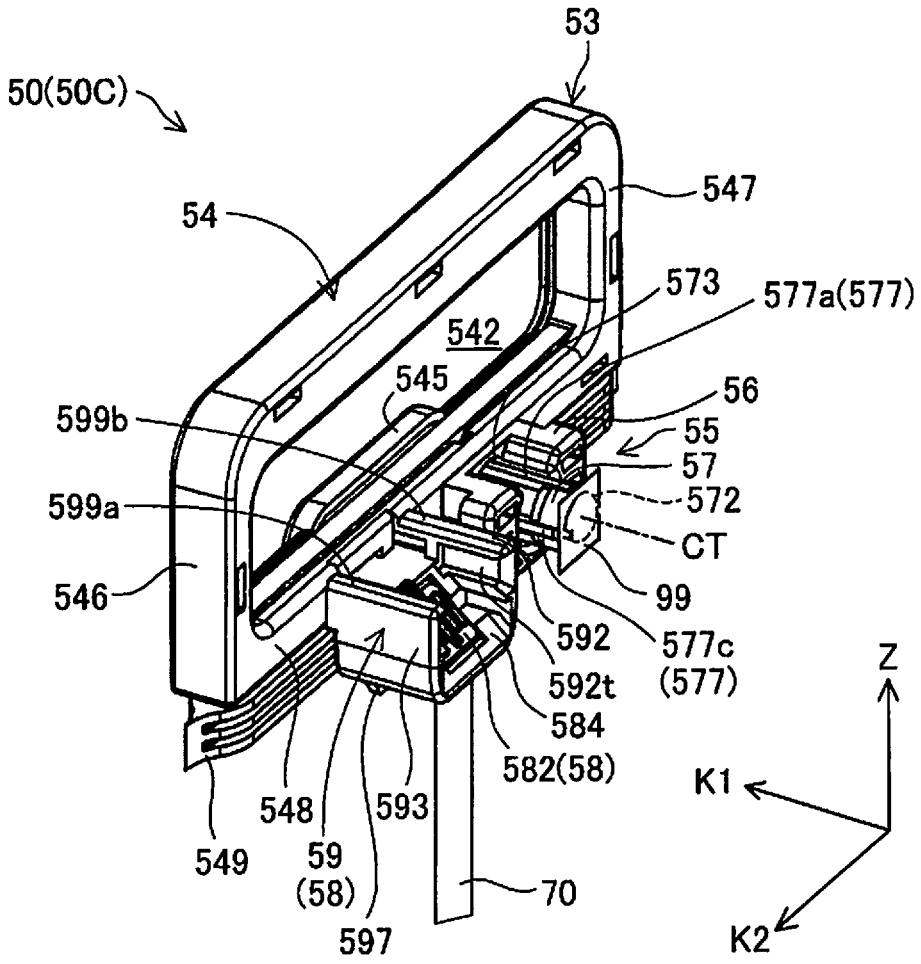
FIG. 10 is a second perspective view showing a part of the liquid container.
Figure 11:
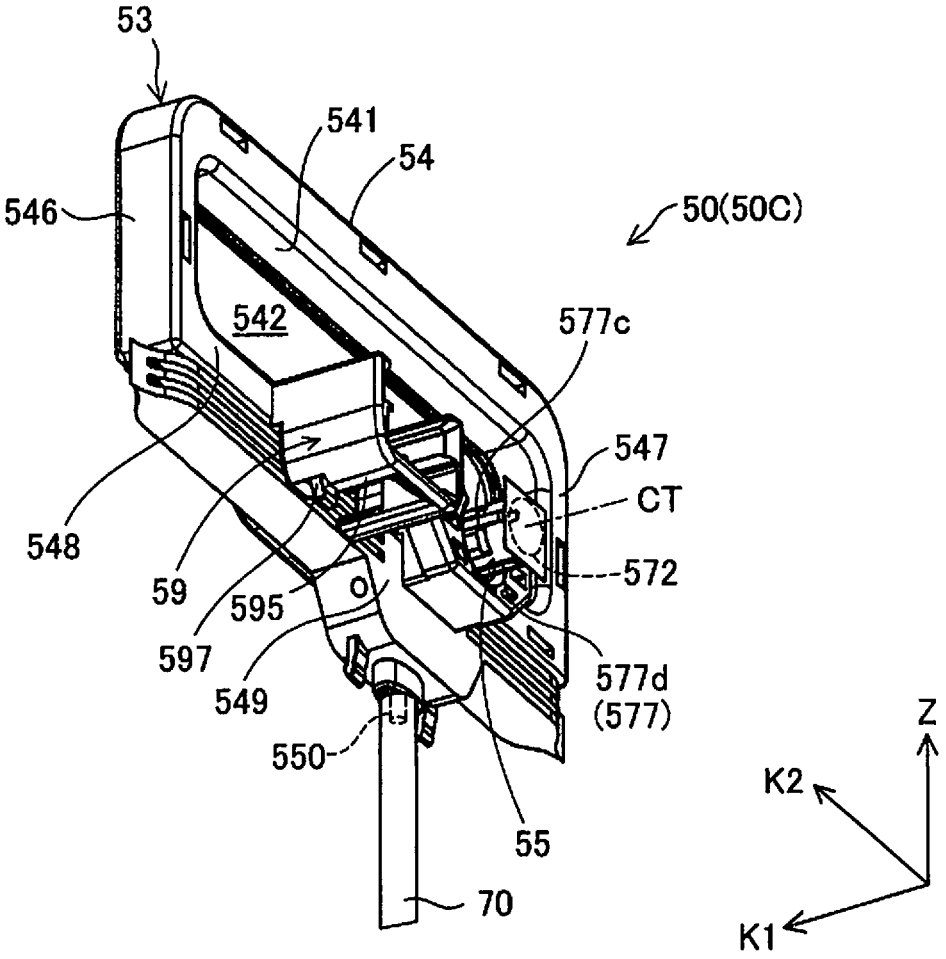
FIG. 11 is a third perspective view showing a part of the liquid container.
Figure 12:
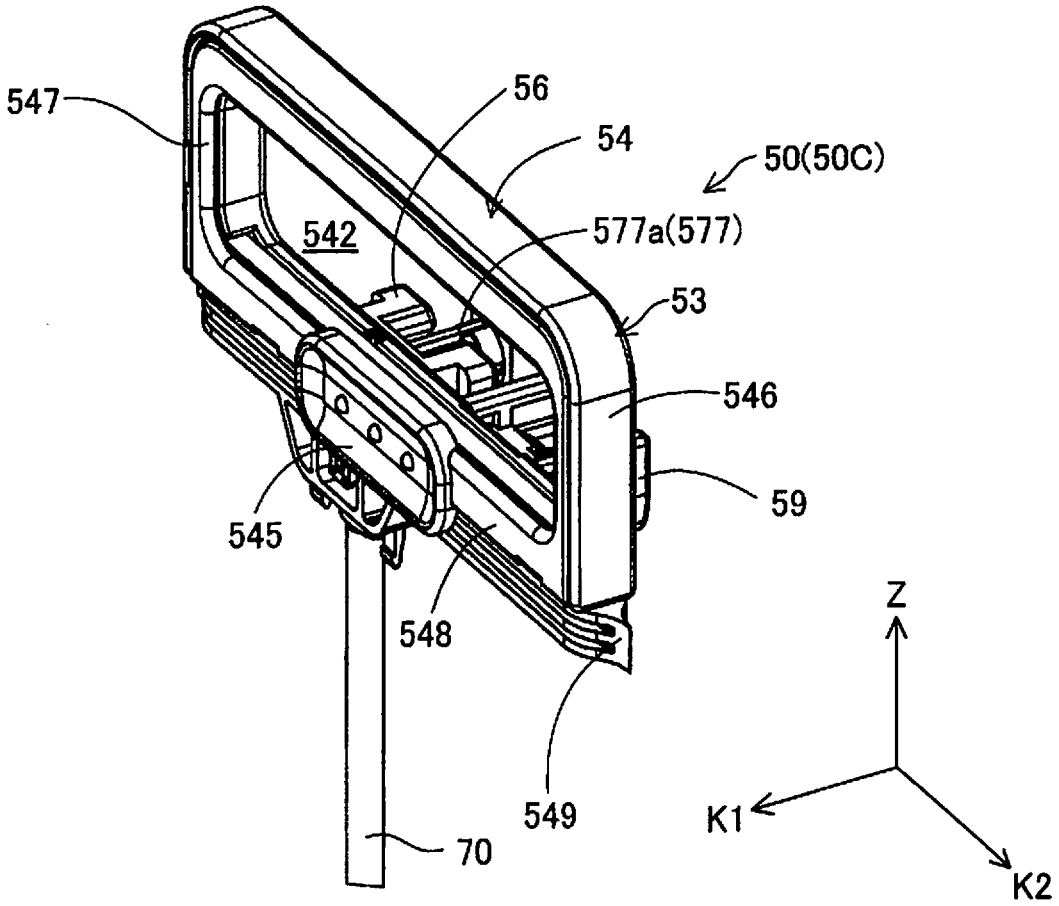
FIG. 12 is a fourth perspective view showing a part of the liquid container.
Figure 13:
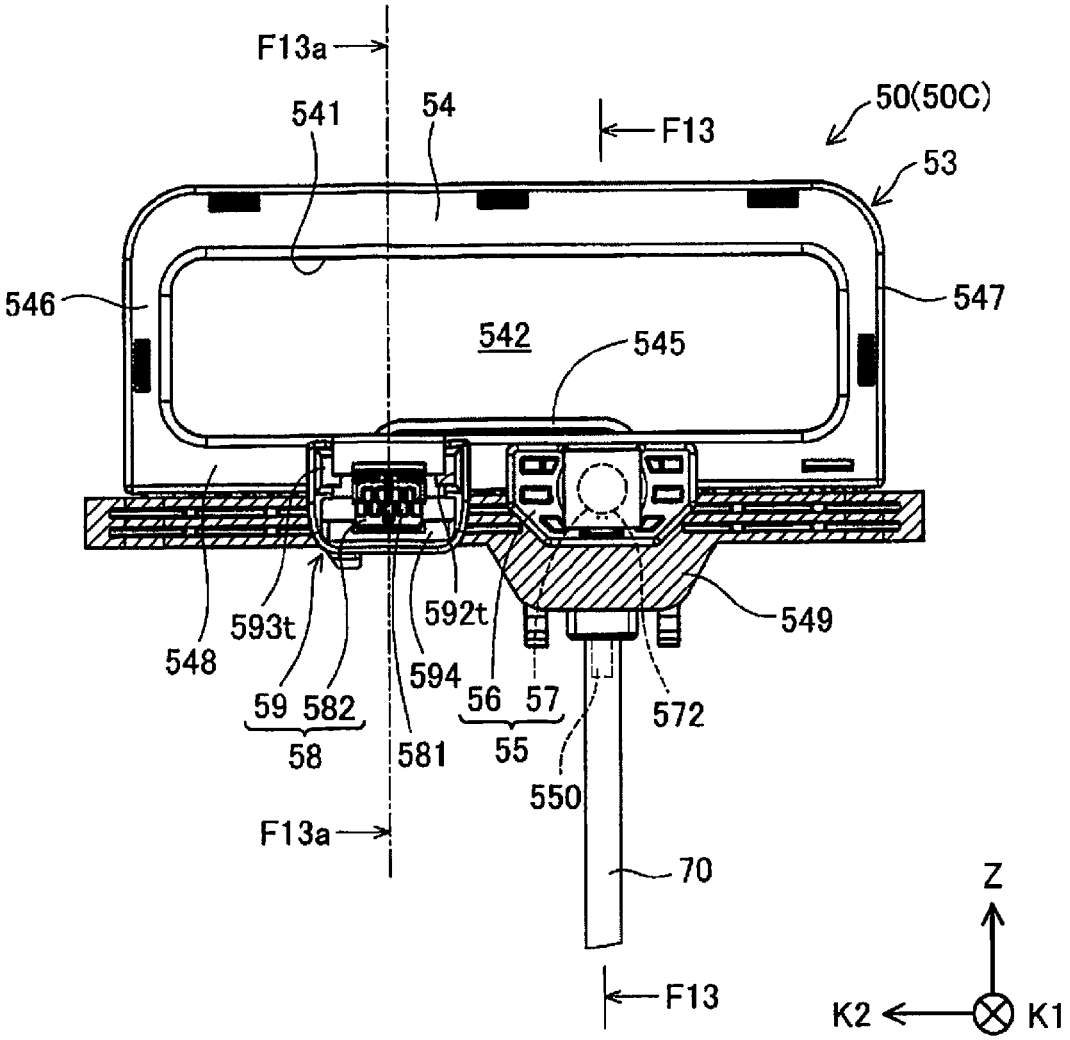
FIG. 13 is a front view of a part of the liquid container.
Figure 14:
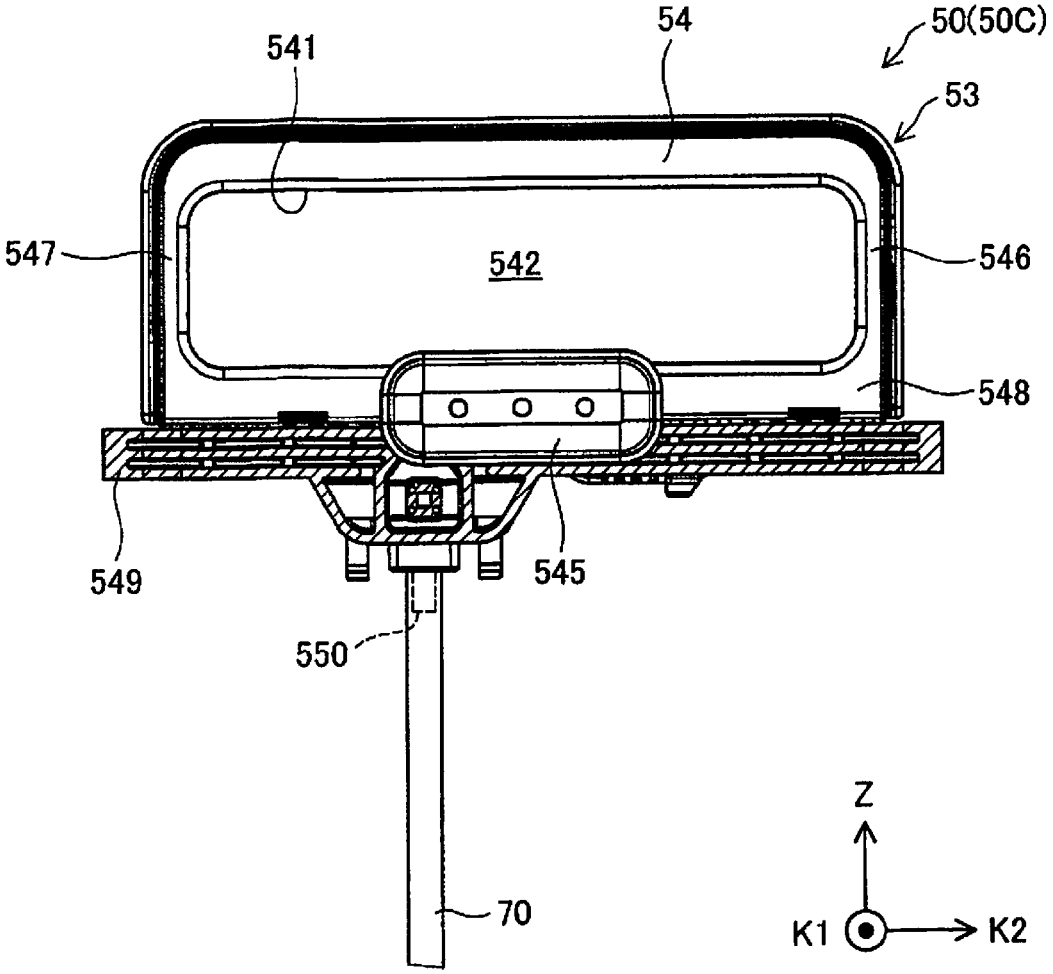
FIG. 14 is a rear view of a part of the liquid container.
Figure 15:
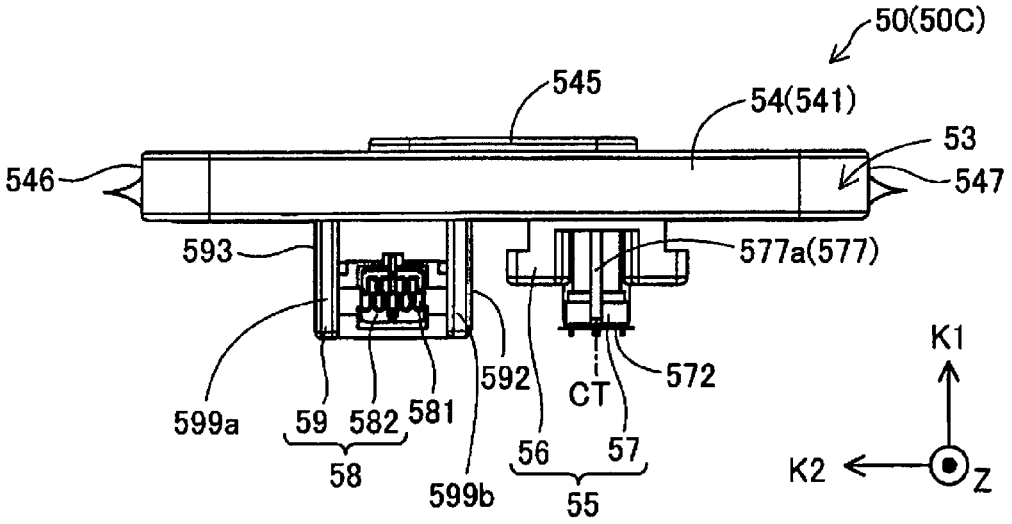
FIG. 15 is a top view of a part of the liquid container.
Figure 16:
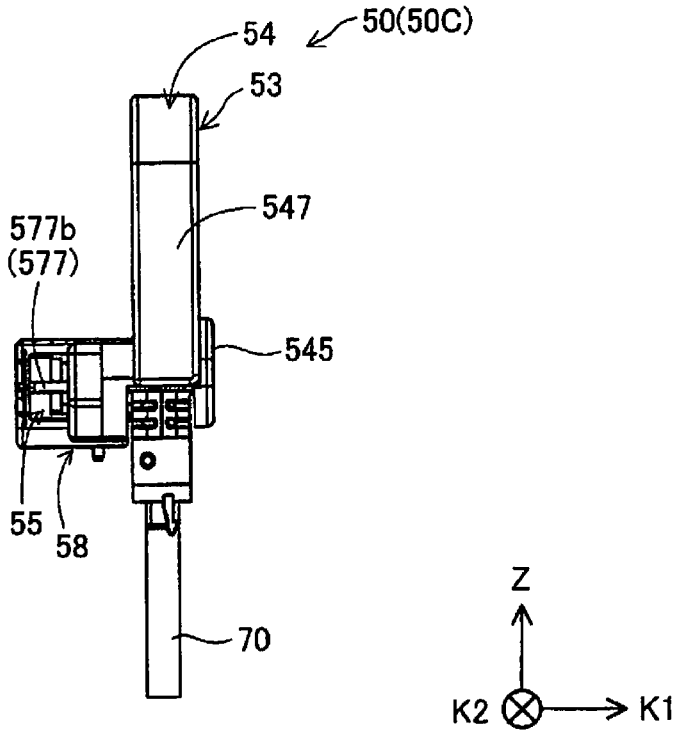
FIG. 16 is a right side view of a part of the liquid container.
Figure 17A:
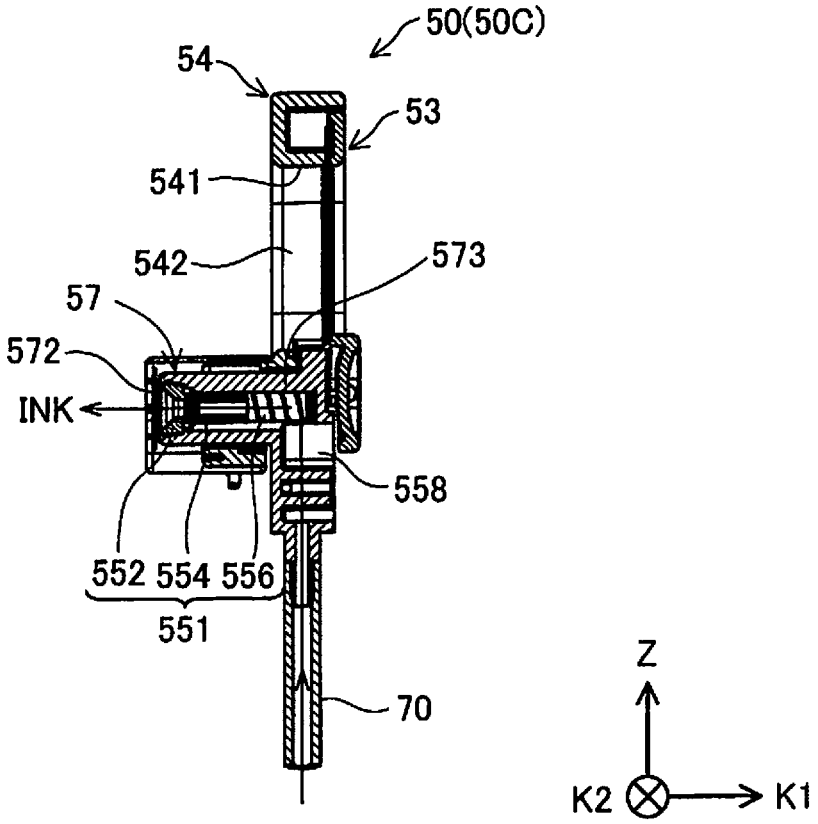
FIG. 17A is a cross section view of F13-F13 of FIG. 13.
Figure 17B:
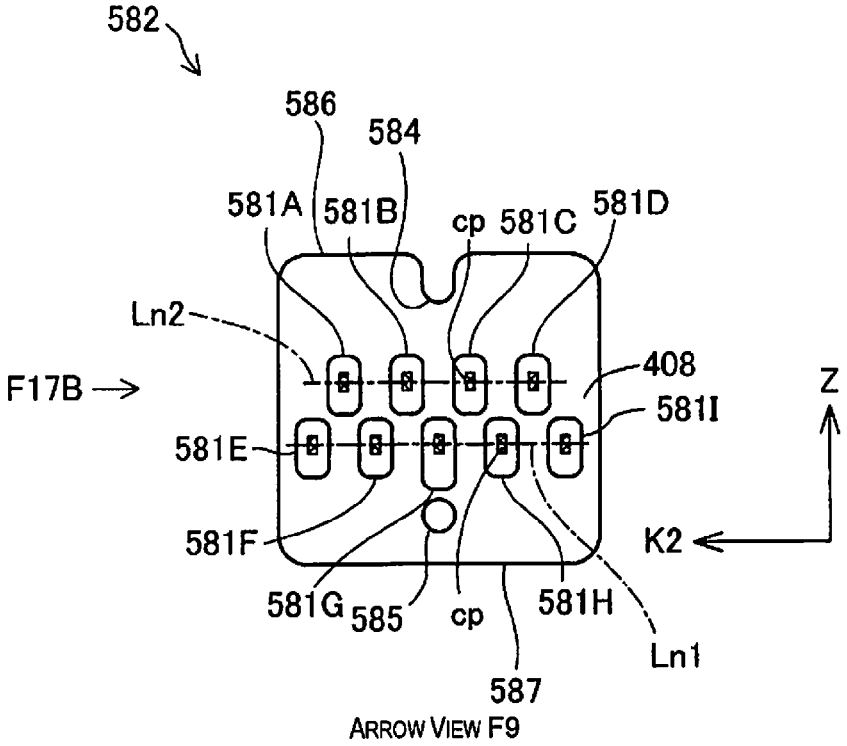
FIG. 17B is a front view of the circuit substrate.
Figure 17C:
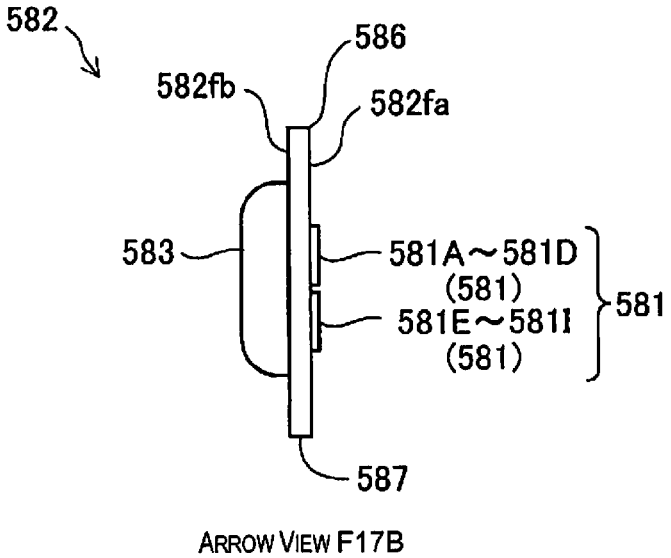
FIG. 17C is an arrow view F17B of FIG. 17B.
Figure 17D:
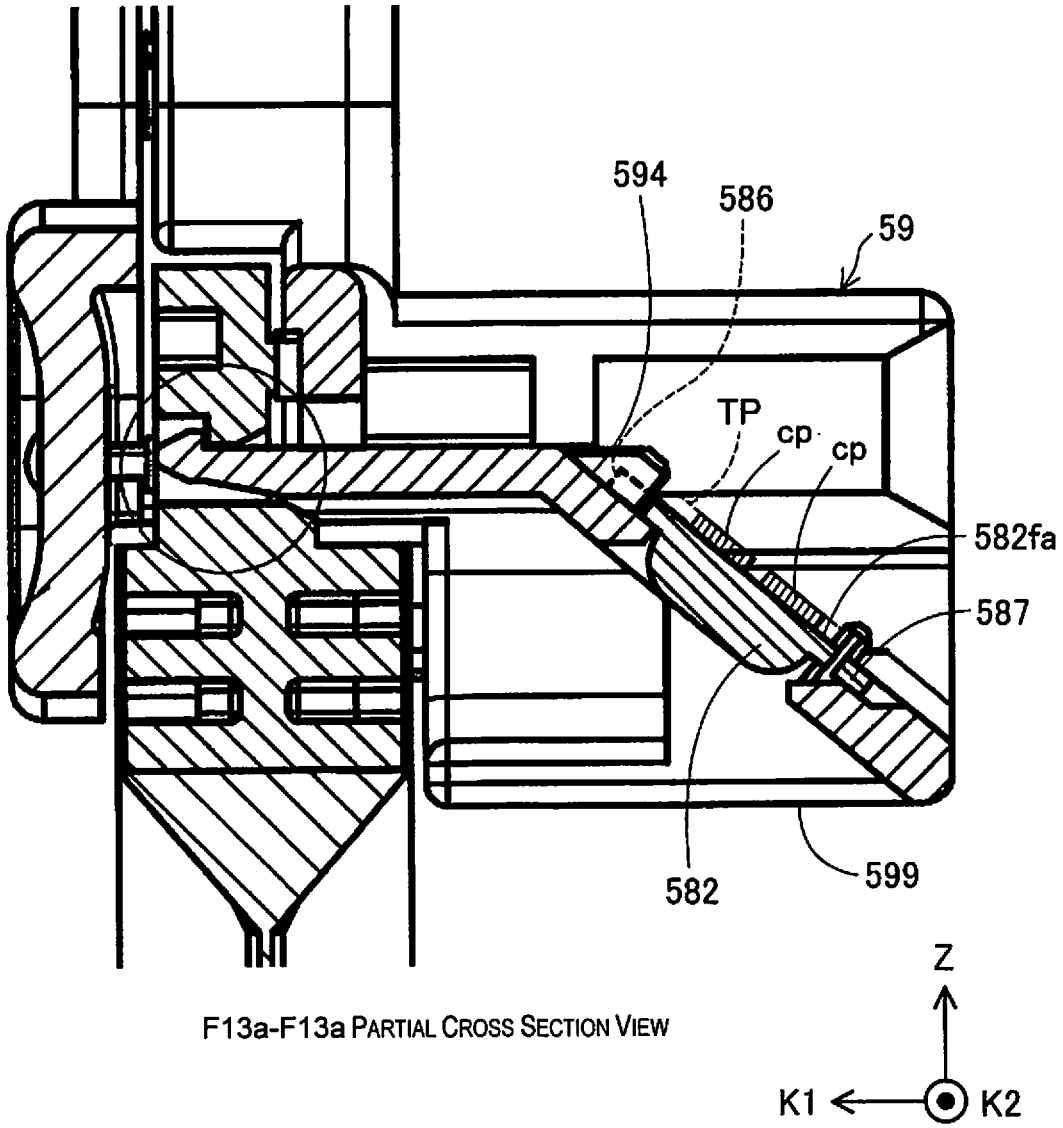
FIG. 17D is a partial cross section view of F13*a*-F13*a* of FIG. 13.
Figure 17E:
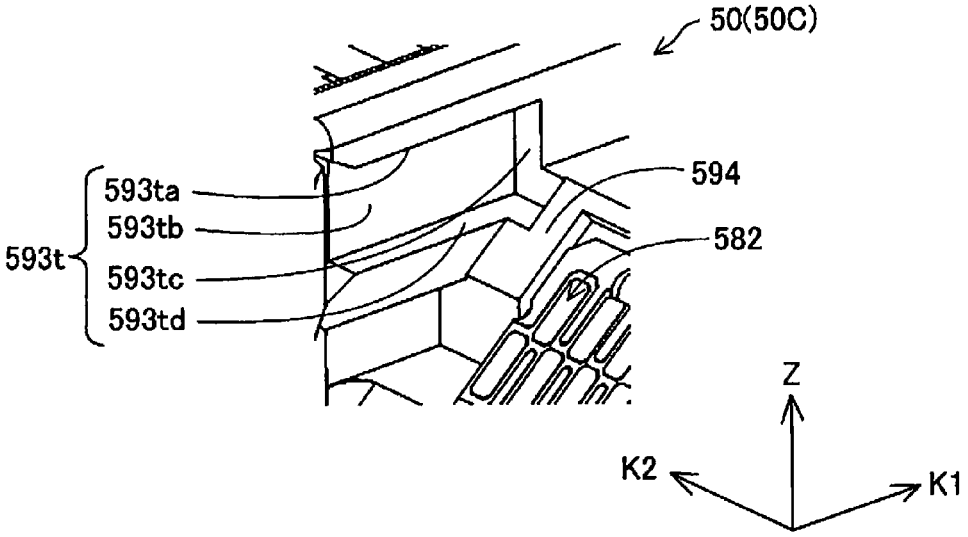
FIG. 17E is a perspective view of the groove part.
Figure 17F:
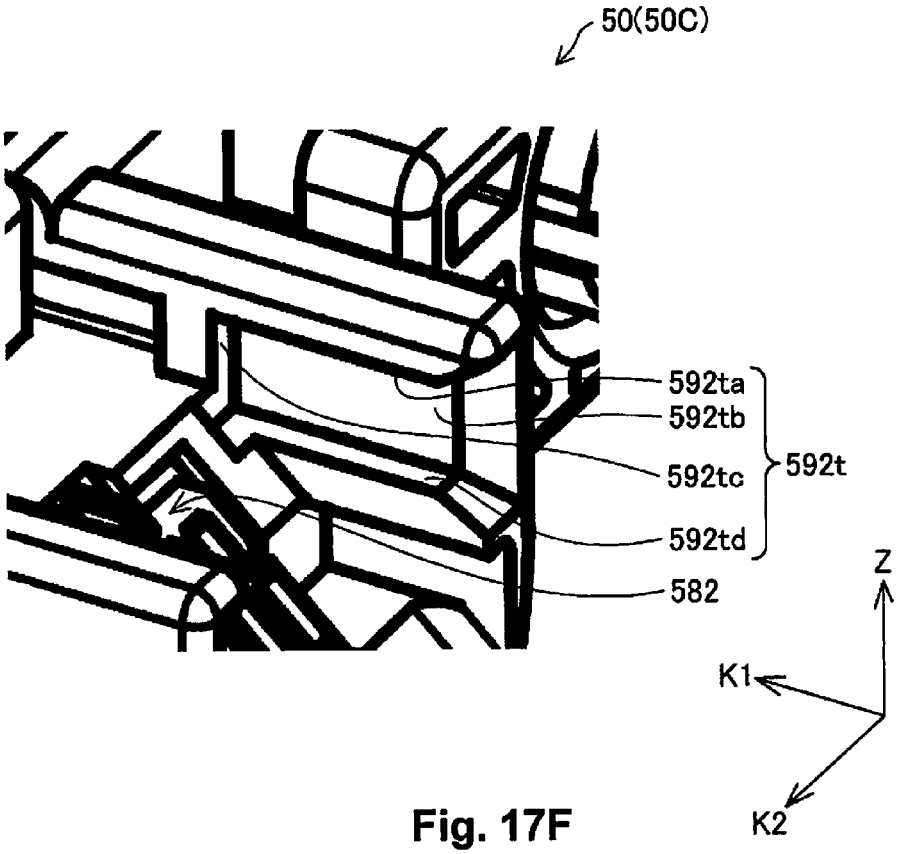
FIG. 17F is a perspective view of the groove part.

FIG. 9 is a first perspective view showing a part of the liquid container 50. FIG. 10 is a second perspective view showing a part of the liquid container 50. FIG. 11 is a third perspective view showing a part of the liquid container 50. FIG. 12 is a fourth perspective view showing a part of the liquid container 50. FIG. 13 is a front view of a part of the liquid container 50. FIG. 14 is a rear view of a part of the liquid container 50. FIG. 15 is a top view of a part of the liquid container 50. FIG. 16 is a right side view of a part of the liquid container 50. FIG. 17A is a cross section view of F13-F13 of FIG. 13. FIG. 17B is a front view of the circuit substrate 582. FIG. 17C is an arrow view F17B of FIG. 17B. FIG. 17D is a partial cross section view of F13*a*-F13*a* of FIG. 13. FIG. 17E is a perspective view of the groove part 593*t*. FIG. 17F is a perspective view of the groove part 592*t*. In FIG. 9 through FIG. 17A, an illustration of the liquid containing part 52 that the liquid container 50 is equipped with is omitted.

Here, with the operating member 53, the Z axis direction is also called the "height direction," the K1 axis direction is also called the "thickness direction," and the K2 axis direction is also called the "width direction." Also, with this embodiment, the "height direction," "thickness direction," and "width direction" with the operating member 53 correspond to the "height direction," "thickness direction," and "width direction" of the liquid container 50.

As shown in FIG. 9 and FIG. 10, in addition to the gripping part 54, the operating member 53 is also equipped with an attachment part 549 to which a first connecting part 546, a second connecting part 547, a base part 548, and the liquid containing part 52 are attached by welding or the like.

The gripping part 54, the first connecting part 546, the second connecting part 547, and the base part 548 are respectively rod shaped. A frame shaped member is formed from the gripping part 54, the first connecting part 546, the second connecting part 547, and the base part 548. By doing this, a roughly rectangular receiving space part 542 for receiving the hand of the user is formed on the operating member 53 by partitioning. As shown in FIG. 11, the gripping part 54 has a gripping surface (support surface) 541 that touches the receiving space part 542. The gripping surface 541 is a flat plane that is roughly perpendicular to the Z axis direction in the mounted state.

As shown in FIG. 9, the base part 548 extends along the K2 axis direction. The liquid supply unit 55 and the substrate unit 58 are attached to the base part 548. Specifically, the liquid supply unit 55 and the substrate unit 58 are mutually joined via the base part 548. By doing this, the liquid supply unit 55 and the substrate unit 58 operate in cooperation with the movement of the base part 548. Specifically, by the user operating the movement of one member (with this embodiment, the base part 548), it is possible to operate the movement of the liquid supply unit 55 and the circuit substrate holding part 59 used for connecting the liquid container 50 to the printer 10. Here, "joined" means connecting the joined members to each other so as to move in cooperation with each other.

The attachment part 549 is positioned at the side opposite to the side at which the gripping part 54 sandwiching the base part 548 is positioned. The attachment part 549 is adjacent to the base part 548. The attachment part 549 extends along the K2 axis direction. The attachment part 549 is a part with which the one end 501 (FIG. 7) of the liquid containing part 52 is attached by welding or the like (bonded part). Also, as shown in FIG. 13 and FIG. 17, the attachment part 549 has a delivery part 550 for drawing the ink housed in the liquid containing part 52 to the liquid supply part 57. By the flow path member 70 being connected to the delivery part 550, the ink flowing through the flow path member 70 is fed to the liquid supply part 57 described later via the delivery part 550. For easier understanding, in FIG. 13 and FIG. 14, single hatching is applied to the part of the attachment part 549 to which the liquid containing part 52 is attached.

As shown in FIG. 9 and FIG. 10, the liquid supply unit 55 is equipped with the liquid supply part (liquid outlet part) 57 and a housing part side support part 56. However, the housing part side support part 56 is constituted as a separate body from the liquid supply part 57, and a slight gap is formed between it and the liquid supply part 57.

The liquid supply part 57 supplies the ink housed in the liquid containing part 52 to the printer 10. The liquid supply part 57 has a liquid supply port 572 that is one end, and a supply connection part 573 that is the other end. The liquid supply port 572 is in communication with the interior of the liquid containing part 52, and flows out the ink housed in the liquid containing part 52 to the outside (printer 10). When supplying ink to the printer 10, the liquid supply part 57 extends so as to face the first direction (−K1 axis direction) that is the direction that intersects the gravity direction (Z axis direction) from the operating member 53. In the liquid container 50 mounted state, the liquid supply port 572 has the liquid introduction part 362 (FIG. 5) inserted. The liquid supply port 572 defines a plane (surface defined by the Z axis direction and the K2 axis direction). The liquid supply port 572 opens facing the first direction (−K1 axis direction, connection direction). Here, the opening direction is the direction perpendicular to the plane defined by the liquid supply port 572, and is the direction facing the outside. The liquid supply port 572 is not limited to the mode opening facing the first direction, and can also open facing a direction including the first direction component.

The supply connection part 573 is connected to the operating member 53. The liquid supply part 57 is a tube shaped member (ring shaped member) extending along the K1 axis direction (central axis CT direction).

The liquid supply part 57 is equipped with the central axis CT. The central axis CT is parallel to the K1 axis direction. Here, of the K1 axis directions, the direction facing from the liquid supply port 572 to the supply connection part 573 is the +K1 axis direction, and the direction facing from the supply connection part 573 to the liquid supply port 572 is the −K1 axis direction.

As shown in FIG. 15, when the liquid container 50 is viewed from the +Z axis direction side (side at which the gripping part 54 is positioned), the liquid supply port 572 is arranged at a position that does not overlap the operating member 53.

As shown in FIG. 9, in the unused state of the liquid container 50, the liquid supply port 572 is blocked by a film 99. By doing this, before the liquid container 50 is mounted in the detachable unit 30 (FIG. 5), it is possible to suppress ink from the liquid supply port 572 from leaking out to the outside. The film 99 is broken by the liquid introduction part 362 (FIG. 5B) when the liquid container 50 is mounted in the detachable unit 30.

As shown in FIG. 9 through FIG. 11, of the liquid supply part 57, a positioning part 577 is provided at the outer periphery with the central axis CT as the center. The positioning part 577 performs positioning of the liquid supply part 57 in relation to the liquid introduction part 362 by abutting the supply part positioning part 364 (FIG. 5B) of the liquid introduction part 362 when connecting the liquid container 50 to the printer 10. The positioning part 577 can also be regarded as a part of the liquid supply part 57.

The positioning part 577 has a first liquid container side positioning part 577*a*, a second liquid container side positioning part 577*b*, a third liquid container side positioning part 577*c*, and a fourth liquid container side positioning part 577*d*. The first through fourth liquid container side positioning parts 577*a* to 577*d* are respectively members that project from the liquid supply part 57 (protruding members). Also, the first through fourth liquid container side positioning parts 577*a* to 577*d* are members that extend along the K1 axis direction. The −K1 axis direction side end portion s of the respective first through fourth liquid container side positioning parts 577*a* to 577*d* are near the liquid supply port 572.

The first liquid container side positioning part 577*a* is arranged at the gravity upward direction side (+Z axis direction side) part of the liquid supply part 57. The second liquid container side positioning part 577*b* is arranged at the −K2 axis direction side part of the liquid supply part 57. The third liquid container side positioning part 577*c* is arranged at the +K2 axis direction side part of the liquid supply part 57. The fourth liquid container side positioning part 577*d* is arranged at the gravity downward direction side (−Z axis direction side) part of the liquid supply part 57. The first and fourth liquid container side positioning parts 577*a* and 577*d* face opposite in the Z axis direction. The second and third liquid container side positioning parts 577*b* and 577*c* face opposite in the K2 axis direction.

As shown in FIG. 17, a valve mechanism 551 for opening and closing the liquid flow path formed by the liquid supply part 57 is arranged inside the liquid supply part. The valve mechanism 551 is equipped with a valve seat 552, a valve body 554, and a spring 556. Facing from the liquid supply port 572 of the liquid supply part 57 toward the supply connection part 573, the valve seat 552, the valve body 554, and the spring 556 are housed in that sequence in the liquid supply part 57.

The valve seat 552 is a roughly circular ring shaped member. The valve seat 552 can be constituted using an elastic body such as rubber, an elastomer or the like, for example. The valve seat 552 is press fit to the interior of the liquid supply part 57. The valve body 554 is a roughly round pillar shaped member. The valve body 554 blocks the hole (valve hole) formed on the valve seat 552 in the state before the liquid container 50 is mounted in the detachable unit 30. The spring 556 is a compressed coil spring. The spring 556 energizes the valve body 554 in the direction facing the valve seat 552 side. In the liquid container 50 mounted state, by the liquid introduction part 362 (FIG. 5B) pushing the valve body 554 to the supply connection part 573 side, the valve body 554 moves to the supply connection part 573 side. By doing this, the valve body 554 separates from the valve seat 552 and the valve mechanism 551 is in an open state. When the valve mechanism 551 is in an open state, the ink housed in the liquid containing part 52 (FIG. 7) flows through the flow path member 70, the internal flow path 558 of the operating member 53, and the liquid supply part 57 and can be flowed out to the outside.

As shown in FIG. 9, the housing part side support part 56 performs positioning to a certain degree of the liquid containing part 52 containing the liquid supply port 572 in relation to the printer 10 when the liquid container 50 is connected to the printer 10. The housing part side support part 56 is a concave shape open at the +Z axis direction side. The housing part side support part 56 encloses the part excluding the Z axis direction (gravity upward direction) of the periphery of the liquid supply part 57 with the central axis CT as the center. The housing part side support part 56 is arranged at a position adjacent to the liquid supply port 572 of the liquid supply part 57. When the operating member 53 consists of a material that does not deform easily, the housing part side support part 56 can also be provided at a position slightly separated from the liquid supply port 572 of the operating member 53. The housing part side support part 56 projects in the −K1 axis direction from the operating member 53.

When the liquid container 50 is connected to the printer 10, the housing part side support part 56 is arranged on the inside of the supply part supporting part 42 (FIG. 5C) that the detachable unit 30 is equipped with. By doing this, the movement of the liquid supply part 57 is regulated by the plurality of surface parts that do partition formation of the supply part supporting part 42 (e.g. first support surface part 402, second support part 403, and third support surface part 404) coming in contact with the housing part side support part 56, and the liquid container 50 is positioned to a certain degree. Also, when the liquid container 50 is set in the movable member 40 of the detachable unit 30, by abutting the third support surface part 404, the housing part side support part 56 is supported on the movable member 40 so as to hang down by its own weight further to the gravity direction lower side than the gripping part 54.

The liquid supply unit 55 has a function of supplying ink housed in the liquid containing part 52 (FIG. 7) to the printer 10. Thus, the liquid supply unit 55 can also be regarded as the "liquid supply part." In this case, the liquid supply unit 55 as the liquid supply part is equipped with the liquid supply part (liquid outlet part) 57 having the liquid supply port 572 at one end, and the housing part side support part 56.

As shown in FIG. 9 and FIG. 10, the substrate unit 58 is equipped with the circuit substrate 582 as the liquid container side electrical connection part, and the circuit substrate holding part 59 as the holding part (arrangement part). As shown in FIG. 9, the circuit substrate holding part 59 positions the circuit substrate 582 in relation to the printer 10 when the liquid container 50 is connected to the printer 10. The circuit substrate holding part 59 is provided as an integrated unit with the operating member 53. With this embodiment, the circuit substrate holding part 59 is provided as an integrated unit with the operating member 53 by being created by integral molding with the operating member 53. Here, "provided as an integrated unit" means the circuit substrate holding part 59 being provided on the operating member 53 so as to be able to move in cooperation with the movement of the operating member 53. With other embodiments, it is also possible to provide the circuit substrate holding part 59 as an integrated unit with the operating member 53 by the circuit substrate holding part 59 being attached to the operating member 53 using welding or the like.

The circuit substrate holding part 59 is arranged aligned with the liquid supply part 57 in the direction (K2 axis direction) intersecting the first direction (−K1 axis direction). The circuit substrate holding part 59 holds (supports, arranges) the circuit substrate 582. Said another way, the circuit substrate holding part 59 arranges a contact part cp of the circuit substrate 582. The circuit substrate holding part 59 holds (arranges) the circuit substrate 582 (contact part cp) so as to be positioned further to the upper side than the liquid containing part 52 when the liquid container 50 is connected to the printer 10. The circuit substrate holding part 59 is a member which has rigidity. In specific terms, the circuit substrate holding part 59 has rigidity to the degree that the circuit substrate 582 is not displaced when the liquid container 50 is set in the movable member 40 of the detachable unit 30. Also, the circuit substrate holding part 59 is formed using an ingredient such as ABS resin, polystyrene (PS) or the like. Also, when set in the movable member 40, the circuit substrate holding part 59 is supported on the supply part supporting part 42 (FIG. 5C) of the movable member 40.

As shown in FIG. 9, the circuit substrate holding part 59 is a concave shape that opens at the +Z axis direction side (the side at which the gripping part 54 is positioned). Also, the −K1 axis direction side of the circuit substrate holding part 59 is open to receive the contact point structure 38. The circuit substrate holding part 59 is equipped with a bottom part (bottom surface) 595 (FIG. 11), a first side wall part 592, and a second side wall part 593. The concave shape of the circuit substrate holding part 59 is defined by the bottom part 595, the first side wall part 592, and the second side wall part 593. The first side wall part 592 is a wall part extending in the gravity upward direction from the −K2 axis direction side part of the bottom part 595. The second side wall part 593 is a wall part extending in the gravity upward direction from the +K2 axis direction side part of the bottom part 595. The first and second side wall parts 592 and 593 connected to the bottom part 595 face opposite each other.

Also, as shown in FIG. 9, the circuit substrate holding part 59 has an arrangement part (arrangement surface) 594. The circuit substrate 582 is attached to the arrangement part 594. The arrangement part 594 is positioned between the first and second side wall parts 592 and 593. The arrangement part 594 is slanted such that the bottom end part is positioned further to the −K1 axis direction side than the top end part. Also, the arrangement part 594 is slanted facing a direction including the +Z axis direction component and the −K1 axis direction component. The arrangement part 594 is positioned further to the +Z axis direction side than the bottom part 595.

The circuit substrate holding part 59 has the first side wall part 592 and the second side wall part 593 extending respectively to the +Z axis direction side from both sides of the K2 axis direction of the bottom part 595. As shown in FIG. 10 and FIG. 15, the first side wall part 592 has a groove part 592*t* as a holding part side positioning part and a holding part side upper side regulating part 599*b*. As shown in FIG. 9 and FIG. 15, the second side wall part 593 has a groove part 593*t* as a holding part side positioning part and a holding part side upper side regulating part 599*a*.

As shown in FIG. 15, the holding part side upper side regulating part 599*a* (599*b*) is the end surface in the gravity upward direction of the second side wall part 593 (first side wall part 592). When the electrical connection part 582 is connected with the device side terminal 381 of the electrical connection unit 38 (FIG. 5C), the holding part side upper side regulating part 599*a* abuts the device side upper side regulating part 377*a* (FIG. 6M) and the holding part side upper side regulating part 599*b* abuts the device side upper side regulating part 377*b* (FIG. 6M). By doing this, the movement of the circuit substrate holding part 59 to the gravity upward direction side is regulated.

As shown in FIG. 13, the two groove parts 592*t* and 593*t* are provided at both sides so as to sandwich the circuit substrate 582 in the K2 axis direction. The two groove parts 592*t* and 593*t* are respectively roughly rectangular solid shapes. When the liquid container 50 is connected to the printer 10, the circuit substrate holding part 59 is first supported by the substrate support part 48 (FIG. 5C). By doing this, positioning is performed to a certain degree of the circuit substrate holding part 59 and circuit substrate 582 in relation to the device side terminal 381 (FIG. 5C). Then, by the movable member 40 of the detachable unit 30 shown in FIG. 5C being moved in the −K1 axis direction, the device side substrate positioning part 385 shown in FIG. 5B is put into the groove part 593*t* (FIG. 13) of the circuit substrate holding part 59, and the device side substrate positioning part 384 shown in FIG. 5B is put into the groove part 592*t* (FIG. 13) of the circuit substrate holding part 59. By doing this, final positioning is performed for the circuit substrate holding part 59 and the circuit substrate 582 in relation to the device side terminal 381.

As shown in FIG. 17E, in the liquid container 50 mounted state, the second contact point side positioning part 385 (FIG. 5B) of the contact point structure 38 is inserted in the groove part 593*t* (second groove part 593*t*). The groove part 593*t* has a top surface 593*ta*, a side surface 593*tb*, a base end surface 593*tc*, and a bottom surface 593*td*. The top surface 593*ta* and the bottom surface 593*td* face opposite in the Z axis direction. The top surface 393*ta* is positioned at the +Z axis direction side, and the bottom surface 593*d* is positioned at the −Z axis direction side. The side surface 593*tb* forms the +K2 axis direction side surface of the groove part 593*t*. The base end surface 593*tc* forms the +K1 axis direction side surface of the groove part 593*t*.

As shown in FIG. 17F, in the liquid container 50 mounted state, the first contact point side positioning part 384 (FIG. 5B) of the contact point structure 38 is inserted in the groove part 592*t* (first groove part 592*t*). The groove part 592*t* has the same shape as the groove part 593*t*. The groove part 592*t* has a top surface 592*ta*, a side surface 592*tb*, a base end surface 592*tc*, and a bottom surface 592*td*. The top surface 592*ta* and the bottom surface 592*td* face opposite in the Z axis direction. The top surface 592*ta* is positioned at the +Z axis direction side, and the bottom surface 592*td* is positioned at the −Z axis direction side. The side surface 592*tb* forms the K2 axis direction side surface of the groove part 592*t*. The base end surface 592*tc* forms the +K1 axis direction side surface of the groove part 592*t*.

When there is an electrical connection by the circuit substrate 582 contacting the electrical connection part (FIG. 5B), as described hereafter, the circuit substrate 582 is positioned in the first direction (−K1 axis direction) and in the direction (Z axis direction and K2 axis direction) that intersects the first direction in relation to the electrical connection part 382.

When the liquid container 50 is set in the movable member 40 and pushed forward in the connection direction (−K1 axis direction), insertion of the groove part 592*t* and 593*t* device side substrate positioning parts 384 and 385 (FIG. 6P, FIG. 6Q) is started. By doing this, positioning in the +Z axis direction is performed by the movement of the circuit substrate holding part 59 to the +Z axis direction side being regulated by abutting of the first regulating part 385*a* (FIG. 6T) and the top surface 593*ta* (FIG. 17E), and abutting of the first regulating part 384*a* (FIG. 6U) and the top surface 592*ta* (FIG. 17F). Also, positioning in the −Z axis direction is performed by the movement of the circuit substrate holding part 59 in the −Z axis direction being regulated by abutting of the fourth regulating part 385*d* (FIG. 6T) and the bottom surface 593*td* (FIG. 17E), and abutting of the fourth regulating part 384*d* (FIG. 6U) and the bottom surface 592*td* (FIG. 17F). Also, positioning in the K2 axis direction is performed by the movement of the circuit substrate holding part 59 in the K2 axis direction being regulated by abutting of the second regulating part 385*b* (FIG. 6T) and the side surface 593*tb* (FIG. 17E), and abutting of the second regulating part 384*b* (FIG. 6U) and the side surface 592*tb* (FIG. 17F).

By the liquid container 50 being further pushed forward in the connection direction (−K1 axis direction), first direction positioning is performed by the movement of the circuit substrate holding part 59 in the first direction (−K2 axis direction) being regulated by abutting of the third regulating part 385*c* (FIG. 6U) on the base end surface 593*tc* (FIG. 17E), and abutting of the third regulating part 384*c* (FIG. 6T) on the base end surface 592*tc* (FIG. 17F). By doing this, it is possible to have contact with good precision of the circuit substrate 582 and the electrical connection part 382 at a determined position.

As shown in FIG. 11, the regulating part 597 is provided on the bottom part 595. The regulating part 597 protrudes projecting outward (−Z axis direction) from the bottom part 595. The movement of the circuit substrate holding part 59 in the direction (+K1 axis direction) opposite the first direction (−K1 axis direction) is regulated by the regulating part 597 abutting the device side regulating part 489 (FIG. 6K) of the movable member 40.

As shown in FIG. 17B, a boss groove 584 is formed on the upper side end portion 586 of the +Z axis direction side of the circuit substrate 582, and a boss hole 585 is formed on the lower side end portion 587 of the −Z axis direction side of the circuit substrate 582. The circuit substrate 582 is fixed to the arrangement part 594 using the boss groove 584 and the boss hole 585.

As shown in FIG. 17B and FIG. 17C, the circuit substrate 582 has a liquid container side terminal group 580 provided on a front surface 582*fa*, and a storage device 583 provided on a back surface 582*fb*. The front surface 582*fa* and the back surface 582*fb* are flat planes.

The liquid container side terminal group 580 consists of nine terminals 581A to 581I. The storage device 420 stores information relating to the liquid container 50 (e.g. remaining ink volume, ink color) and the like.

As shown in FIG. 17B, the nine liquid container side terminals 581A to 581I are respectively formed as roughly rectangular shapes, and two rows Ln1 and Ln2 formed to be arranged at different positions in the Z axis direction. The rows Ln1 and Ln2 are parallel in the K2 axis direction.

At the respective center parts of the liquid container side terminals 581A to 581I, there are corresponding contact parts cp that contact the device side terminals 381A to 381I (FIG. 6V). The aforementioned rows Ln1 and Ln2 can also be thought of as being rows formed by the plurality of contact parts cp. When using the nine liquid container side terminals 581A to 581I without distinguishing between them, the code number 581 is used.

As shown in FIG. 17D, in the liquid container 50 mounted state, the front surface 582*fa* on which a plurality of contact parts cp are arranged is slanted so that the lower side end portion 587 is positioned further in the first direction (−K1 axis direction, connection direction) than the upper side end portion 586. Also, the surface (contact surface) TP defined by the plurality of contact parts cp is slanted so that the bottom side is positioned further in the first direction than the upper side. Also, the front surface 582*fa* and the surface TP are slanted so as to face a direction including a +Z axis direction (gravity upward direction) component and a −K1 axis direction (first direction) component.

A-6. Method of Mounting the Liquid Container 50 on the Detachable Unit 30

Figure 18:
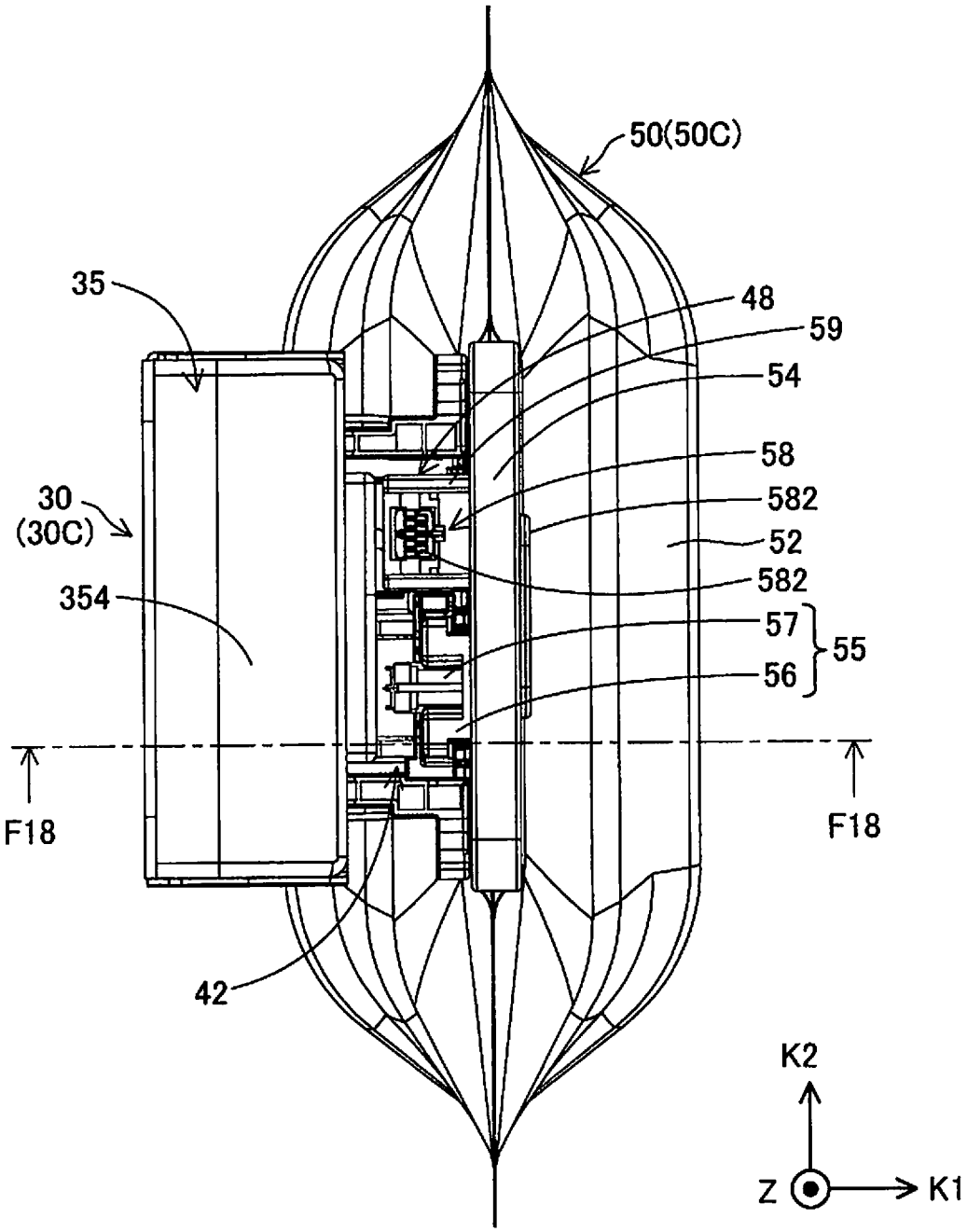
FIG. 18 is a drawing of when the liquid container is set in the detachable unit.
Figure 19:
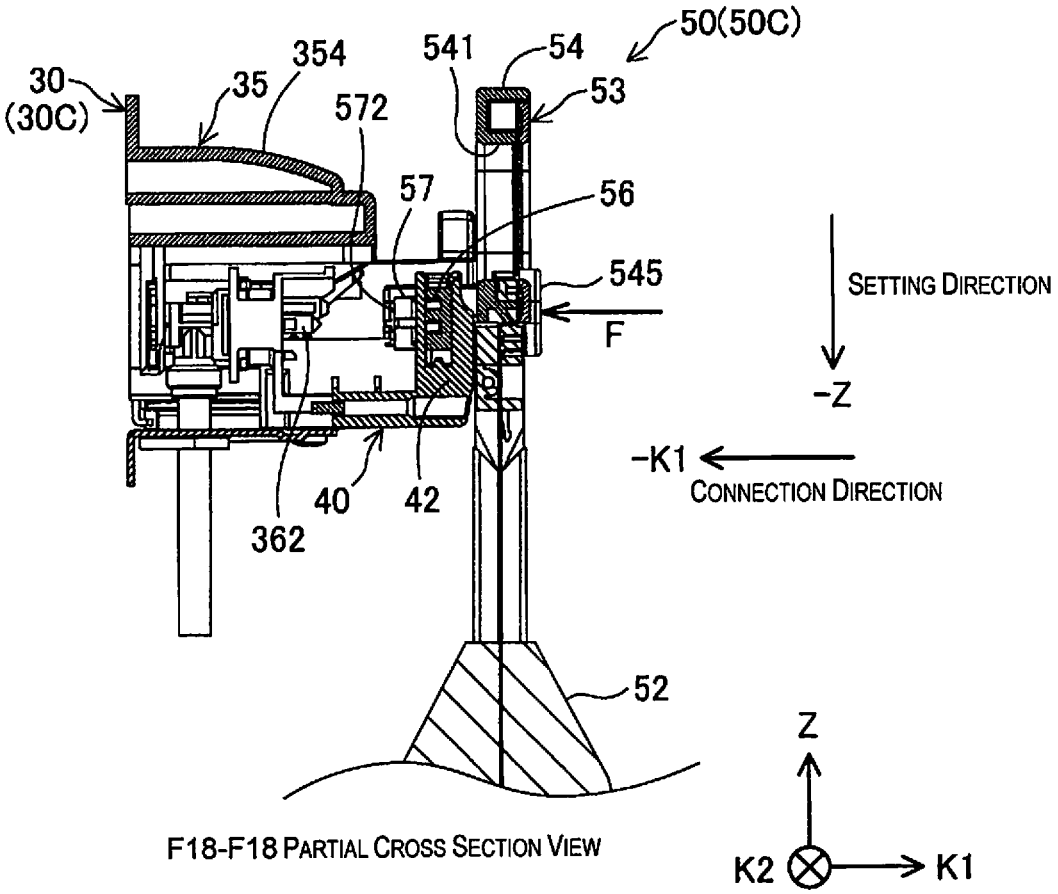
FIG. 19 is a partial cross section view of F18-F18 of FIG. 18.
Figure 20:
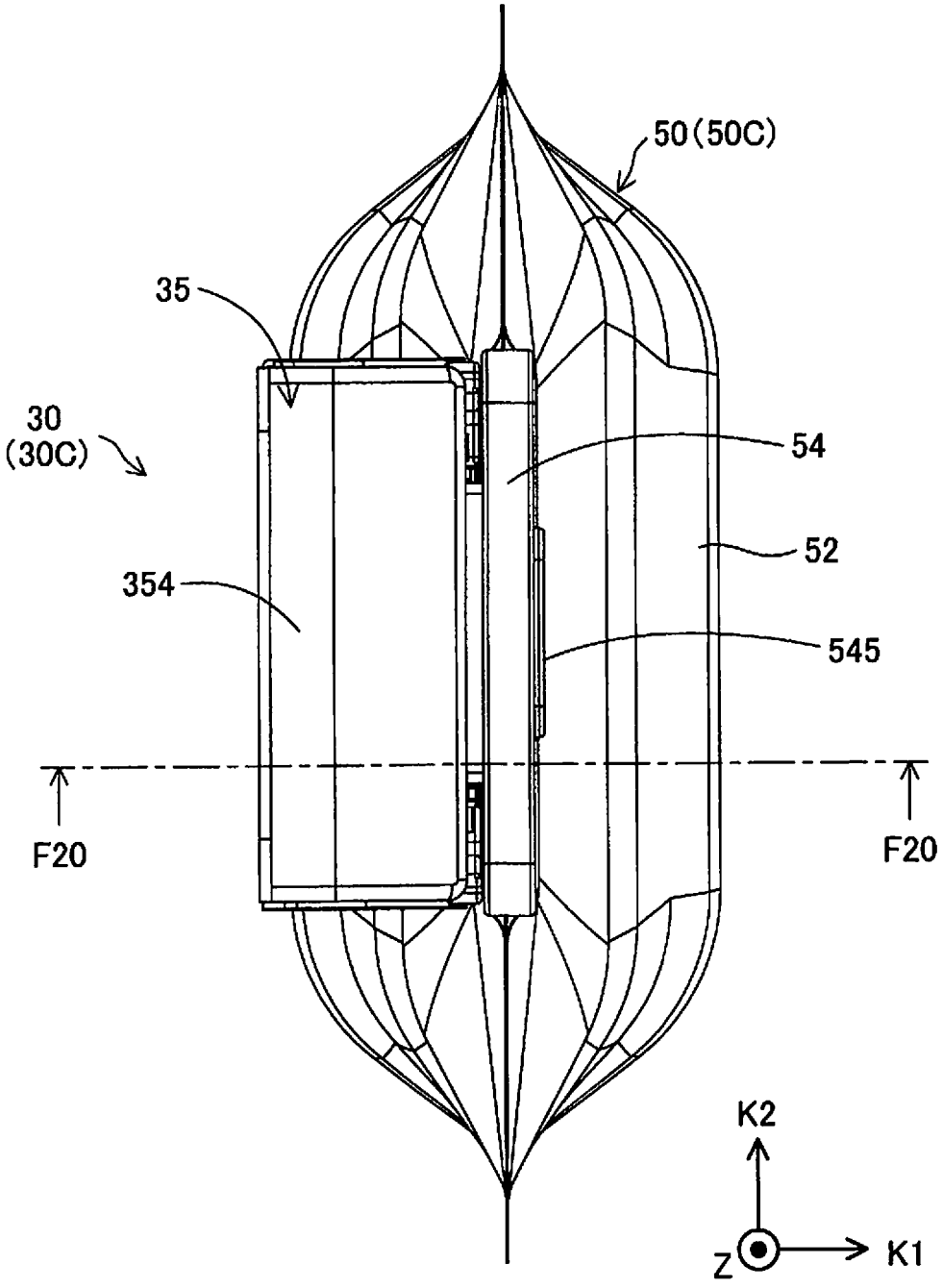
FIG. 20 is a drawing of when the liquid container is mounted in the detachable unit.
Figure 21:
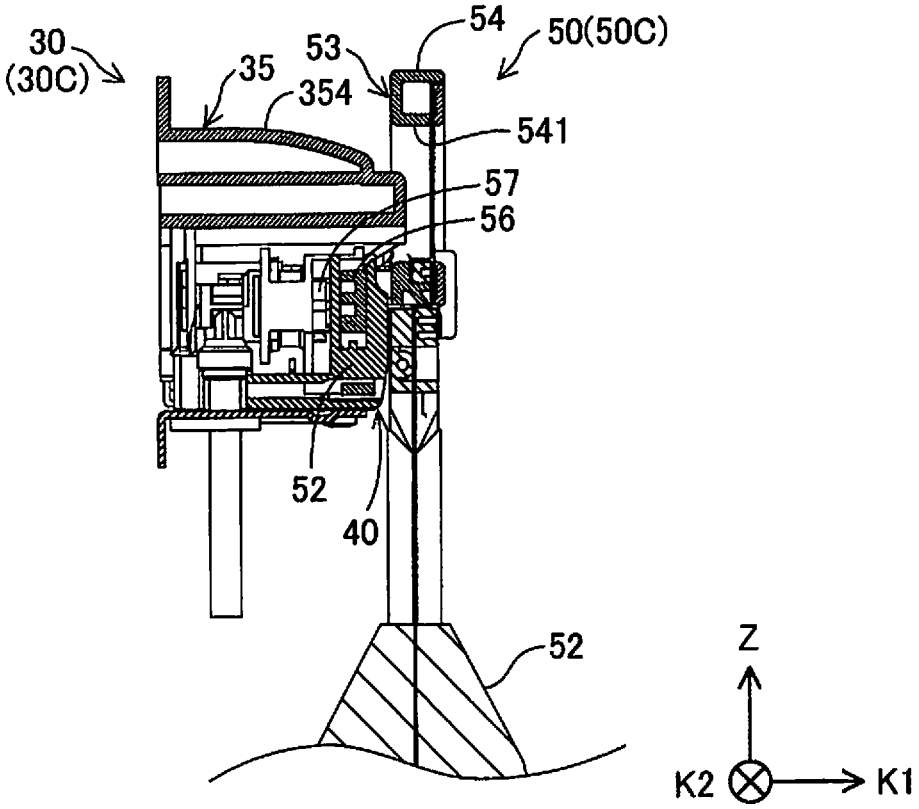
FIG. 21 is a partial cross section view of F20-F20 of FIG. 20.

FIG. 18 is a drawing of when the liquid container 50 is set in the detachable unit 30. FIG. 19 is a partial cross section view of F18-F18 of FIG. 18. FIG. 20 is a drawing of when the liquid container 50 is mounted on the detachable unit 30. FIG. 21 is a partial cross section view of F20-F20 of FIG. 20. The state of the detachable unit 30 shown in FIG. 18 and FIG. 19 is the same as the first state in FIG. 5. The state of the detachable unit 30 shown in FIG. 20 and FIG. 21 is the same as the second state in FIG. 6.

As shown in FIG. 19, when the liquid container 50 is mounted in the detachable unit 30, two operations are performed, the operation of moving the liquid container 50 in the setting direction (setting operation or first operation), and the operation of moving in the connection direction (connection operation or second operation). The setting direction is the direction including the gravity downward direction (−Z axis direction) component. With this embodiment, the setting direction is the gravity downward direction. The connection direction is the direction including the horizontal direction (K1 axis direction). With this embodiment, the connection direction is the −K1 axis direction (first direction) which is the horizontal direction.

With the detachable unit 30 in the first state, the user sets the liquid container 50 in the movable member 40 of the detachable unit 30. In specific terms, the user grips the gripping part 54 in a state for which the operating member 53 is in a state further in the gravity upward direction than the liquid containing part 52. Then, as shown in FIG. 18 and FIG. 19, the housing part side support part 56 of the liquid container 50 is arranged inside the supply part supporting part 42, and the circuit substrate holding part 59 is arranged inside the substrate support part 48.

After the liquid container 50 is set in the movable member 40, as shown by arrow F in FIG. 19, the user pushes the pushing part 545 to the −K axis direction side. By doing this, the liquid container 50 and the movable member 40 are moved in the connection direction (−K1 axis direction).

As shown in FIG. 21, in the second state of the detachable unit 30, the liquid introduction part 362 (FIG. 19) is inserted inside the liquid supply part 57. Also, in the second state, the circuit substrate 582 and the electrical connection part 382 are electrically connected by the terminals 581 (FIG. 13) of the circuit substrate 582 and the device side terminals 381 (FIG. 5B) of the electrical connection part 382 being in contact. Also, with the mounted state shown in FIG. 21, the protecting member 354 is positioned on the upper side of the electrical connection part of the liquid container 50, and covers the top part (above) of the electrical connection part 582. In FIG. 21, the electrical connection part 582 is positioned further to the +K2 axis side than the liquid supply part 57.

As described above, "when the liquid container 50 is connected to the detachable unit 30 (printer 10)" means at least a portion of the period from when the user grips the operating member 53 and starts the setting operation until connection of the liquid container 50 to the printer 10 by the connection operation is completed. With this embodiment, at least a portion of the period is the period from after the liquid container 50 has moved to a certain degree in the connection direction after being set in the movable member 40 until the connection is completed. Also, as shown in FIG. 18 to FIG. 21, the movable member 40 supports the liquid container 50 so that the liquid supply part 57 of the liquid container 50 is positioned further to the upper side (+Z axis direction side) than the liquid containing part 52.

A-7. Connection Timing of Each Part

Figure 22:
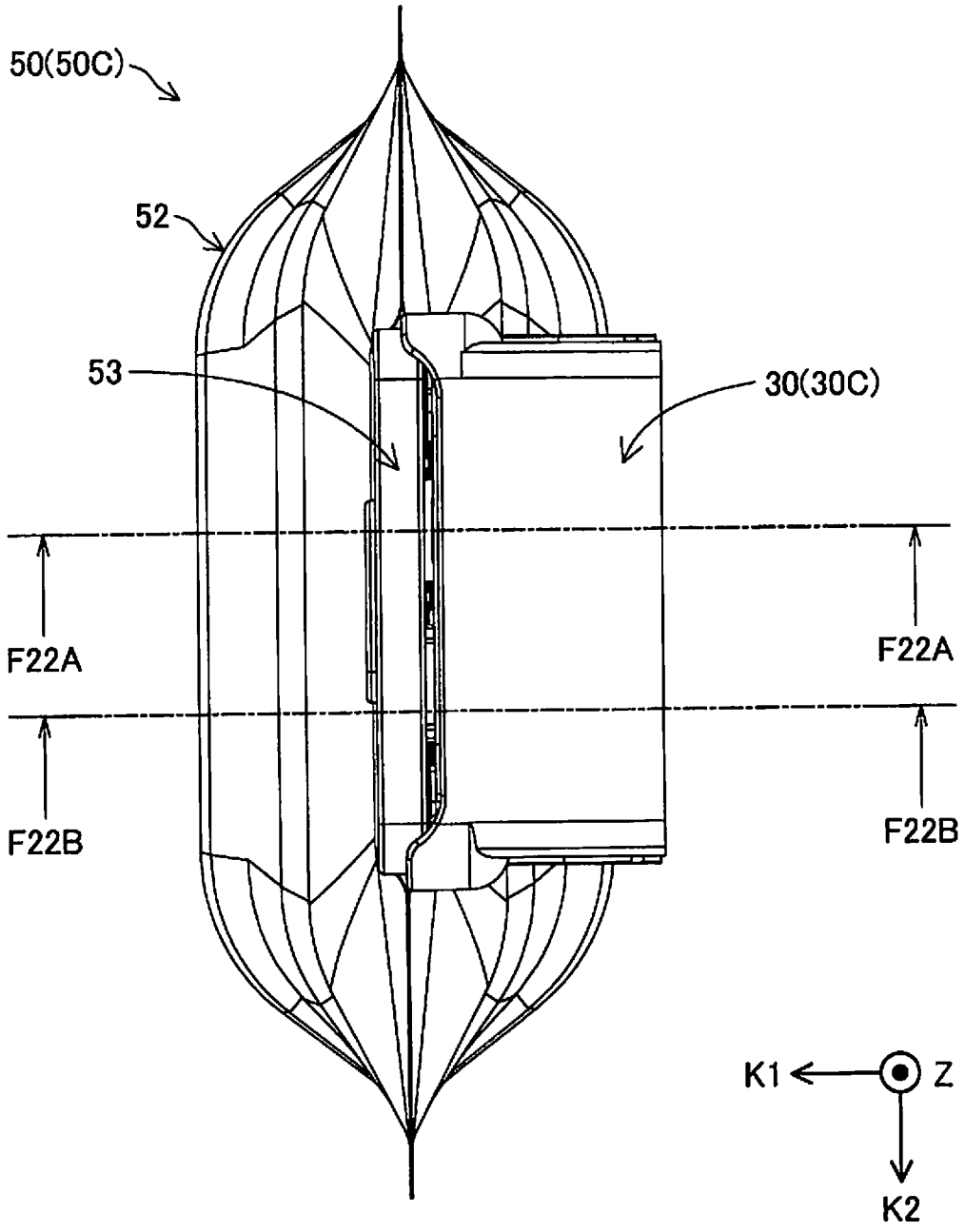
FIG. 22 is a first drawing for describing the connection timing.
Figure 23:
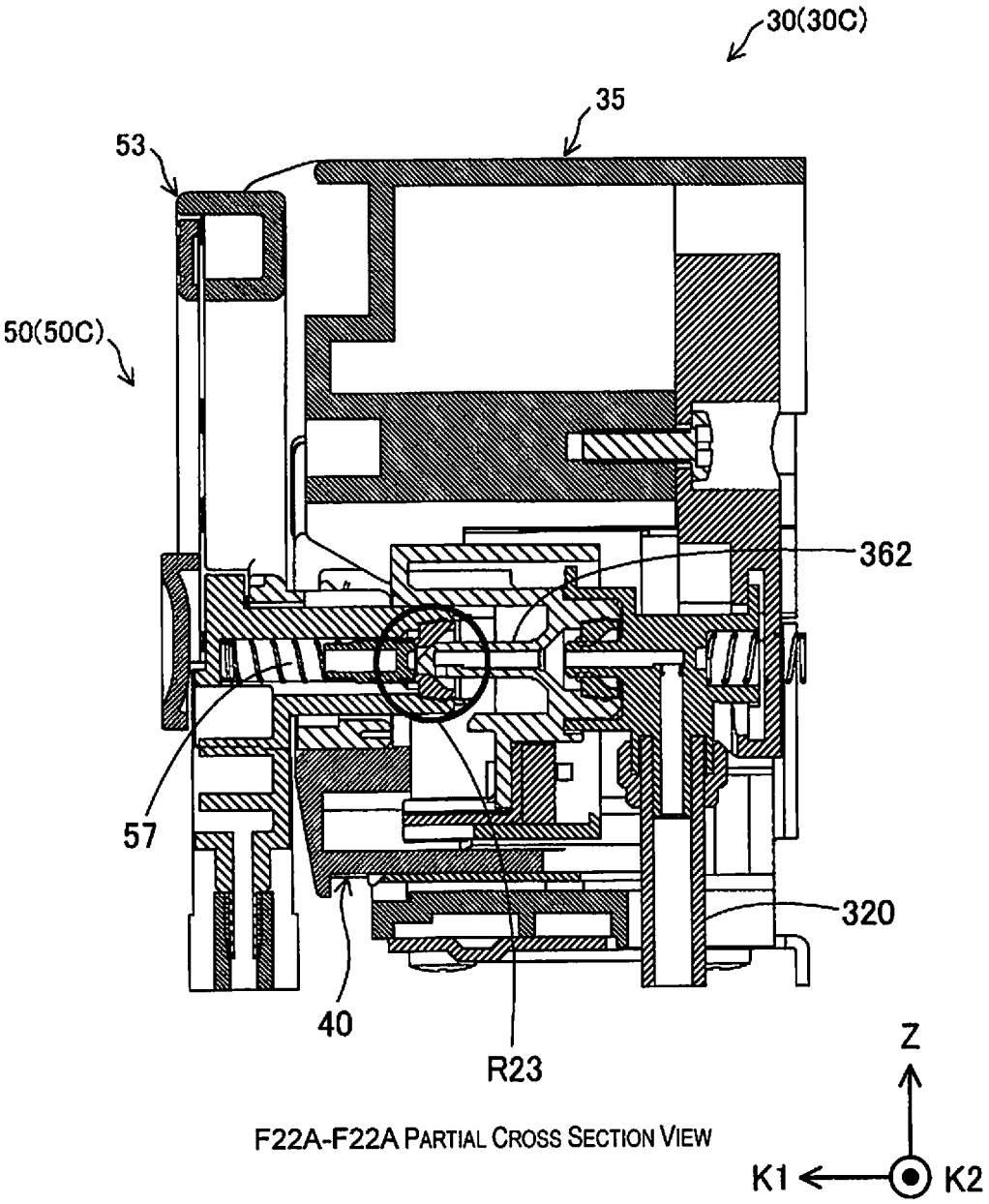
FIG. 23 is a partial cross section drawing of F22A-F22A of FIG. 22.
Figure 24:
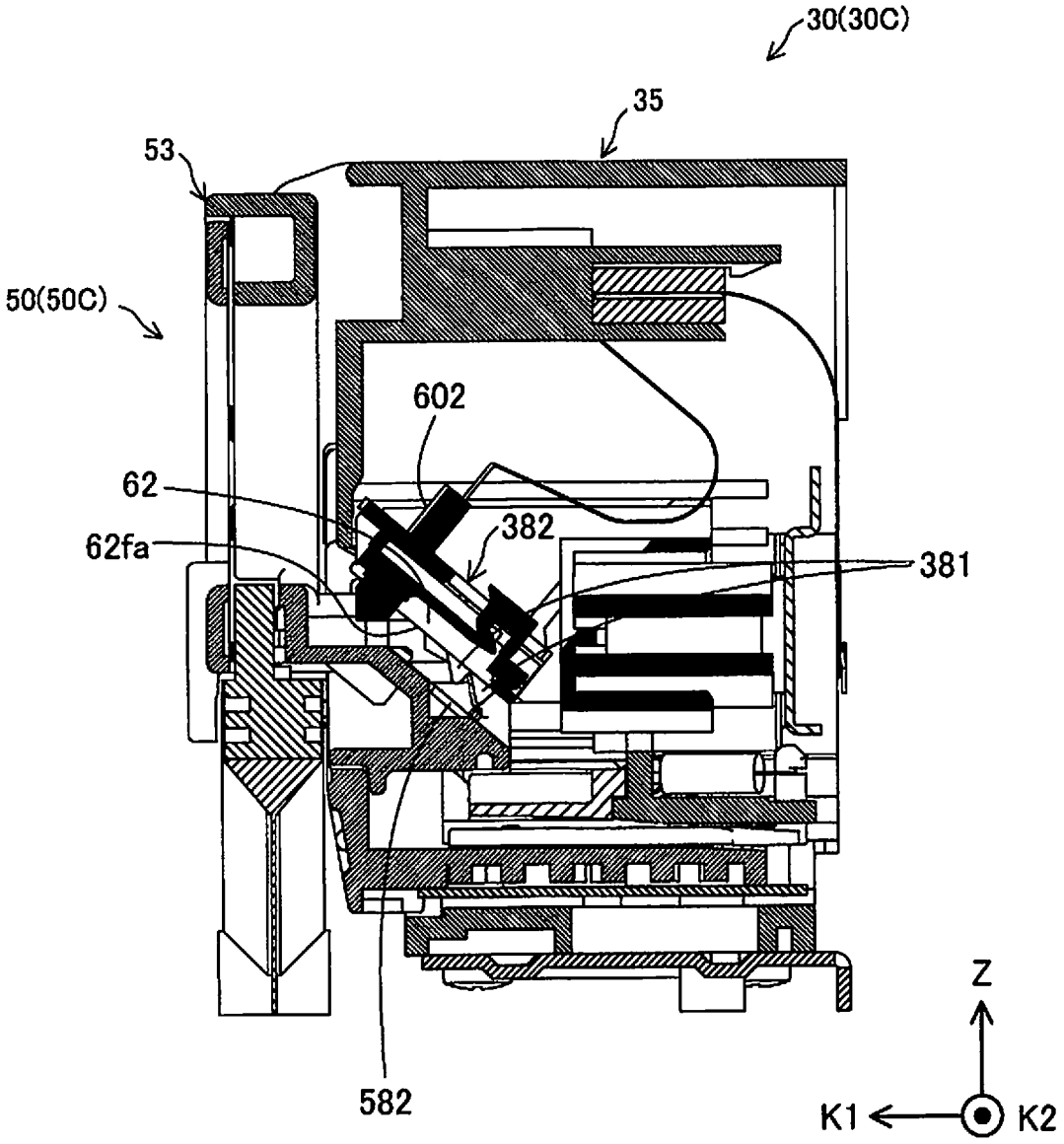
FIG. 24 is a partial cross section drawing of F22B-F22B of FIG. 22.
Figure 25:
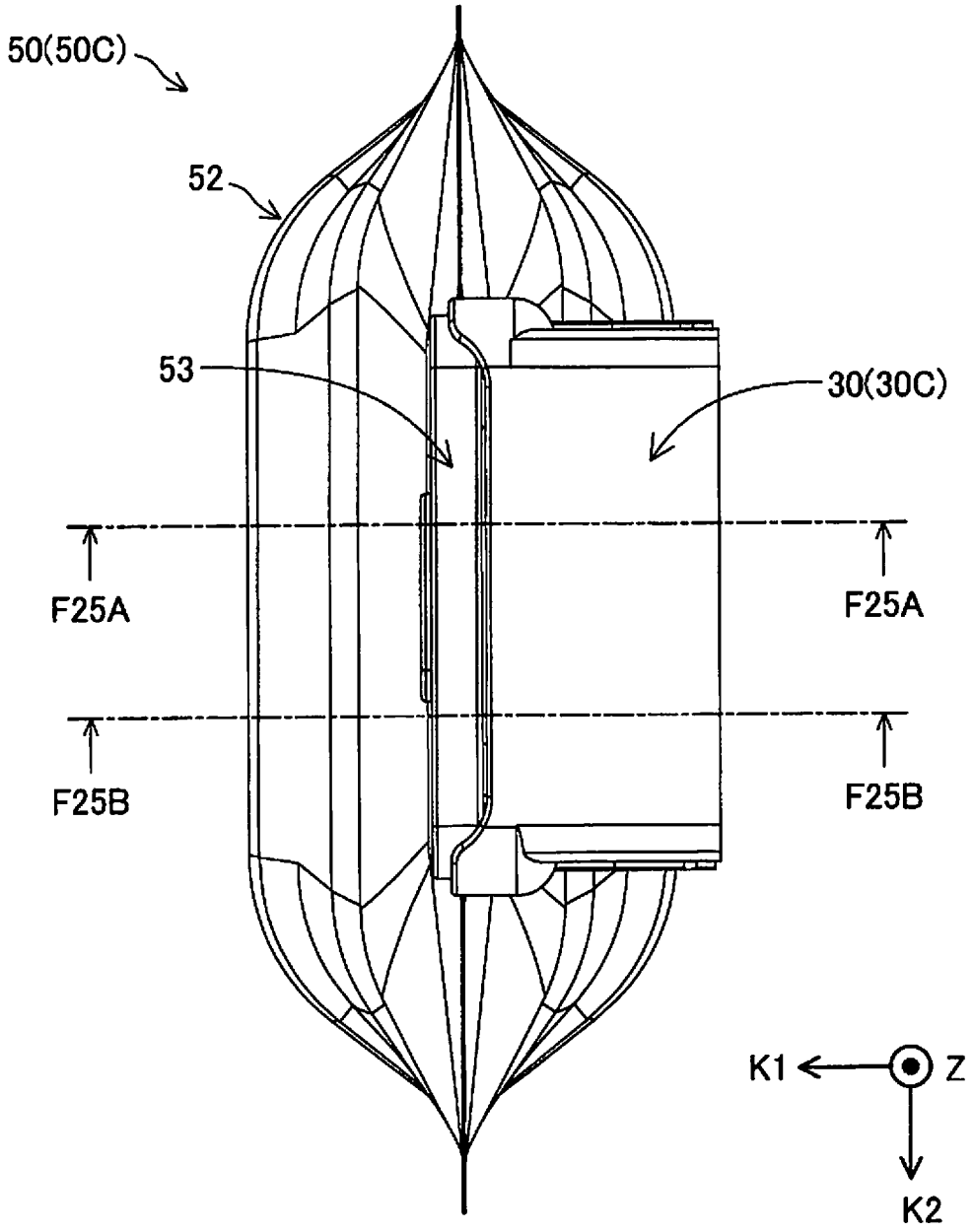
FIG. 25 is a second drawing for describing the connection timing.
Figure 26:
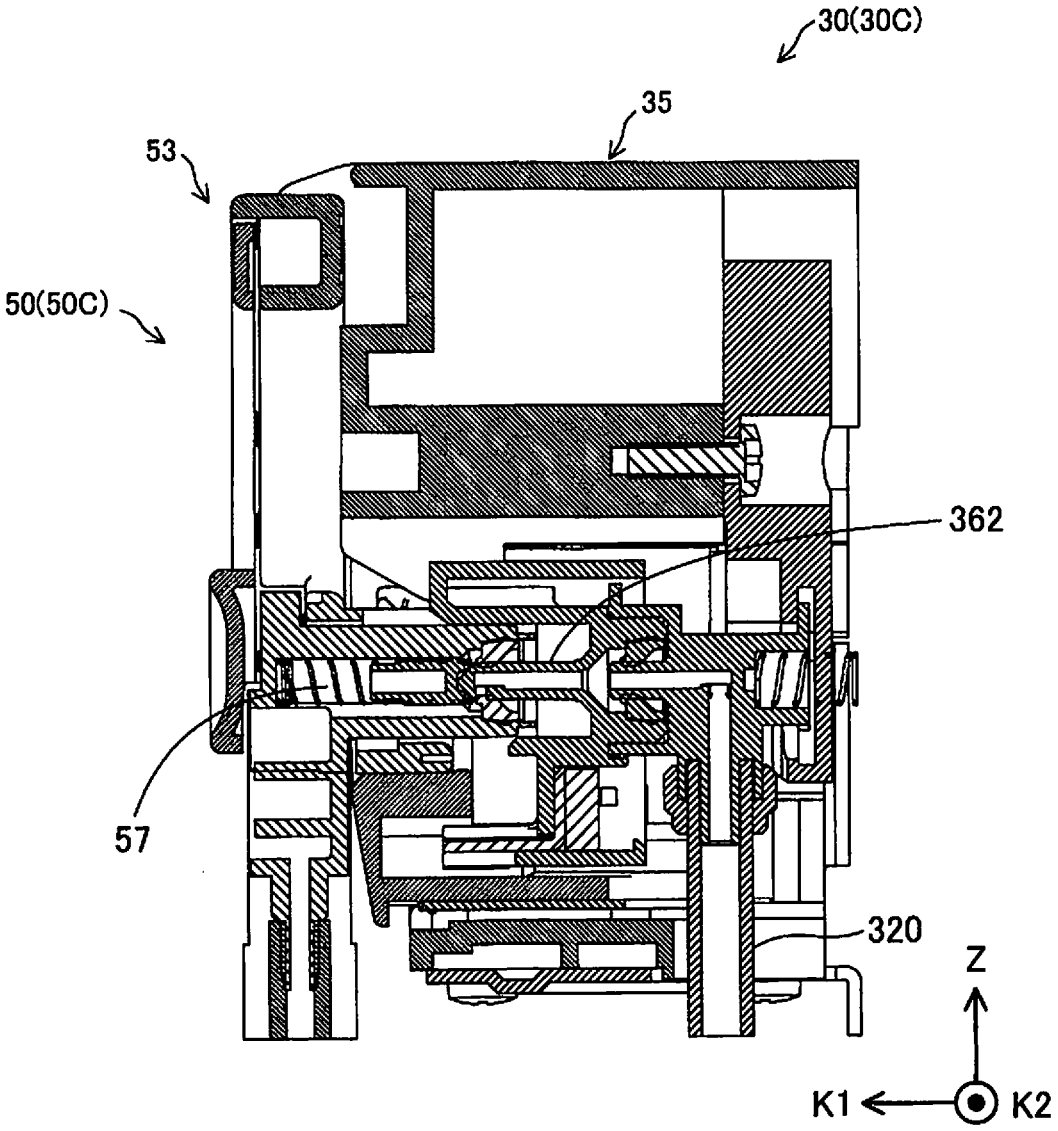
FIG. 26 is a partial cross section drawing of F25A-F25A of FIG. 25.
Figure 27:
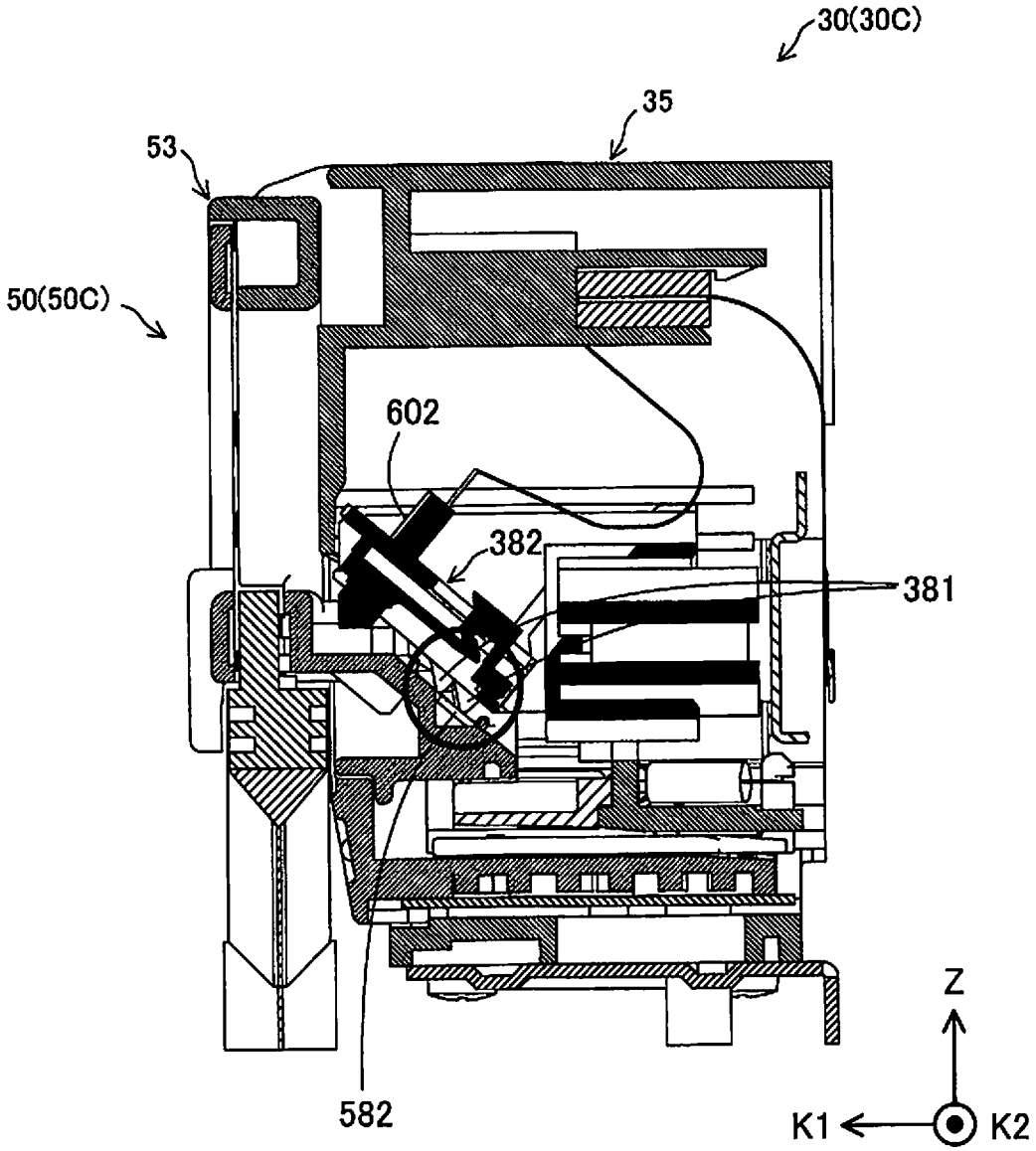
FIG. 27 is a partial cross section drawing of F25B-F25B of FIG. 25.

FIG. 22 is a first drawing for describing the connection timing. FIG. 23 is a partial cross section view of F22A-F22A of FIG. 22. FIG. 24 is a partial cross section view of F22B-F22B of FIG. 22. FIG. 25 is a second drawing for describing the connection timing. FIG. 26 is a partial cross section view of F25A-F25A of FIG. 25. FIG. 27 is a partial cross section view of F25B-F25B of FIG. 25. FIG. 22 is a first drawing of before completion of mounting of the liquid container 50. FIG. 25 is a second drawing of before completion of mounting of the liquid container 50.

As shown in FIG. 23 and FIG. 24, by pushing forward the liquid container 50 in the connection direction (−K1 axis direction, first direction), connection of the liquid supply part 57 and the liquid introduction part 362 starts before contact (connection) of the circuit substrate 582 (in more detail, terminal 581 of the circuit substrate 582) and the device side terminal 381 starts. In FIG. 23, for easier understanding, the region in which connection of the liquid supply part 57 and the liquid introduction part 362 is started is shown as code number R23.

As shown in FIG. 26 and FIG. 27, by the liquid container 50 being further pushed forward in the connection direction, contact of the terminal 581 of the circuit substrate 582 and the device side terminal 381 starts.

A-8. Relationship of the Printer 10 and the Parts of the Liquid Container 50

A-8-1. Support when Connecting

Figure 28:
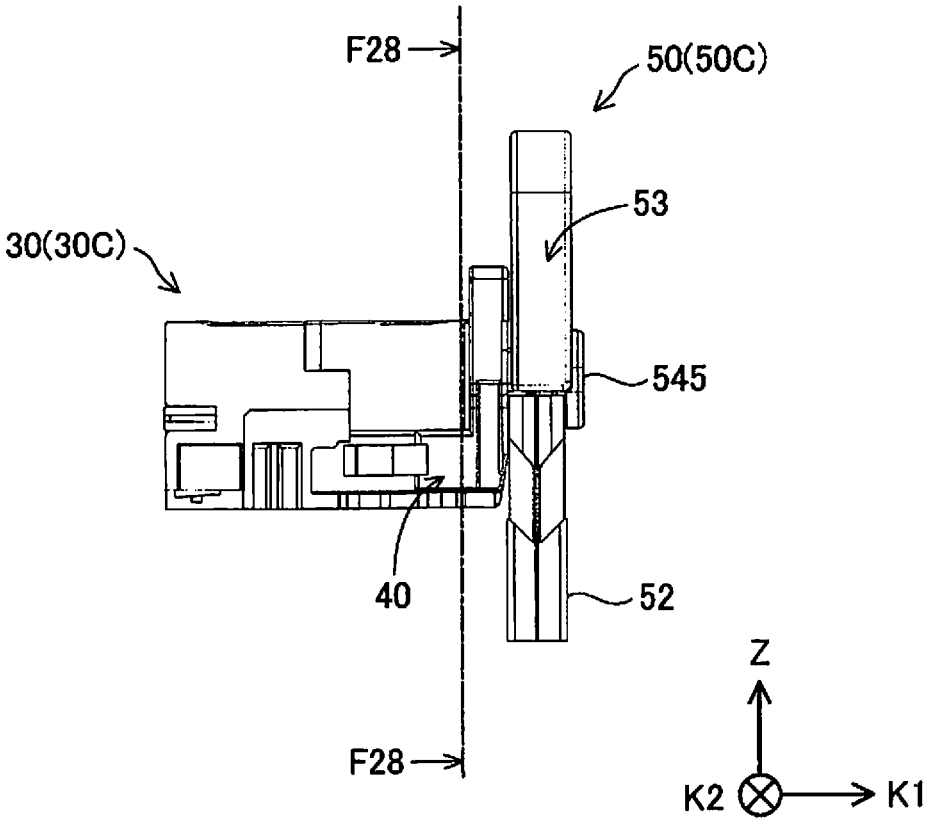
FIG. 28 is a side view of when the liquid container is set in the movable member.
Figure 29:
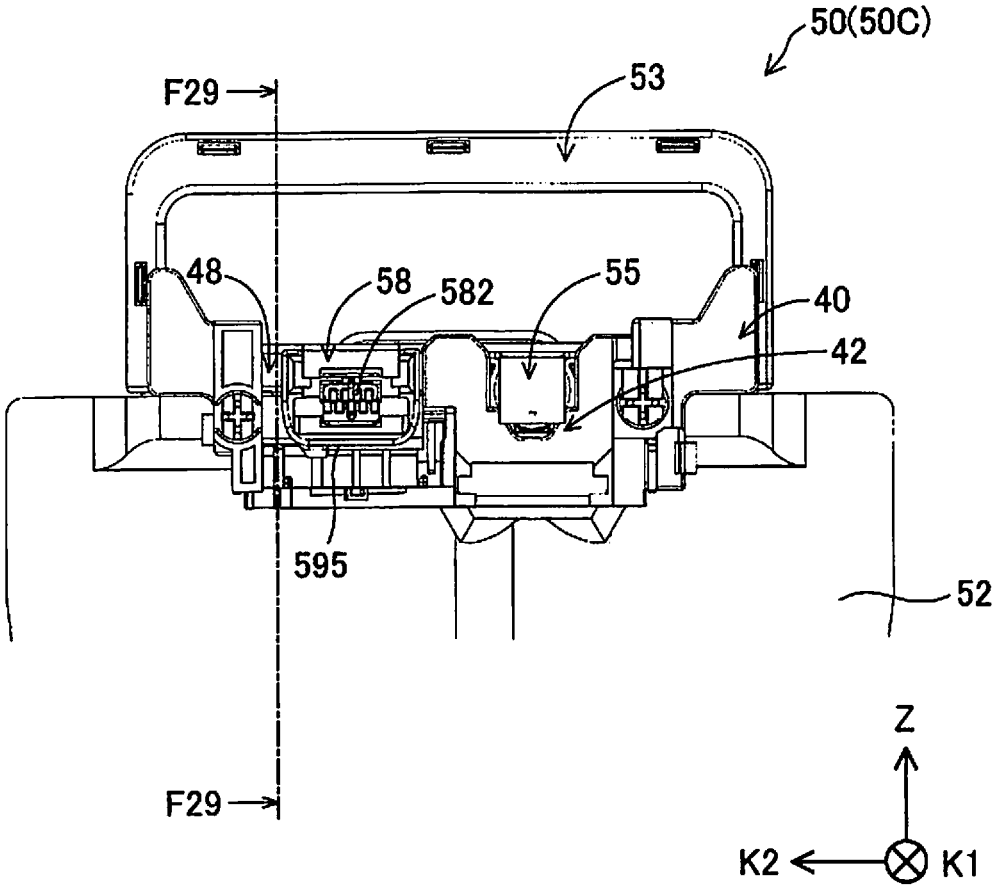
FIG. 29 is a front view of when the liquid container is set in the movable member.
Figure 30:
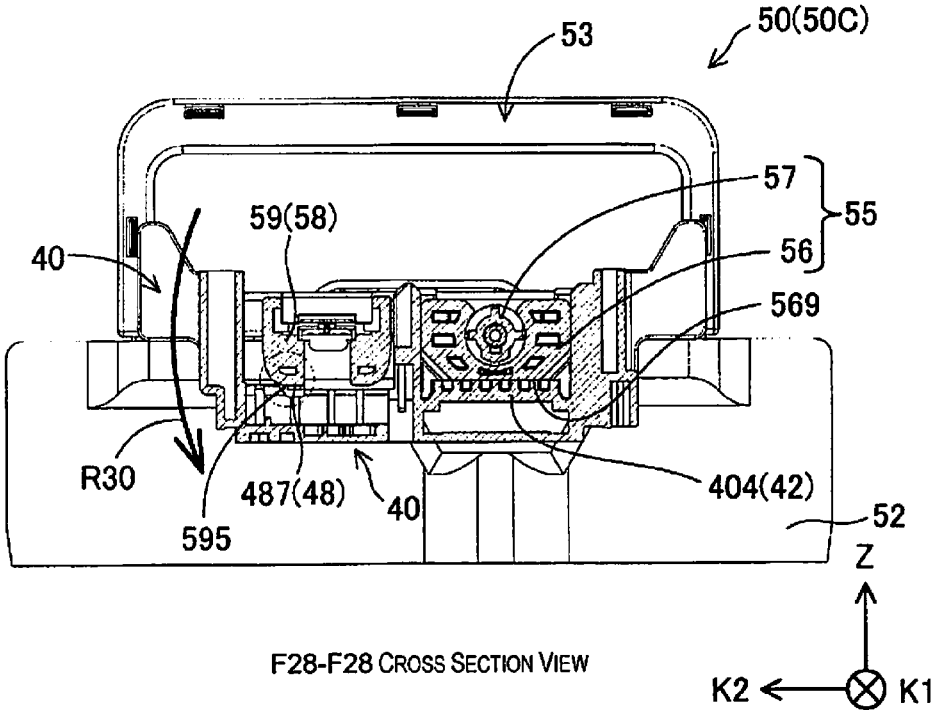
FIG. 30 is a cross section view of F28-F28 of FIG. 28.
Figure 31:
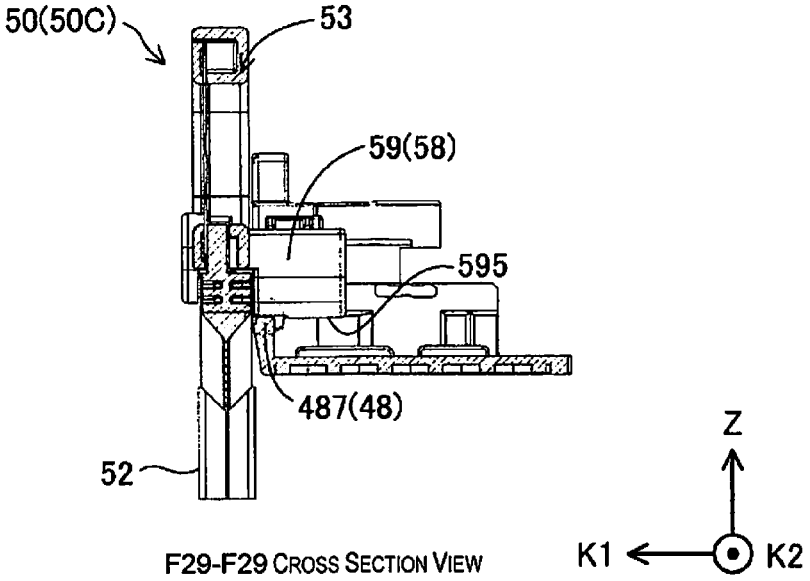
FIG. 31 is a cross section view of F29-F29 of FIG. 29.
Figure 32:
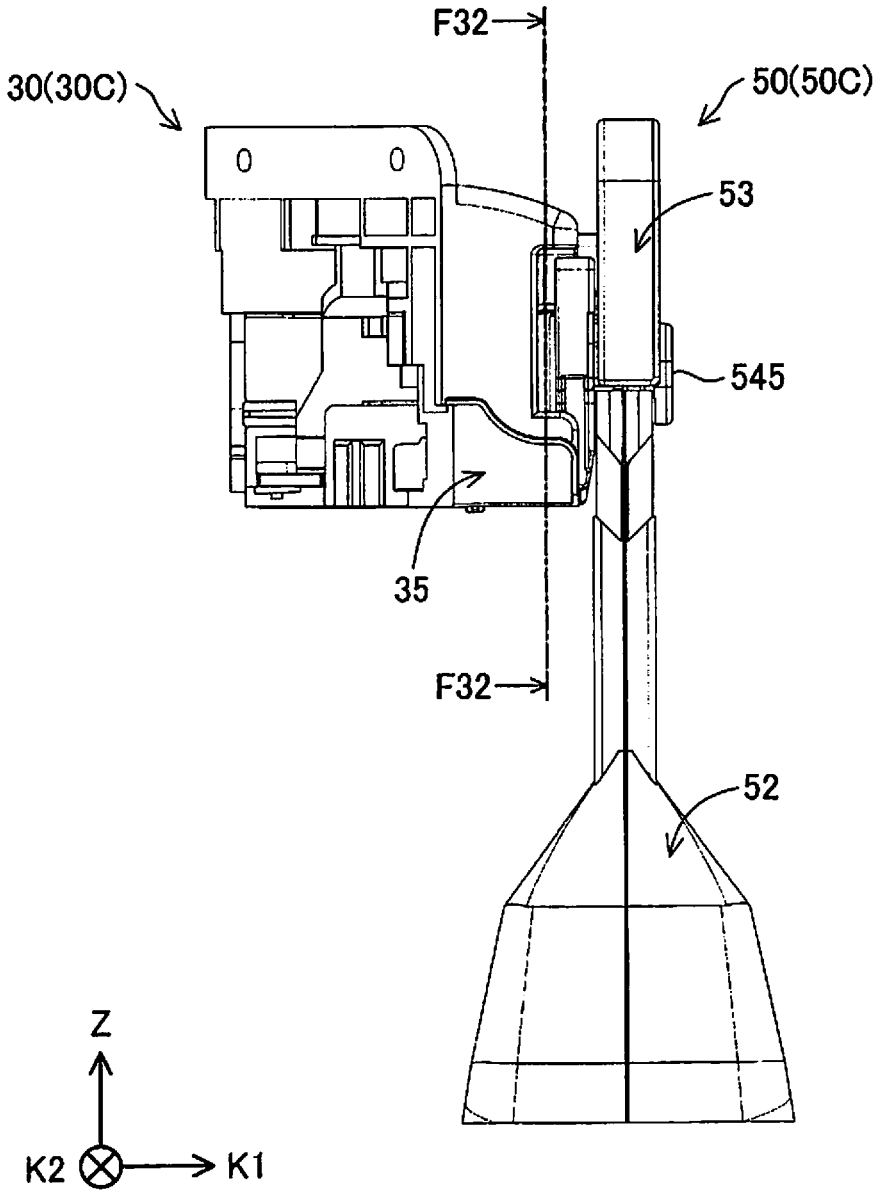
FIG. 32 is a side view of when mounting of the liquid container on the detachable unit is completed.
Figure 33:
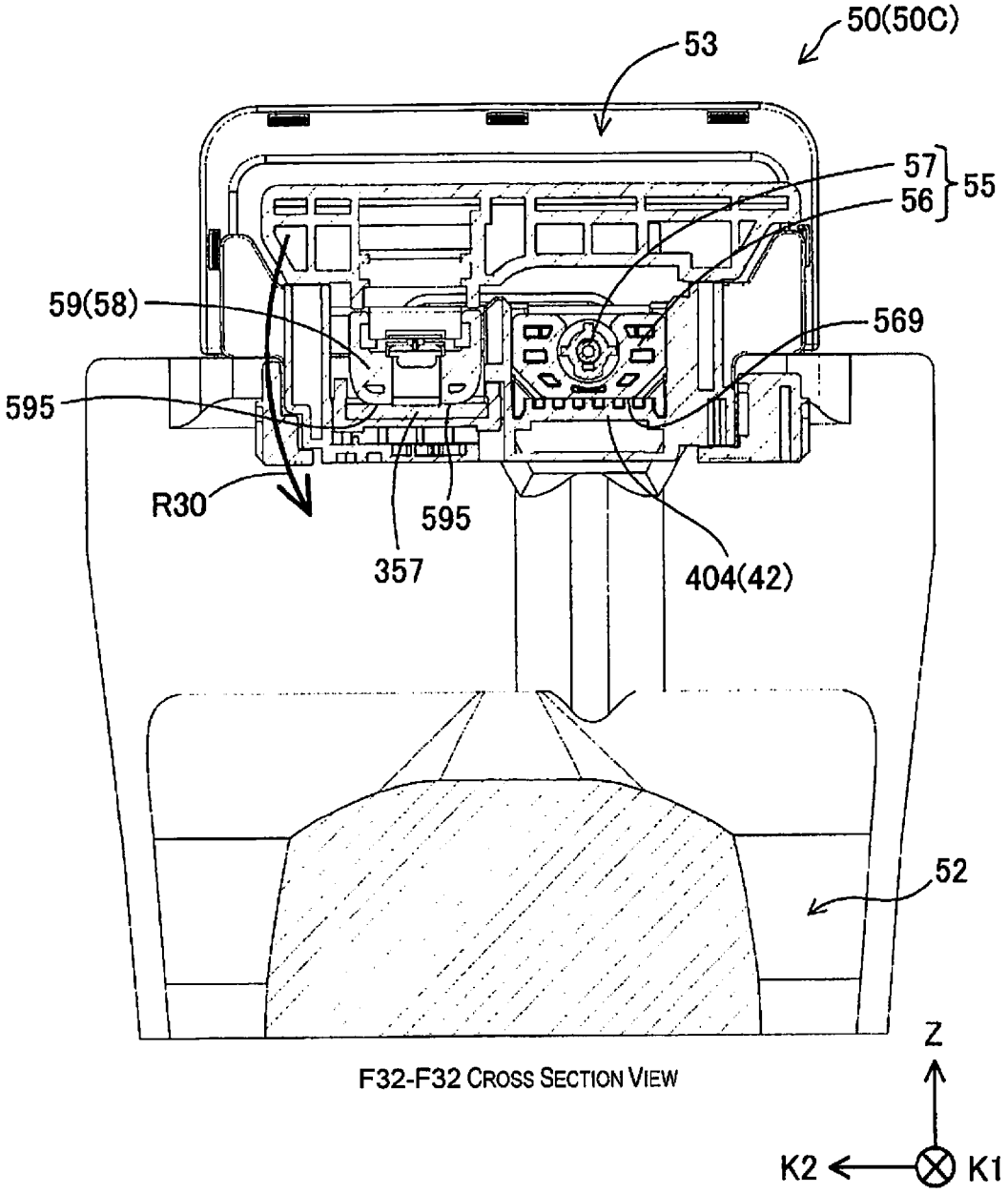
FIG. 33 is a cross section view of F32-F32 of FIG. 32.

FIG. 28 is a side view of when the liquid container 50 is set in the movable member 40 that the detachable unit 30 is equipped with. FIG. 29 is a front view of when the liquid container 50 is set in the movable member 40 that the detachable unit 30 is equipped with. FIG. 30 is a cross section view of F28-F28 of FIG. 28. FIG. 31 is a cross section view of F29-F29 of FIG. 29. FIG. 32 is a side view of when mounting (connecting) of the liquid container 50 to the detachable unit 30 is completed. FIG. 33 is a cross section view of F32-F32 of FIG. 32. The state of the detachable unit 30 shown in FIG. 28 is the same as the first state in FIG. 5. The state of the detachable unit 30 shown in FIG. 32 is the same as the second state in FIG. 6.

As shown in FIG. 30, when the liquid container 50 is set in the movable member 40, the liquid supply unit 55 and the substrate unit 58 are supported so as to be further to the upper side in the gravity direction (+Z axis direction side) than the liquid containing part 52. As shown in FIG. 30, the movement of the liquid container 50 in the gravity downward direction (−Z axis direction) is regulated by the bottom part 569 of the housing part side support part 56 abutting the third support surface part 404 of the supply part supporting part 42. By doing this, of the liquid containing part 52, the −K2 axis direction side is supported.

Also, as shown in FIG. 33, when the liquid container 50 is connected to the detachable unit 30 (when in a mounted state), the same as when the liquid container 50 is set in the movable member 40, the liquid supply unit 55 and the substrate unit 58 are supported further to the upper side (+Z axis direction side) in the gravity direction than the liquid containing part 52. In specific terms, the movement of the liquid container 50 in the gravity downward direction (−Z axis direction) is regulated by the bottom part 595 of the circuit substrate holding part 59 abutting the bottom part 357 of the stationary member 35. Also, the movement of the liquid container 50 in the gravity downward direction (−Z axis direction) is regulated by the bottom part 569 of the housing part side support part 56 abutting the third support surface part 404 of the supply part supporting part 42. In this way, the liquid container 50 is supported by the movement of the liquid container 50 in the gravity downward direction being regulated by the liquid supply unit 55 and the substrate unit 58. The abutting of the bottom part 357 of the stationary member 35 and the circuit substrate holding part 59 starts during the time after the liquid container 50 has been set in the movable member 40 and moved in the connection direction, until connection is completed.

As shown in FIG. 30 and FIG. 33, the bottom part 595 of the circuit substrate holding part 59, when an attempt is made to rotate in the arrow R30 direction, abuts the device side rotation regulating part 487 of the movable member 40. By doing this, the circuit substrate holding part 59 is regulated to rotate in the arrow R30 direction with the liquid supply part 57 as the center. Thus, the bottom part 595 is also called the rotation regulating part 595.

A-8-2. Positioning of the Liquid Supply Part 57 and the Liquid Introduction Part 362

Figure 34:
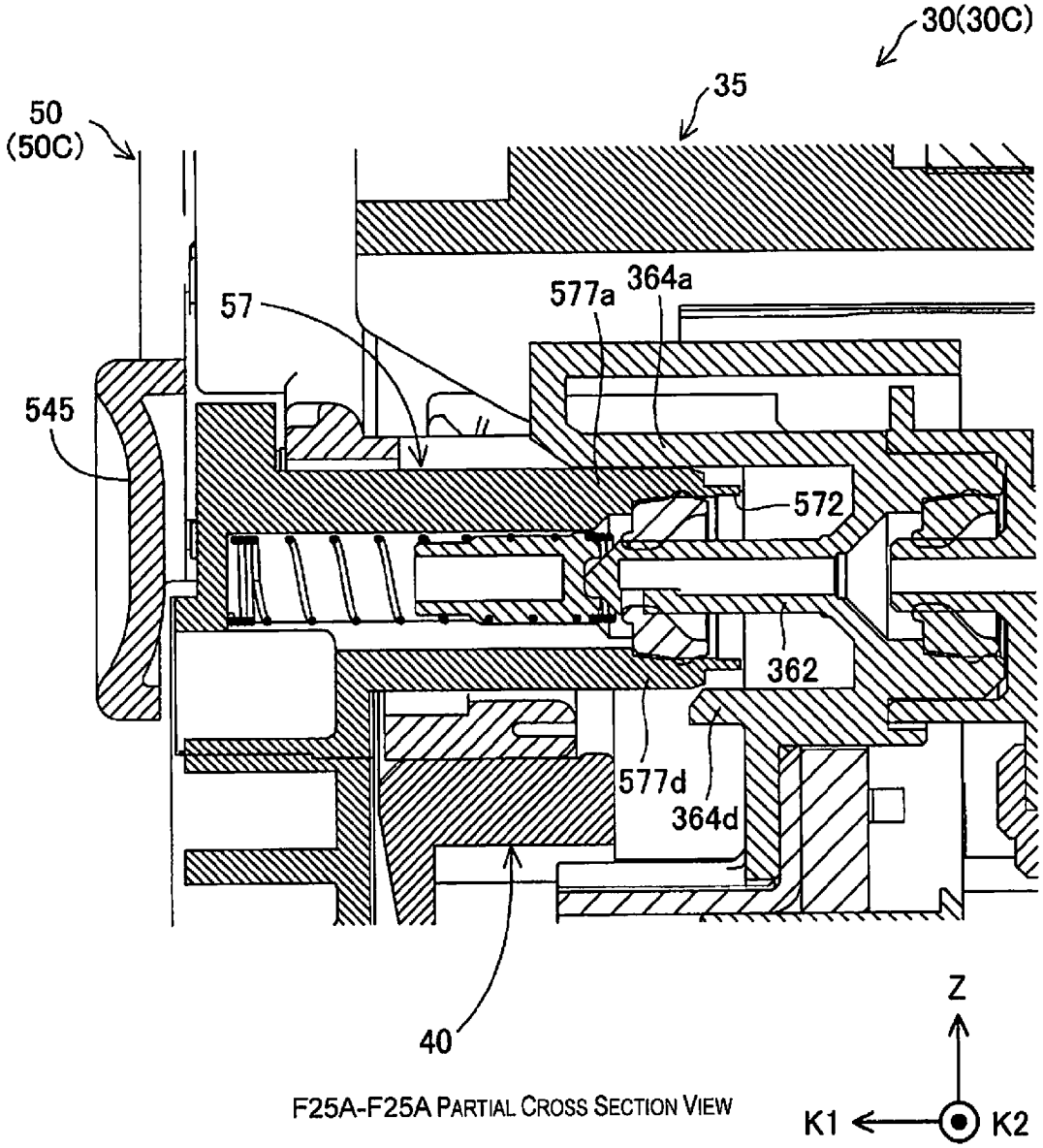
FIG. 34 is a partial enlarged view of F25A-F25A of FIG. 25.
Figure 35:
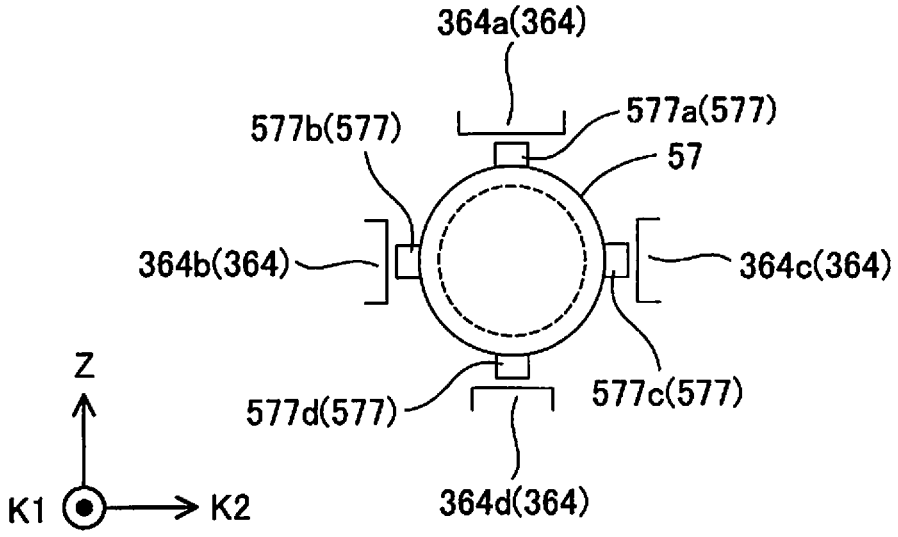
FIG. 35 is a drawing for describing positioning.

FIG. 34 is a partial enlarged view of F25A-F25A of FIG. 25. FIG. 35 is a drawing for describing the positioning.

As shown in FIG. 34, for example when the liquid supply part 57 is positioned further to the gravity upward direction side than the position designed for the liquid introduction part 362, the +Z axis direction side liquid supply part 57 positioning is performed by the first supply part positioning part 364*a* abutting the first liquid container side positioning part 577*a*.

As shown in FIG. 35, when the liquid container 50 is connected to the detachable unit 30, the positioning part 577 provided on the periphery of the liquid supply part 57 enters the inside of the positioning part 364 provided on the periphery of the liquid introduction part 362. When the position of the liquid supply part 57 is skewed in relation to the liquid introduction part 362, fine correction of the position of the liquid supply part 57 in relation to the liquid introduction part 362 is done by the positioning part 577 and the supply part positioning part 364 abutting. Specifically, the positioning part 577 and the supply part positioning part 364 are members that perform positioning in the direction intersecting the connection direction (−K axis direction) of the liquid supply part 57 to the liquid introduction part 362.

A-9. Details of the Displacement Mechanism (Alignment) of the Liquid Introduction Structure 36 and the Liquid Introduction Part 362

Figure 36:
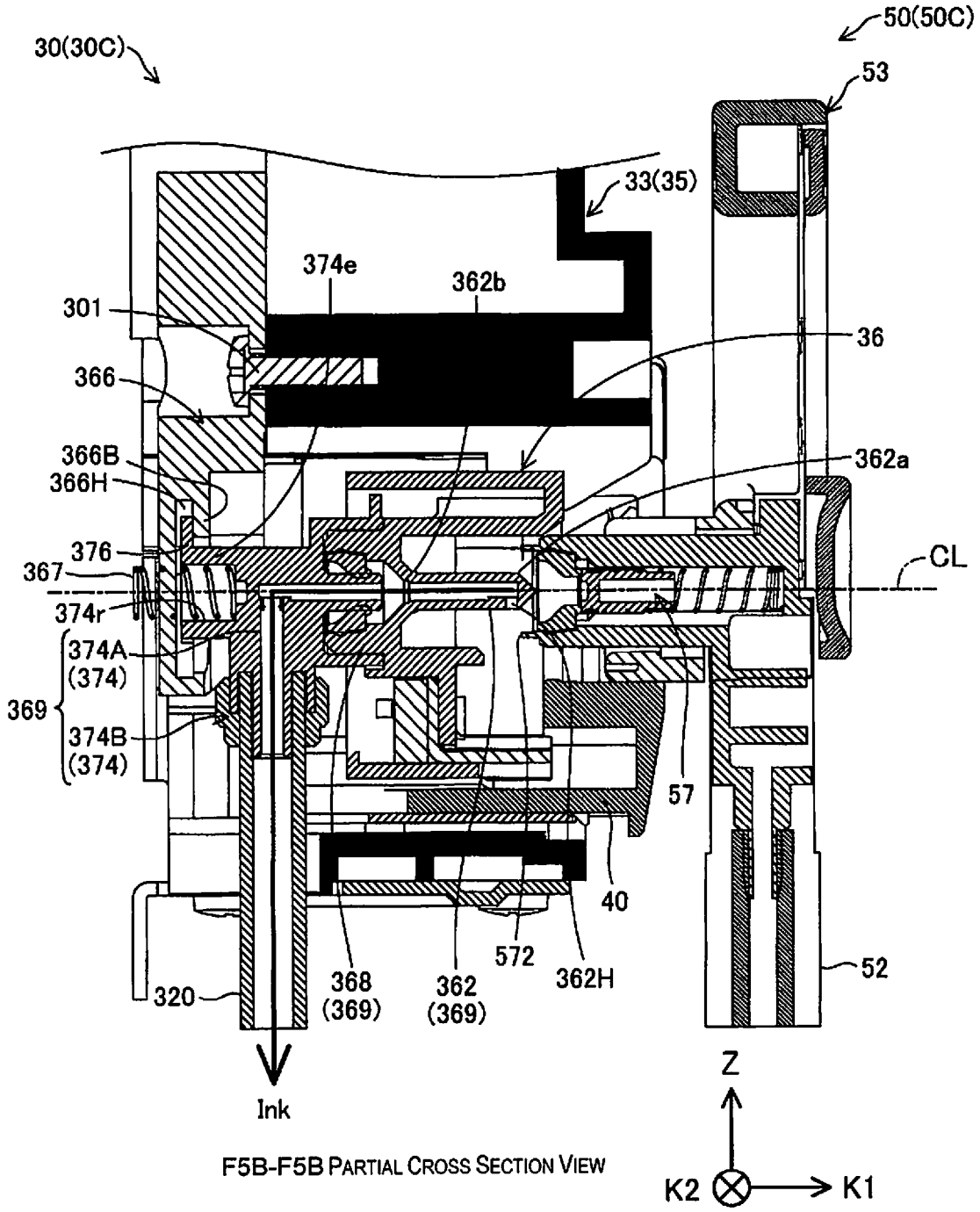
FIG. 36 is a partial cross section view of F5B-F5B of FIG. 5B.
Figure 37:
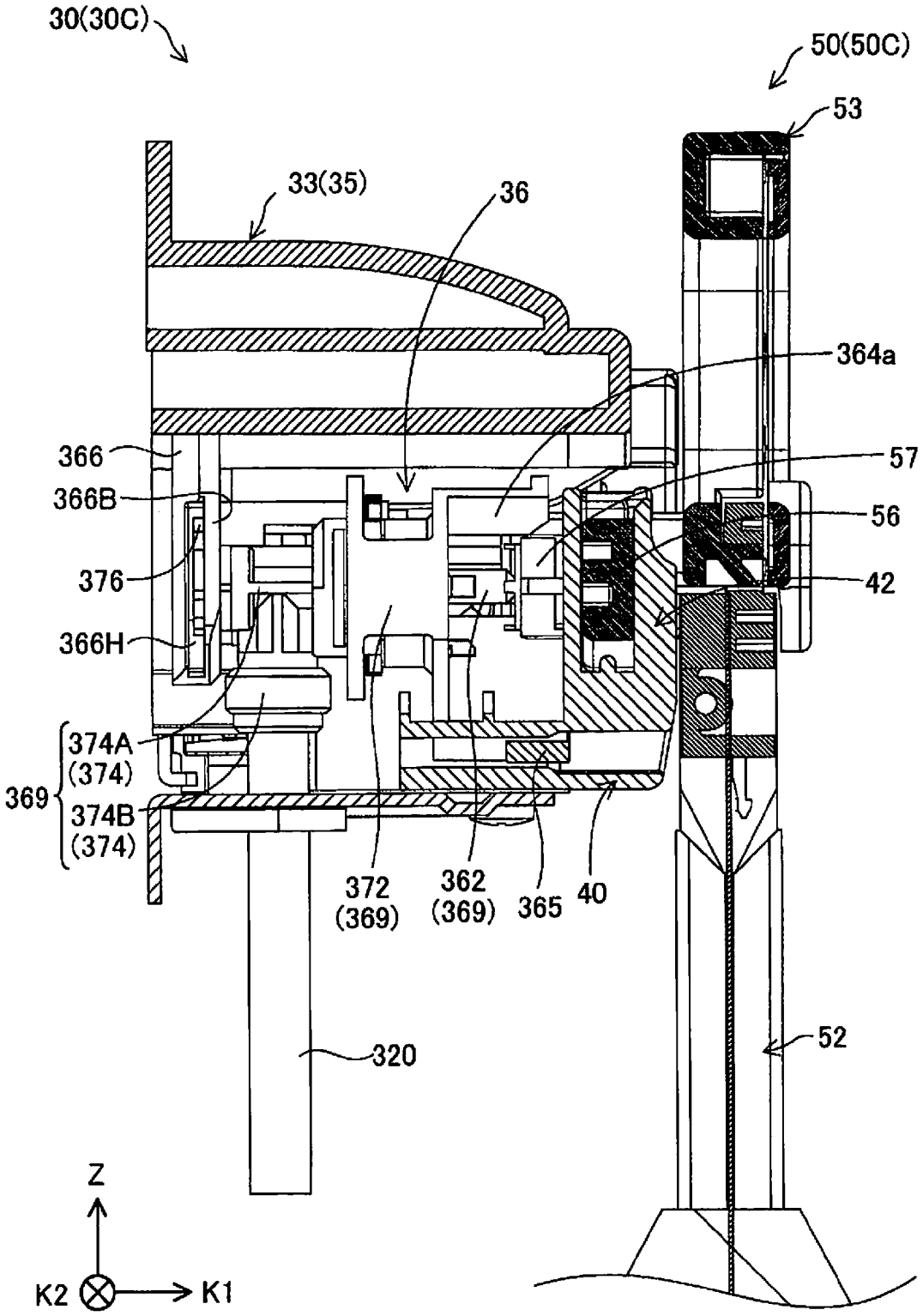
FIG. 37 is a drawing of the liquid introduction part seen from the −K2 axis direction side.
Figure 38:
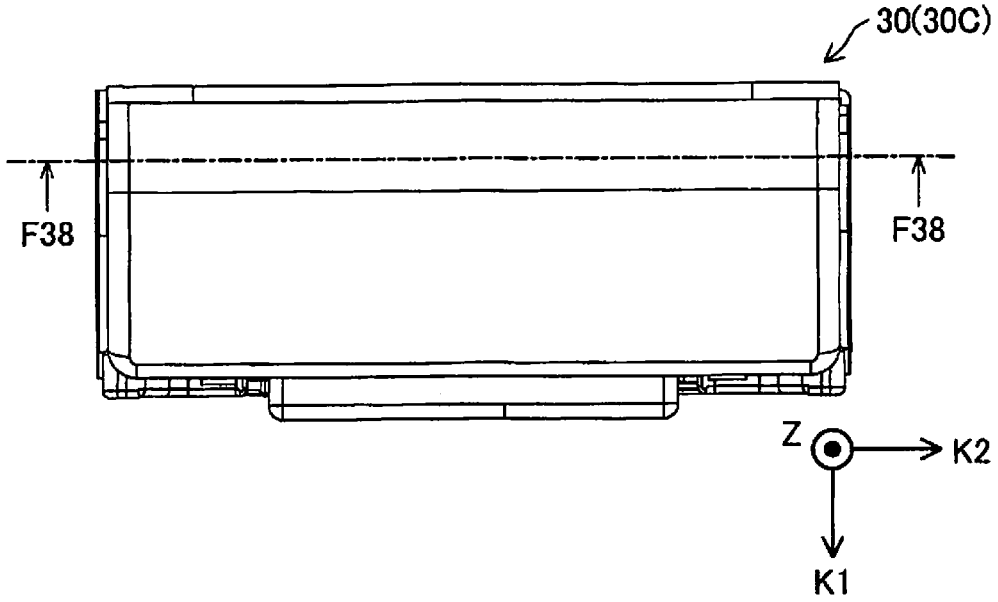
FIG. 38 is a top view of the detachable unit.
Figure 39:
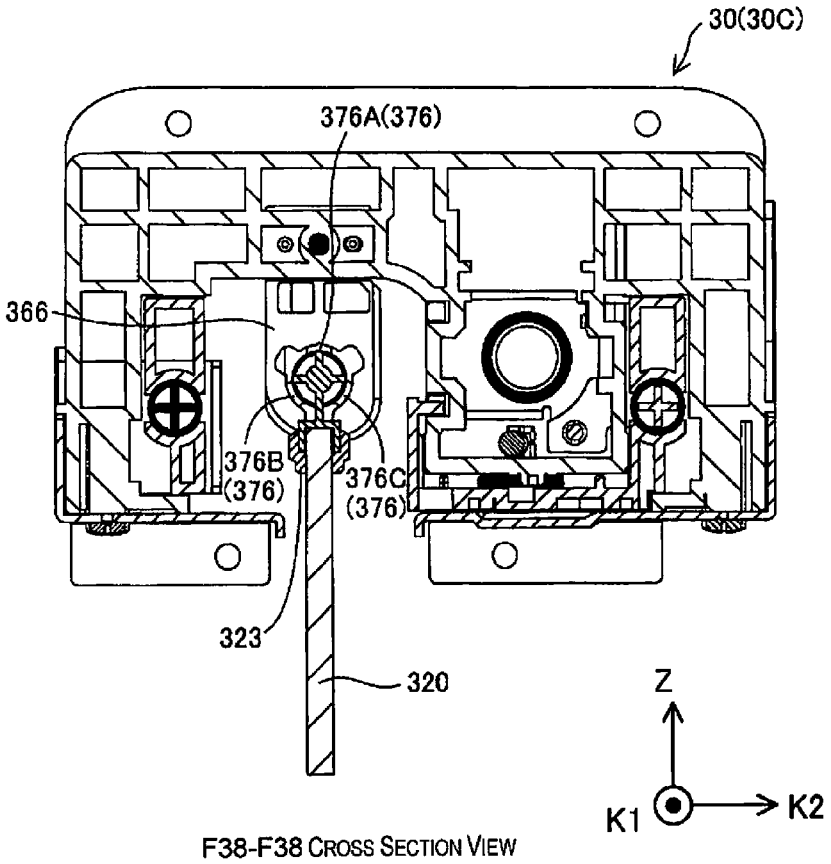
FIG. 39 is a cross section view of F38-F38.
Figure 40:
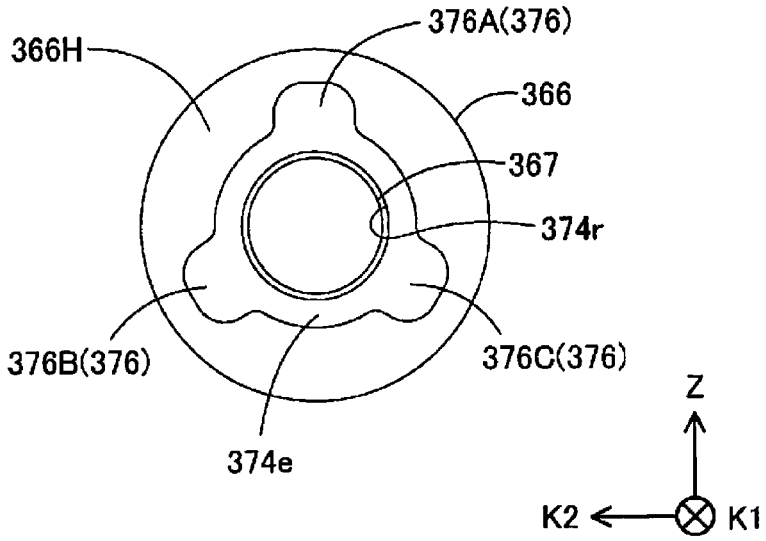
FIG. 40 is a drawing for describing the displacement mechanism.

FIG. 36 is a partial cross section view of F5B-F5B of FIG. 5B. FIG. 37 is a view of the liquid introduction part 362 seen from the −K2 axis direction side. FIG. 38 is a top view of the detachable unit 30. FIG. 39 is a cross section of F38-F38. FIG. 40 is a drawing for describing the displacement mechanism. FIG. 36 and FIG. 37 also show the liquid container 50 for easier understanding.

As shown in FIG. 36 and FIG. 37, the liquid introduction structure 36 has a liquid conduit part 369 that forms a flow path for supplying the ink of the liquid container 50 in the printer 10. The liquid conduit part 369 is equipped with the liquid introduction part 362, the liquid introduction main unit part 368, and the connection flow path part 374 in sequence from the upstream side in the ink flow direction facing from the outside to the printer 10 side. Hereafter, "upstream side" and "downstream side" will use the ink flow direction from the outside (liquid container 50) facing the printer 10 side as the standard. With the liquid conduit part 369, the upstream side forms a flow path parallel to the central axis CT, and the downstream side forms a flow path in the gravity downward direction. The liquid conduit part 369 can also be regarded as the "liquid introduction part 362."

On the upstream side end portion of the liquid introduction part 362, a liquid introduction hole 362H that draws ink from the outside in the flow path of the liquid introduction part 362 is formed. The downstream side end portion of the liquid introduction part 362 is connected to the liquid introduction main unit part 368. The liquid introduction part 362 and the liquid introduction main unit part 368 form a flow path parallel to the central axis CL. The liquid introduction main unit part 368 can also be regarded as a portion of the liquid introduction part 362. In this case, the liquid introduction main unit part 368 constitutes the downstream side end portion of the liquid introduction part 362.

The upstream side end portion of the connection flow path part 374 is connected to the liquid introduction main unit part 368, and the downstream side end portion is connected to the liquid flow tube 320. The connection flow path part 374 forms a curved flow path. In specific terms, the connection flow path 374 forms a flow path parallel to the central axis CL, and forms a flow path in the gravity downward direction. The connection flow path part 374 has a flow path forming part 374A that forms the flow path, and a connection part 374B for attaching the liquid flow tube 320 and the flow path forming part 374A to be airtight. The flow path forming part 374A and the connection part 374B are formed by two color molding. By doing this, it is possible to easily use different materials for the flow path forming part 374A and the connection part 374B.

Also, the liquid conduit part 369 (liquid introduction part 362) is insert molded with one end of the liquid flow tube 320 in a state inserted in the connection part 374 of the liquid conduit part 369. In more detail, the connection part 374B and the flow path forming part 374A are molded parts, and the liquid flow tube 320 is an insert part. In more detail, after the flow path forming part 374A and the liquid flow tube 320 are connected, the connection part 374B is injection molded so as to cover the periphery of the connection location. In this way, by the liquid flow tube 320 being insert molded on the liquid conduit part 369, it is possible to make the connection part airtight using the connection part 374B. Thus, it is possible to reduce the possibility of ink from the connection location of the liquid flow tube 320 and the liquid conduit part 369 leaking out to the outside. Specifically, when the liquid flow tube 320 is connected to the connection part 374 and fixed using a spring, there is a possibility of creeping by the part fixed using the spring, and of a crack occurring and a leak occurring, but with the liquid supply device 20 of this mode, it is possible to reduce the possibility of that kind of liquid leak. The other end (not illustrated) positioned at the printer 10 side of the liquid flow tube 320 is also insert molded in a state inserted in the connection part.

As noted above, the liquid conduit part 369 includes the top end portion (upstream side end portion) 362*a* connected to the liquid outlet part 57, and has an upstream side introduction part on which a flow path parallel to the first direction (−K1 axis direction) is formed. Also, the liquid conduit part 369 includes a downstream side end portion connected to the liquid flow tube 320, and has a downstream side introduction part extending from the upstream side introduction part to the gravity direction downward direction (−Z axis direction). By doing this, the liquid conduit part 369 is able to suppress the shape in the first direction of the liquid supply device 20 from becoming large by having a downstream side introduction part that extends in the direction (gravity direction downward direction) intersecting the first direction.

As shown in FIG. 36, of the connection flow path part 374, in the direction parallel to the central axis CL (central axis CL direction), at the part of the side opposite to the side at which the liquid introduction main unit part 368 is positioned (the connection part base end portion 374*e*), a concave part 374*r* in which the other end portion of the coil spring 367 is received is formed as a spring bearing. The one end portion of the coil spring 367 abuts the wall surface of the printer 10 (e.g. device third surface 106 of FIG. 2). The coil spring 367 energizes the liquid conduit part 369 to the tip end portion 362*a* side of the liquid introduction part 362 (+K1 axis direction side, direction facing the liquid supply part 57). Of the liquid introduction part 362, the direction for which the tip end portion 362*a* faces the base end portion 362*b* (or the connection base end portion 374*e*) is the −K1 axis direction (connection direction).

As shown in FIG. 38 and FIG. 40, the connection part base end portion 374*e* has a regulating part 376 projecting outward facing the outside which is the direction of the surface perpendicular to the central axis CL direction. As shown in FIG. 36, the regulating part 376 is housed inside a housing part 366H of the stationary structure 366. The movement of the liquid conduit part 369 to the tip end portion 362*a* side by the coil spring 367 is regulated by the regulating part 376 abutting a wall part 366B that does partition forming of the inside housing part 366H.

As shown in FIG. 40, there are three regulating parts 376 provided with roughly a fixed gap open in the peripheral direction of the connection part base end portion 374*e* having a roughly circular cross section. Specifically, as shown in FIG. 39 and FIG. 40, the regulating part 376 has a first regulating part 376A, a second regulating part 376B, and a third regulating part 376C. In the direction (direction parallel to the surface defined by the Z axis direction and the K2 axis direction) perpendicular to the central axis CL direction (K1 axis direction), the regulating part 376 is arranged provided with looseness (a gap) in relation to the wall part that does partition formation of the inside housing part 366H. By doing this, the liquid conduit part 369 is constituted to be able to be displaced by the stationary structure 366 fixed to the stationary member 35 and the coil spring 367 in the direction (direction parallel to the surface defined by the Z axis direction and the K2 axis direction) that intersects the first direction (−K1 direction).

A-10. Displacement Mechanism of the Movable Member 40

Figure 41:
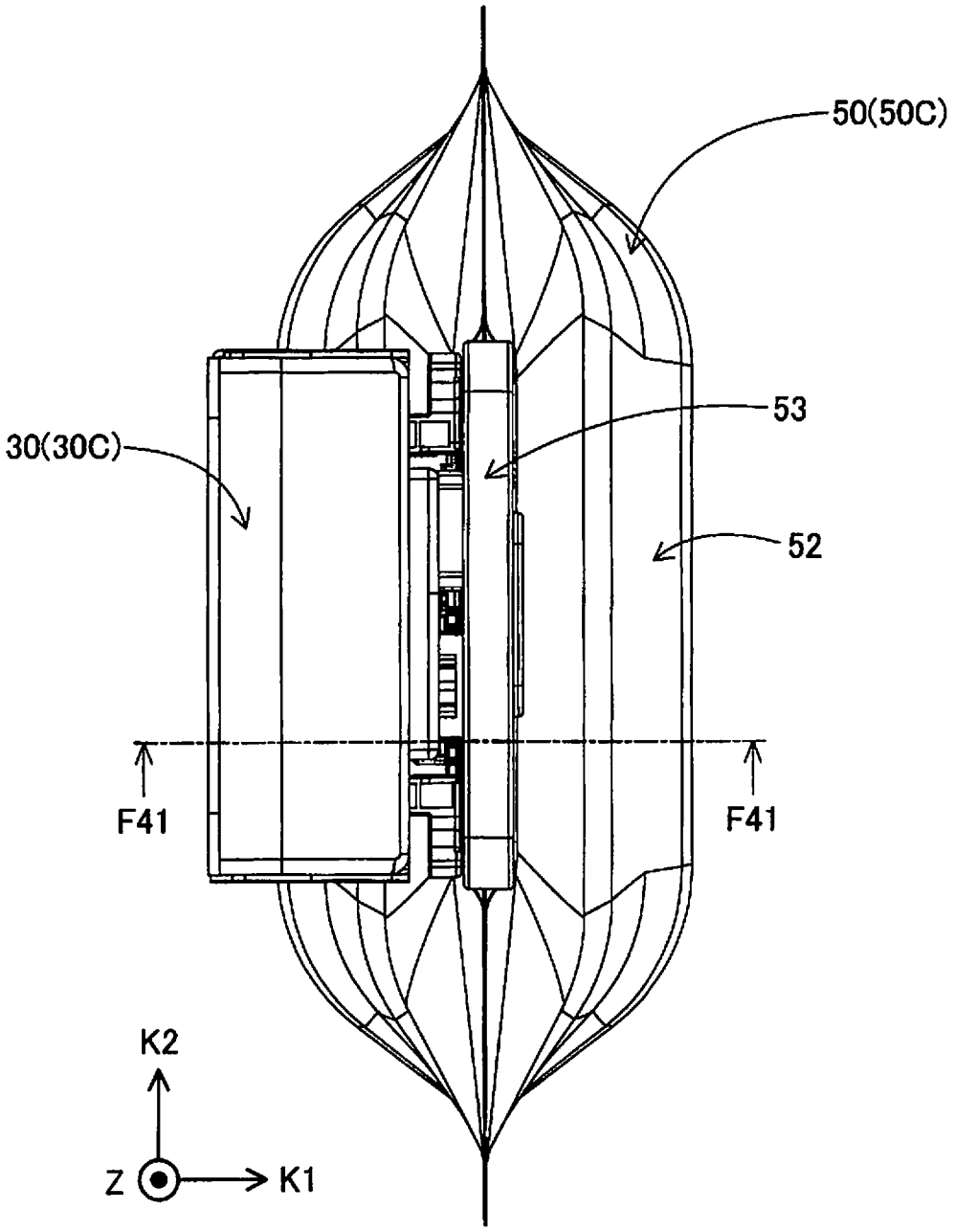
FIG. 41 is a top view of the detachable unit and the liquid container.
Figure 42:
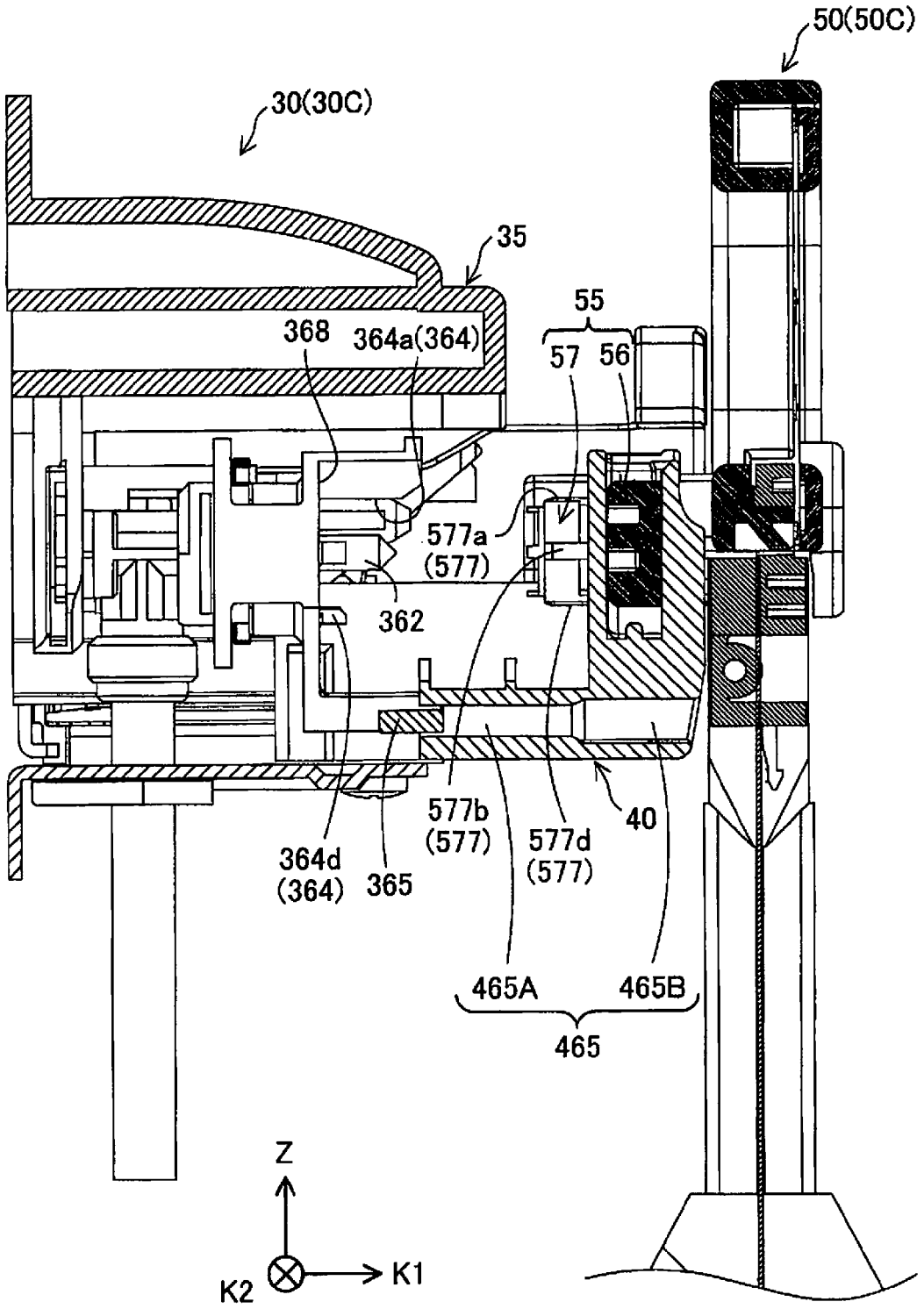
FIG. 42 is a first drawing correlating to the partial cross section view of F41-F41.
Figure 43:
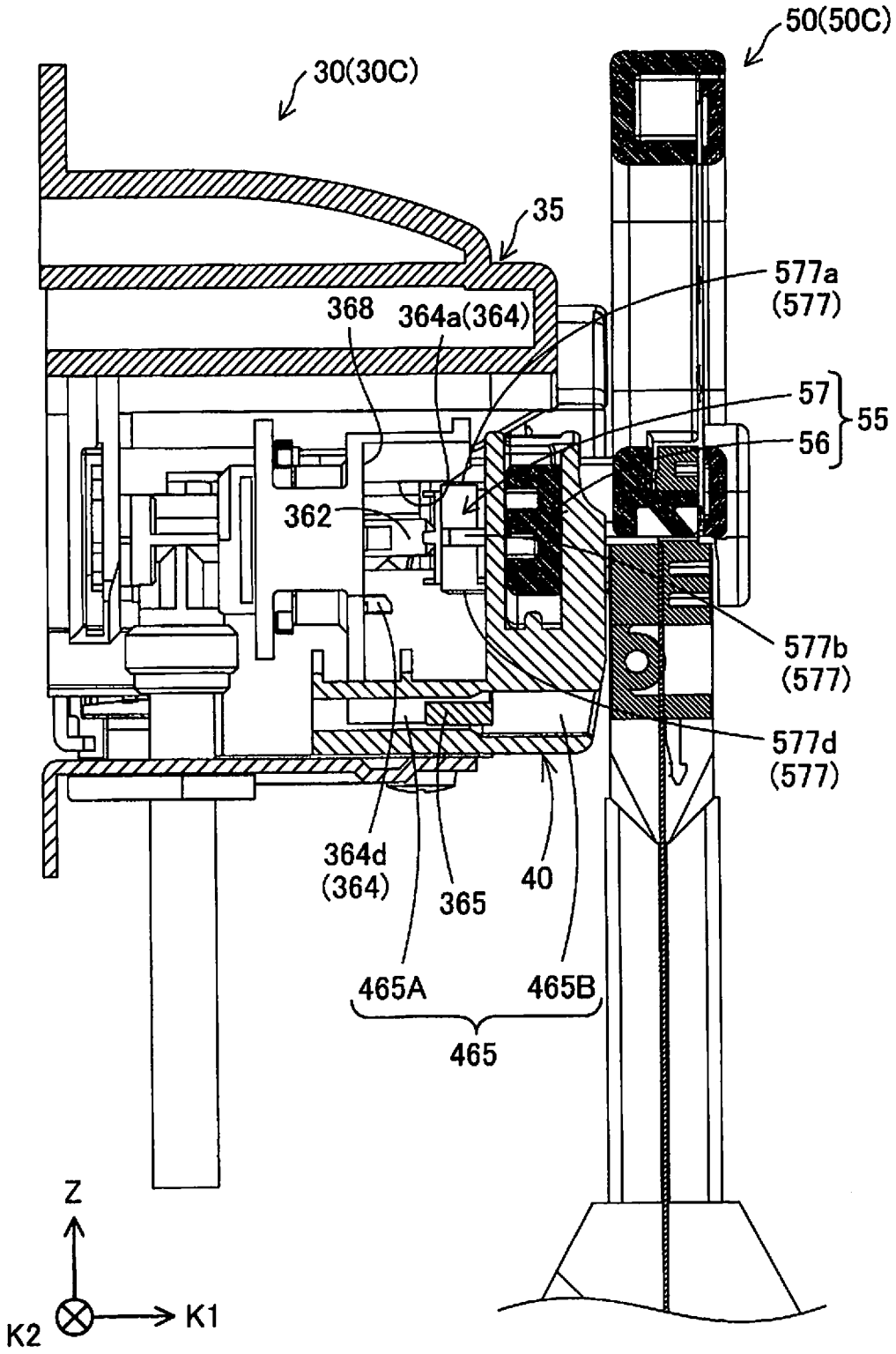
FIG. 43 is a second drawing correlating to the partial cross section view of F41-F41.
Figure 44:
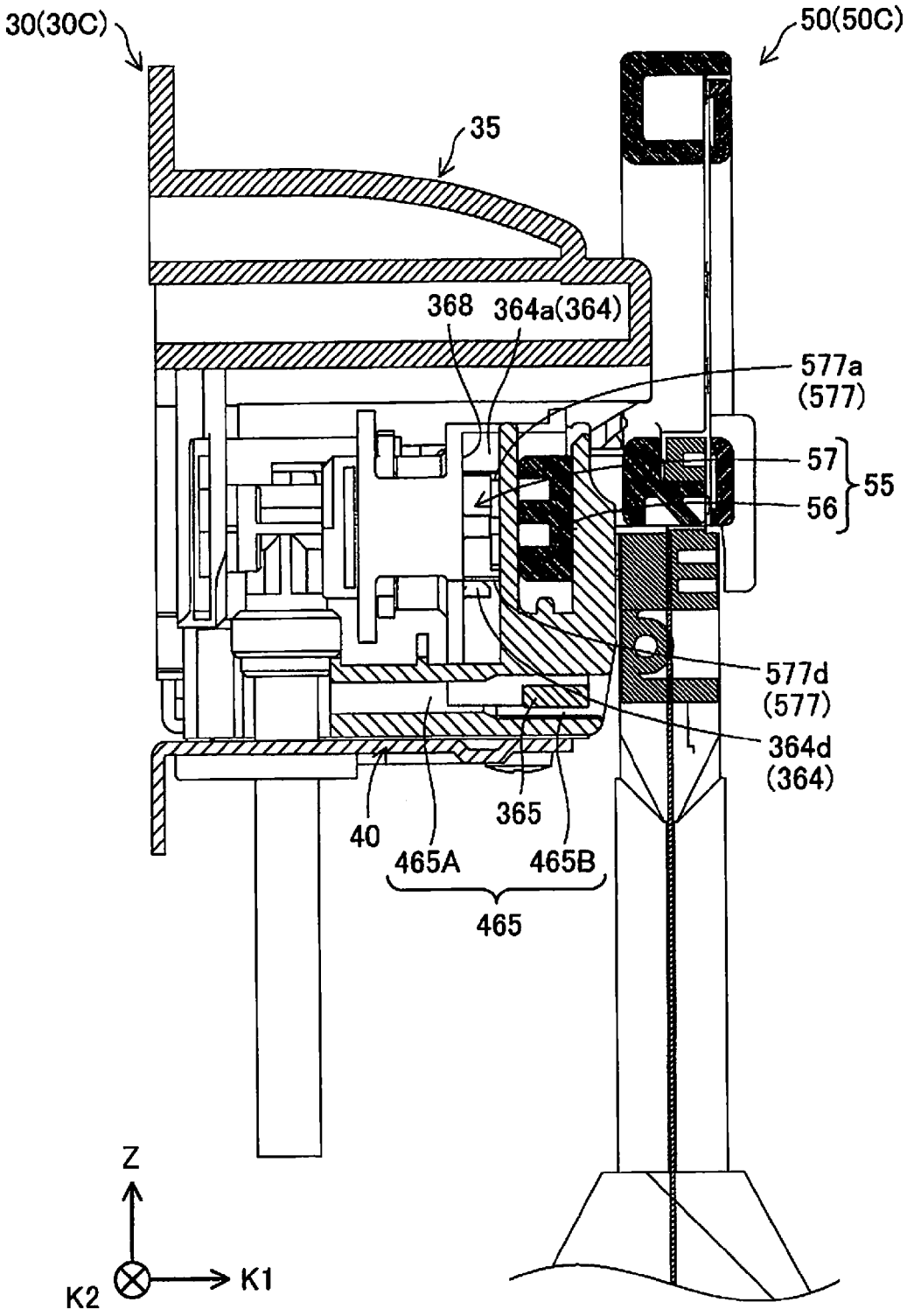
FIG. 44 is a third drawing correlating to the partial cross section view of F42-F42.

FIG. 41 is a top view of the detachable unit 30 and the liquid container 50. FIG. 42 is a first drawing correlating to the partial cross section view F41-F41. FIG. 43 is a second drawing correlating to the partial cross section view F41-F41. FIG. 44 is a third drawing correlating to the partial cross section view F42-F42. In FIG. 42 to FIG. 44, the position of the movable member 40 and the liquid container 50 in relation to the stationary member 35 is different. FIG. 42 is a drawing expressing when the liquid container 50 is set in the movable member 40 in the first state with the movable member 40 projecting outward in relation to the stationary member 35. FIG. 43 is a drawing expressing when the movable member 40 is pushed forward in the connection direction (−K1 axis direction), and the connection of the liquid supply part 57 and the liquid introduction part 362 is started. FIG. 44 is a drawing expressing when the liquid container 50 is in a mounted state.

As shown in FIG. 42, the movable member 40 has the induction part 465 in which the guide part 365 of the liquid introduction main unit part 368 is inserted. The induction part 465 has a first induction part 465A and a second induction part 465B. The first induction part 465A is positioned further to the first direction (−K1 axis direction) side than the second induction part 465B. The second induction part 465B is connected to the first induction part 465A. The second induction part 465B is larger in size in the gravity direction (Z axis direction) than the first induction part 465A. Specifically, as shown in FIG. 42 and FIG. 44, the gap in the gravity direction between the second induction part 465B and the guide part 365 is larger than the gap in the gravity direction between the first induction part 465A and the guide part 365.

As shown in FIG. 42, one portion of the guide part 365 is arranged inside the first induction part 465A in a state with the movable member 40 projecting to the furthest outward (+K1 axis direction) in relation to the stationary member 35. From the state shown in FIG. 42, by the movable member 40 being pushed forward inward (first direction, −K1 axis direction), as shown in FIG. 43, connection of the liquid supply part 57 and the liquid introduction part 362 starts. When connection has started, the guide part 365 reaches the boundary of the first induction part 465A and the second induction part 465B. Furthermore, by the movable member 40 being pushed forward inward, as shown in FIG. 44, the connection of the liquid supply part 57 and the liquid introduction part 362 is completed.

As noted above, during the period after the liquid container 50 is set in the movable member 40 until connection of the liquid supply part 57 and the liquid introduction part 362 starts, the guide part 365 is positioned at the first induction part 465A (FIG. 42 and FIG. 43). Also, during the period after the connection of the liquid supply part 57 and the liquid introduction part 362 starts until the connection is completed, the guide part 365 is positioned at the second induction part 465B (FIG. 43 and FIG. 44). Specifically, the induction part 465 of the movable member (first support part) 40 is supported to be able to have, of the liquid supply part (liquid outlet part) 57, the far side (first side) of the liquid introduction part 362 be more greatly displaced in the direction (Z axis direction) intersecting the first direction than the near side (second side). Here, the "far side" means the supply connection part 573 (FIG. 9) that is the other end of the liquid supply part 57, and the "near side" means the liquid supply port 572 (FIG. 9) that is the one end of the liquid supply part 57.

With the guide part 365 and the induction part 465 as the aforementioned displacement mechanism, when the connection between the liquid supply part 57 and the liquid introduction part 362 starts, it is easier to perform positioning of the liquid supply part in relation to the liquid introduction part 362, and immediately before the connection is complete, the movement of the liquid supply part 57 is not restricted more than when the connection starts, so it is possible to perform the connection of the liquid supply part 57 and the liquid introduction part 362 well. Specifically, until the connection starts, by making the amount of looseness small, it is possible to perform positioning of the liquid supply part 57 to the liquid introduction part 362 with good precision. Also, after connection has started, by making the amount of looseness greater, it is possible to make it easier for the liquid introduction part 362 to follow the movement of the liquid supply part 57.

In addition to the description above, the induction part 465 of the movable member (first support part) 40 can also be supported so as to be able to have, of the liquid supply part (liquid outlet part) 57, the far side of the liquid introduction part 362 be displaced more greatly in the K2 axis direction than the near side. As this kind of constitution, for example, it is also possible to have the gap in the K2 axis direction between the second induction part 465B and the guide part 365 be greater than the gap in the K2 axis direction between the first induction part 465A and the guide part 365.

A-11. Effect

With the embodiment noted above, as shown in FIG. 19, the first support part 40 is supported so that the liquid outlet part 57 is positioned further to the upper side in the gravity direction than the liquid containing part 52, and so that the liquid outlet part 57 is able to move along the first direction (−K1 axis direction) that intersects the gravity direction (Z axis direction). By doing this, it is possible to reduce the possibility of the liquid containing part 52 becoming an obstacle and not being able to connect the liquid outlet part 57 to the liquid introduction part 362. Also, with the embodiment noted above, as shown in FIG. 35, the positioning part 364 is arranged at the periphery of the liquid introduction part 362. By doing this, it is possible to perform positioning of the liquid outlet part 57 in the first direction (direction parallel to the surface defined by the Z axis direction and the K2 axis direction) that intersects with the first direction (−K1 axis direction) in relation to the liquid introduction part 362. Thus, it is possible to perform the connection between the liquid outlet part 57 and the liquid introduction part 362 well.

Also, with the embodiment noted above, as shown in FIG. 36, FIG. 39, and FIG. 40, the second support part 366 is supported so that the liquid introduction part 362 can be displaced in the direction intersecting with the first direction. When the liquid introduction part 362 is connected with the liquid outlet part 57, it is possible for the liquid introduction part 362 to be displaced following the movement of the liquid outlet part 57, so it is possible to perform the connection between the liquid outlet part 57 and the liquid introduction part 362 even more successfully.

Also, with the embodiment noted above, as shown in FIG. 36, the liquid introduction part 362 is energized by the coil spring 367 in the direction facing the liquid outlet part 57. By doing this, in the liquid container 50 mounted state, it is possible to reduce the possibility of the liquid outlet part 57 coming off from the liquid introduction part. Specifically, it is possible to reduce the possibility of a connection failure occurring between the liquid introduction part 362 and the liquid outlet part 57.

Also, with the embodiment noted above, as shown in FIG. 36, the liquid introduction structure 36 including the liquid supply connection part 362 (liquid introduction part 362) is supported on the outer wall (e.g. device third surface 106 of FIG. 4) via the stationary structure 366 and the stationary member 35. By doing this, compared to when the liquid supply connection part 362 is arranged on the interior of the printer 10, it is possible to easily perform the connection between the liquid container 50 and the liquid supply connection part 362. Also, compared to the interior of the printer 10, the liquid supply connection part 362 can have a larger space for housing the liquid container 50 while inhibiting the printer 10 from becoming larger. By doing this, it is possible to make the liquid containing part 52 of the liquid container 50 larger, so it is possible to increase the liquid volume that can be housed by the liquid container 50. Also, compared to the external placement type for which the liquid container 50 is arranged at a position separated from the printer 10, the flow path (liquid supply part) of the ink that reaches from the liquid container 50 to the printer 10 can be made short. By doing this, it is possible to shorten the time for the ink to reach from the liquid container 50 to the printer 10. It is also possible to inhibit changes of the physical properties of the ink by components of the ink evaporating via the liquid supply path. Also, since it is possible to make the flow path resistance of the liquid supply part low, it is possible to make the power (e.g. pump power for suctioning ink) for supplying ink from the liquid container 50 to the printer 10 small.

Also, with the embodiment noted above, as shown in FIG. 6A and FIG. 6J, the contact point structure 38 including the device side electrical connection part 382 is supported on the outer wall (e.g. device third surface 106 of FIG. 4) via the sheet metal 323 and the stationary member 35. By doing this, compared to when the device side electrical connection part 382 is arranged on the interior of the printer 10, it is possible to more easily perform connection of the device side electrical connection part 382 and the liquid container side electrical connection part 582 (circuit substrate 582).

Also, with the embodiment noted above, as shown in FIG. 5B, the liquid supply connection part 362 and the device side electrical connection part 382 are arranged aligned in the K2 axis direction. In more detail, the liquid supply connection part 362 and the device side electrical connection part 382 are arranged adjacent in the K2 axis direction. Specifically, the liquid supply connection part 362 and the device side electrical connection part 382 are arranged adjacent to the degree that they are simultaneously visible to the user. By doing this, the user is able to connect the parts corresponding to the liquid container 50 (the liquid outlet part 57 and the circuit substrate 582) while simultaneously visually confirming the liquid supply connection part 362 and the device side electrical connection part 382. Specifically, it is possible to improve the operability when mounting the liquid container 50 in the printer 10. The meaning of "adjacent" in this specification can be that both members are next to each other, but not necessarily in contact. Specifically, the members do not have to be in contact.

Also, with the embodiment noted above, as shown in FIG. 5A, the liquid supply device 20 has the bottom surface 27, and has a liquid container unit 22 for which the top part can open and close. By doing this, when the liquid supply part 57 is attached and detached with the liquid supply connection part 362, even when ink leaks out to the outside from the liquid supply connection part 362, it is possible to hold the leaked ink using the bottom surface 27. Thus, it is possible to reduce the possibility of ink adhering to the outside of the liquid supply device 20. Also, since it is sufficient to open and close the top part of the liquid container housing unit 22 only when necessary such as when attaching or detaching the liquid container 50 to the printer 10, during normal times, it is possible have the liquid container 50 protected by the liquid container housing unit 22. By doing this, it is possible to reduce the possibility of the liquid container 50 being damaged. Also, since the liquid supply connection part 362 is arranged on the interior of the liquid container housing unit 22, it is possible to reduce the possibility of the liquid supply connection part 362 being damaged.

Also, with the embodiment noted above, as shown in FIG. 10 and FIG. 18, when the liquid container 50 is connected to the printer 10, there is a holding part 59 that supports the liquid container side electrical connection part 582 further to the upper side (gravity upward direction side) than the liquid containing part 52. By doing this, even when the liquid containing part 52 is in a state (free state) dropped in the gravity direction by its own weight, by the liquid container side electrical connection part 582 being supported by the holding part 59, it is possible to position the liquid container side electrical connection part 582 within the designed range. Thus, it is possible to perform electrical connection of the liquid container side electrical connection part 582 and the device side electrical connection part 382 well.

Also, with the embodiment noted above, as shown in FIG. 17D, the contact surface TP is slanted so that the lower side is positioned further to the first direction side (−K1 axis direction side) than the upper side. By doing this, as shown in FIG. 24, it is possible to slant the front surface 62*fa* of the terminal holding part 62 so that the upper side projects further to the opposite direction side (+K1 axis direction side) to the first direction than the lower side. Specifically, the front surface 62*a* of the terminal holding part 62 can be arranged so as to cover the top part of the contact part cp of the circuit substrate 582. By doing this, it is possible to reduce the possibility of impurities such as debris or the like from adhering to the electrical connection part 382 (e.g. the front surface 62*fa* or the device side terminal 381). Thus, it is possible to perform electrical connection of the liquid container side electrical connection part 582 and the device side electrical connection part 382 even more successfully.

Also, with the embodiment noted above, as shown in FIG. 6K and FIG. 11, there is a regulating part 597 that regulates the movement of the holding part 59 in the opposite direction (+K1 axis direction) to the first direction by the holding part 59 abutting the first support part 40. Here, there are cases when in the mounted state, with the holding part 59 of the liquid container 50, external force is applied to the +K1 axis direction side. Examples of this external force include energizing force of the coil spring 387 shown in FIG. 17, or elastic force of the device side terminal 381 shown in FIG. 6V. By external force being applied to the holding part 59 to the +K1 axis direction side in this way, there is the risk of the holding part 59 moving to the +K1 axis direction side, and the electrical connection between the liquid container side electrical connection part 582 and the device side electrical connection part 382 being cut off. However, it is possible to regulate the movement of the holding part 59 to the +K1 axis direction side using the regulating part 597, so it is possible to stably maintain the electrical connection between the liquid container side electrical connection part 582 and the device side electrical connection part 382.

Also, with the embodiment noted above, as shown in FIG. 30 and FIG. 33, there is a rotation regulating part 595 for regulating the rotation in the arrow R30 direction by the holding part 59 abutting the first support part 40. By doing this, the rotation of the holding part is regulated, so it is possible to more stably maintain the electrical connection between the liquid container side electrical connection part 582 and the device side electrical connection part 382.

Also, with the embodiment noted above, as shown in FIG. 6A, the printer 10 is equipped with the stationary member 35 to which is attached an electrical connection unit 38 having the liquid introduction part 362 and the device side electrical connection part 382, and the first support part 40. Also, as shown in FIG. 6R, the device side electrical connection part 382 is attached so as to be able to be displaced in the direction (direction parallel to the surface defined by the Z axis direction and the K2 axis direction) that intersects the first direction (−K1 axis direction). As shown in FIG. 17E and FIG. 17F, the holding part 59 has groove parts 593*t* and 592*t* for receiving device side substrate positioning parts 384 and 385 (FIG. 6T) of the electrical connection unit 38. By doing this, when connecting the liquid container side electrical connection part 582 to the device side electrical connection part 382, it is possible for the device side electrical connection part 382 to follow the movement of the holding part 59 and be displaced. Thus, it is possible to perform electrical connection of the liquid container side electrical connection part 582 and the device side electrical connection part 382 well.

Also, with the embodiment noted above, as shown in FIG. 17E and FIG. 17F, when connecting the liquid container side electrical connection part 582 to the device side electrical connection part 382, the holding part 59 of the liquid container 50 abuts the device side substrate positioning parts 384 and 385 (FIG. 6T) of the electrical connection unit 38. By doing this, the liquid container side electrical connection part 582 is positioned in relation to the device side electrical connection part 382, so it is possible to perform electrical connection of the device side electrical connection part 382 and the liquid container side electrical connection part 582 well. For example, it is possible to make it less likely to be affected by the gravity downward direction component load that occurs due to the liquid containing part 52's own weight. By doing this, it is possible to decrease the possibility of not being able to perform electrical connection of the connection parts 382 and 582 well.

Also, with the embodiment noted above, as shown in FIG. 13, the holding part side positioning parts 592*t* and 593*t* are provided at both sides sandwiching the liquid container side electrical connection part 582. Also, as shown in FIG. 6T, the device side substrate positioning parts 384 and 385 are provided at both sides sandwiching the device side terminal 381 of the device side electrical connection part 382. By doing this, compared to when the holding part side positioning parts 592*t* and 593*t* (device side substrate positioning parts 384 and 385) are provided at one side, it is possible to reduce the possibility of the liquid container side electrical connection part 582 (device side electrical connection part 382) slanting.

Also, with the embodiment noted above, as shown in FIG. 15, the holding part 59 has holding part side upper side regulating parts 599*a* and 599*b*, and as shown in FIG. 6M, the stationary structure 37 has device side upper side regulating parts 377*a* and 377*b*. When the liquid container side electrical connection part 582 is connected to the device side electrical connection part 382, the movement of the holding part 59 to the upper side of the gravity direction is regulated by the holding part side upper side regulating parts 599*a* and 599*b* of the holding part 59 and the device side upper side regulating parts 377*a* and 377*b* of the stationary structure 37 abutting. By doing this, it is possible to perform electrical connection of the liquid container side electrical connection part 582 and the device side electrical connection part 382 at an even better level. With this embodiment, this regulation starts before the start of positioning by the device side substrate positioning parts 384 and 385 (FIG. 6T) and the holding part side positioning parts 593*t* and 592*t* (FIG. 17E and FIG. 17F) of the holding part 59. By working in this way, it is possible to perform positioning to some degree of the holding part side positioning parts 593*t* and 592*t* which are groove parts with the projection shaped device side substrate positioning parts 384 and 385, so it is possible to reliably insert the device side substrate positioning parts 384 and 385 in the holding part side positioning parts 593*t* and 592*t*.

Also, with the embodiment noted above, as shown in FIG. 5C, there is a protecting member (cover part) 354 that covers the top part of the device side electrical connection part 382. This cover part 354 covers the holding part of the liquid container 50 and the top part of the circuit substrate 582 when the liquid container side electrical connection part 582 is connected with the device side electrical connection part 382 (e.g. when in a mounted state). By doing this, it is possible to perform the electrical connection of the liquid container side electrical connection part 582 and the device side electrical connection part 382 even one level better.

A-12. Other Preferred Modes

Figure 45:
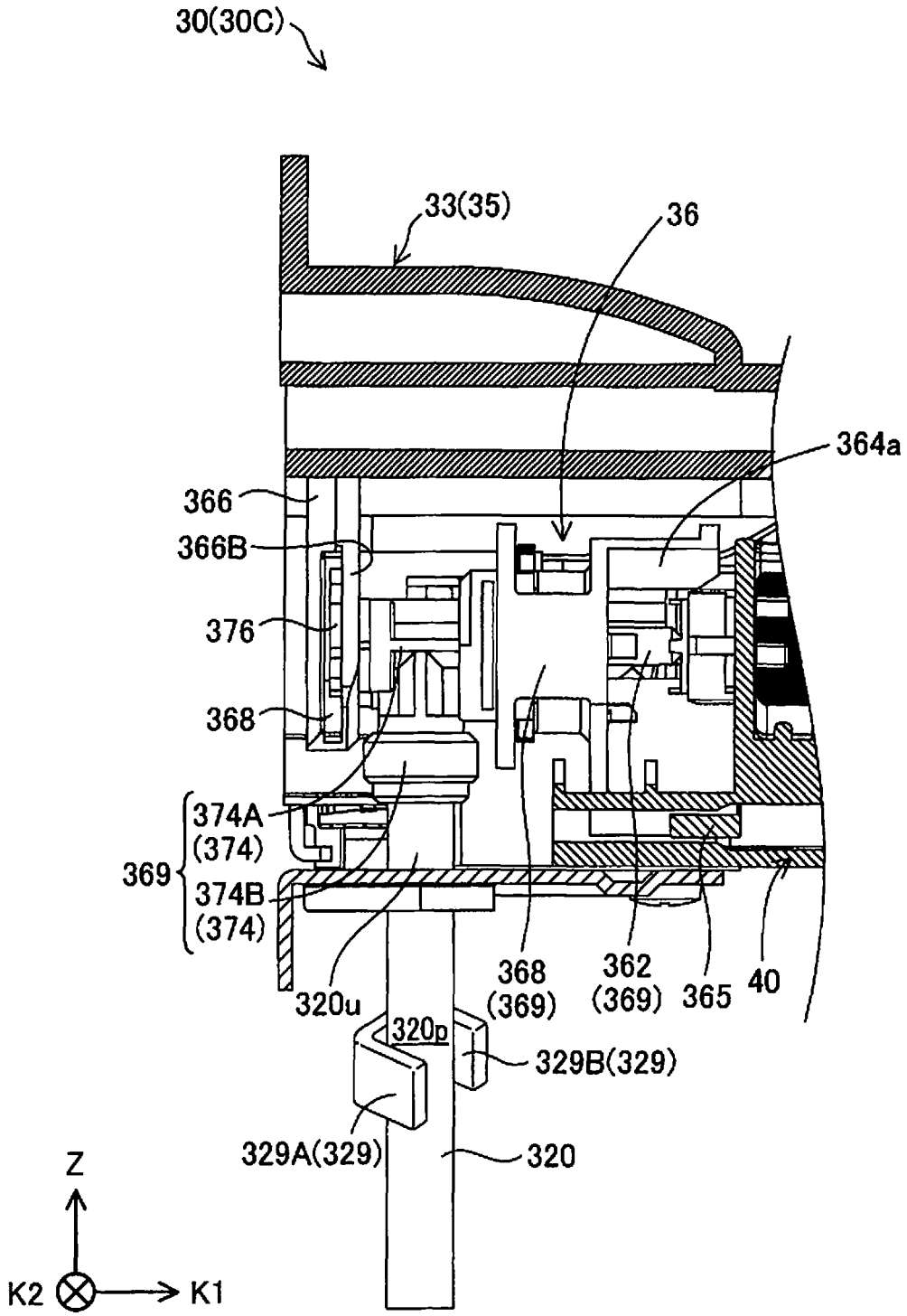
FIG. 45 is a drawing for describing preferred embodiments.

FIG. 45 is a drawing for describing a preferred mode. The liquid supply device 20 can further have the liquid flow tube 320 and a holding member 329. The holding member 329 holds the liquid flow tube 320. With this embodiment, the holding member 329 is a pair of ribs 329A and 329B provided on the outer wall (e.g. device third surface 106 of FIG. 2) of the printer 10. The liquid flow tube 320 is held by being inserted between the pair of ribs 29A and 329B. In specific terms, the holding member 329 holds the liquid flow tube 320 so that the upstream side part from an upstream end 320*u* of the liquid flow tube 320 up to part 320*p* at which the holding member 329 is positioned extends along the gravity direction (Z axis direction) in the ink flow direction reaching from the liquid introduction part 362 to the printer 10. Specifically, the holding member 329 is positioned directly under the connection flow path part 374.

By doing this, even when the downstream side of the liquid flow tube 320 is arranged so as to curve more than the upstream end side part, it is possible to maintain the shape of the upstream end side part along the gravity direction. Specifically, even when reaction force occurs by the curve of the downstream side of the liquid flow tube 320, it is possible to receive the reaction force using the holding member 329. For example, it is possible to reduce the possibility of another member of the liquid supply device (e.g. the second support part 366) being affected by the downstream side of the liquid flow tube. For example, when the liquid supply device 20 does not have the holding member 329, when the upstream side of the liquid flow tube 320 has a curved shape, there may be cases when it is not possible to arrange the regulating part 376 at the designed position within the second support part 366 at a designed position due to receiving the effect of the reaction force of the liquid flow tube 320. Also, by the reaction force of the liquid flow tube 320 being applied to the second support part 366, there may be cases when the second support part 366 is deformed.

Meanwhile, the upstream end side part of the liquid flow tube 320 can have the shape maintained along the gravity direction using the holding member 329. Specifically, by the downstream side of the liquid flow tube 320 being curved more than the upstream side part, even when reaction force occurs at that upstream side part, it is possible for the holding member 329 to receive that generated reaction force. By doing this, it is possible to arrange the regulating part 376 with good precision at the designed position within the second support part 366. Thus, it is possible to have the displacement mechanism using the second support part 366 of the liquid conduit part 369 function within the designed range. As long as the holding member 329 is a shape by which it can hold the liquid flow tube 320, it does not have to be a rib. For example, the holding member 329 can also be a round ring shaped member. In this case, the liquid flow tube 320 is inserted through the inside of the round ring shape.

With this embodiment, the substrate unit 58 is also called the "liquid container side electrical connection part 58," the circuit substrate holding part 59 is also called the "arrangement part 59," the holding part side positioning parts 592*t* and 593*t* are also called the "liquid container side electrical connection part positioning parts 592*t* and 593*t*," and the holding part side upper side regulating parts 599*a* and 599*b* are also called the "liquid container side electrical connection part upper side regulating parts 599*a* and 599*b*."

B. Modification Examples

The present invention is not limited to the embodiments and modes noted above, and can be implemented in various modes in a range that does not stray from the scope of its gist, and for example the following kinds of modifications are possible.

B-1. First Modification Example

With the embodiment noted above, the liquid containing part 52 was formed by a flexible member, but the invention is not limited to this, and it is acceptable as long as it is possible to function as a liquid containing part that can house the liquid in the interior. For example, the liquid containing part 52 can have a portion be formed by a flexible member, and regardless of the volume of liquid consumed, can be formed by a hard member for which the capacity does not change. By forming at least a portion of the liquid containing part 52 (liquid containing part 52) using a flexible member, the capacity of the liquid containing part 52 changes according to the volume of ink housed in the liquid containing part 52.

B-2. Second Modification Example

With the embodiment noted above, as shown in FIG. 19, the connection direction of the liquid container 50 to the detachable unit 30 was the horizontal direction (K1 axis direction), but the invention is not limited to this, and the connection direction can also be a direction including a first direction (K1 axis direction) component. For example, the connection direction can also be a direction including the −Z axis direction and the −K1 axis direction. In this case, the movable member 40 also moves in the direction corresponding to the connection direction of the liquid container 50.

B-3. Third Modification Example

The present invention is not limited to inkjet printers and their liquid container 50, but can also be applied to any printing device (liquid consumption device) that sprays another liquid besides ink and a liquid container for housing that liquid. For example, it can also be applied to the various kinds of liquid consumption device and their liquid container like those below:

(1) Image recording devices such as facsimile devices or the like,
(2) Devices that spray coloring material used for manufacturing color filters for image display devices such as liquid crystal displays or the like,
(3) Devices for spraying electrode material used for forming electrodes such as of organic EL (Electro Luminescence) displays, field emission displays (FED) or the like,
(4) Liquid consumption devices for spraying liquid containing bioorganic material used for biochip manufacturing,
(5) A sample spraying device as a precision pipette,
(6) A lubricating oil spraying device,
(7) A resin liquid spraying device,
(8) A liquid consumption device for spraying lubricating oil in a pinpoint on precision machines such as watches, cameras or the like,
(9) A liquid consumption device for spraying on a substrate a transparent resin liquid such as an ultraviolet curing resin or the like for forming a miniature hemispheric lens (optical lens) used for optical communication elements or the like,
(10) A liquid consumption device for spraying an acid or alkaline etching fluid for etching a substrate or the like, and
(11) Any other liquid consumption device equipped with a liquid spray head for discharging tiny volume droplets.

The "droplets" means the state of a liquid discharged from the liquid consumption device and includes granular shapes, tear shapes, and threadlike shapes with a tail. Also, a "liquid" is acceptable as long as it is a material that can be sprayed by the liquid consumption device. For example, liquid state materials such as liquid state materials of high or low viscosity, as well as sol, gel water, other inorganic solvents, organic solvents, solutions, liquid resin, liquid metal (metal melt), and the like are included in "liquids."_Also, this is not limited to liquids as one physical property state, but items for which particles of functional materials consisting of a solid such as a pigment, metal particles or the like are dissolved, dispersed, or blended in a solvent and the like are also included in "liquids." Representative examples of liquids include the kind of ink like that described with the embodiments noted above, liquid crystal and the like. Here, ink includes various types of liquid body compositions such as typical water based inks and oil based inks as well as gel inks, hot melt inks and the like. Also, when housing UV ink that can be cured by irradiating ultraviolet rays in this liquid containing part and connecting to a printer, the liquid containing part floats from the installation surface, so there is a reduction in the possibility of the heat of the installation surface being conveyed to the liquid containing part and causing curing.

B-4. Fourth Modification Example

Figure 46:
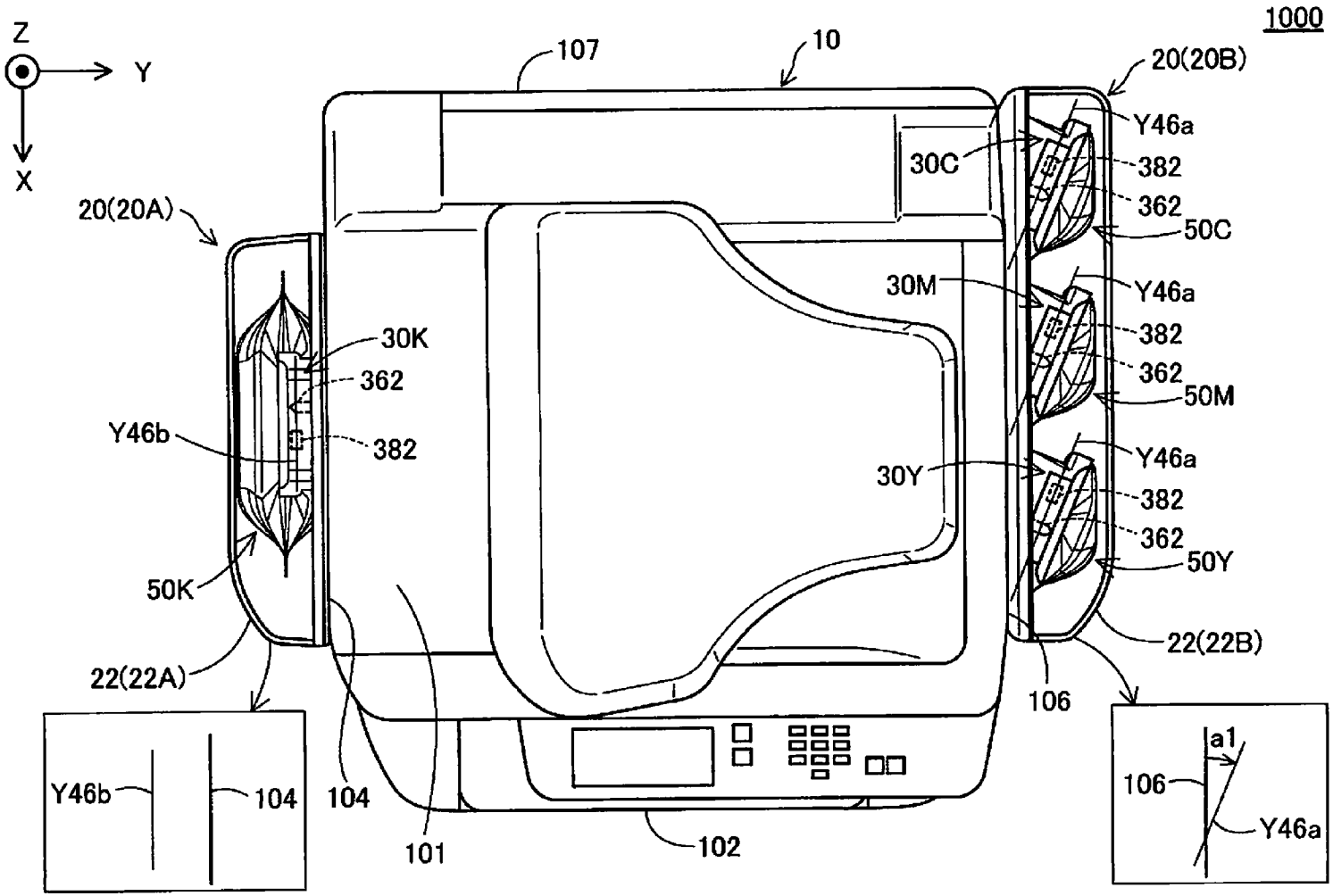
FIG. 46 is a drawing for explaining a preferred arrangement example of this embodiment.

FIG. 46 is a drawing for describing a preferred arrangement example of this embodiment. FIG. 46 is a drawing of when FIG. 1 is seen from the +Z axis direction (vertical upward) side. For easier understanding, the liquid housing bodies 50C, 50M, 50Y, and 50K arranged on the interior of the cover member 22 are also illustrated. The printer 10 is further equipped with a device fourth surface (back surface, back wall) 107 facing opposite the +Z axis direction side top surface (upper wall) 101 and the device first surface 102.

The liquid housing bodies 50C, 50M, and 50Y are connected to the second liquid supply device 20B of the device third surface (right side wall, first side wall) 106 side. The detachable units 30C, 30M, and 30Y are also respectively equipped. The liquid supply connection part 362 and the device side electrical connection part 382 are arranged aligned in a designated direction Y46*a*. Also, the liquid supply connection part 362 and the device side electrical connection part 382 that the detachable unit 30K is equipped with are arranged aligned in a designated direction Y46*b*. Specifically, a plurality of sets consisting of the liquid supply connection part 362 and the device side electrical connection part 382 are arranged on the device third surface 106. Also, the plurality of sets are arranged aligned in the direction (X axis direction) facing opposite the front surface 102 and the back surface 107.

Here, the liquid container 50K is connected to the first liquid supply device 20A of the device second surface (left side wall, device second side wall) 104 side. The liquid container 50K has a larger capacity than the liquid housing bodies 50C, 50M, and 50Y, and is able to house a larger volume of ink. This ink capacity size is realized as described hereafter with this embodiment. Specifically, the length of the liquid container 50K in the designated direction Y46*b* (width direction, K2 axis direction in FIG. 7) is longer than the length of the liquid housing bodies 50C, 50M, and 50Y in the designated direction Y46*a* (width direction, K2 axis direction in FIG. 7). Also, with this embodiment, the length of the liquid container 50K in the direction (thickness direction, K1 axis direction in FIG. 7) orthogonal to the designated direction Y46*b* is also longer than the length of the liquid housing bodies 50C, 50M, and 50Y in the direction (thickness direction, K1 axis direction in FIG. 7) orthogonal to the designated direction Y46*a*.

Here, the angle forming the designated direction Y46*a* with the device third surface 106 in the clockwise direction (right rotation direction) from the device third surface 106 is angle a1. At this time, the angle a1 is greater than 0 degrees and less than 90 degrees. Also, the designated direction Y46*b* is parallel to the device second surface 104. Specifically, the liquid supply connection part 362 and the device side electrical connection part 382 supported on the device third surface 106 are arranged aligned along the direction parallel to the device second surface 104. When the detachable units 30C, 30M, and 30Y are arranged at the device second surface 104 side, an angle a2 that forms the designated direction Y46*a* with the device second third 106 in the counterclockwise direction (left rotation direction) from the device second surface 104 is preferably greater than 0 degrees and less than 90 degrees.

As noted above, since angle a1 or angle a2 is greater than 0 degrees and less than 90 degrees, it is possible to inhibit the width in the lateral direction (Y axis direction) which is the direction at which the device second surface 104 and the device third surface 106 face opposite from becoming large. Also, since it is possible to arrange the liquid container 50K with a large capacity in parallel with the device second surface 104, it is possible to make the mounting space of the liquid container 50 formed at the device second surface 104 side and the device third surface 106 side sandwiching the printer 10 almost equal.

B-5. Fifth Modification Example

Figure 47:
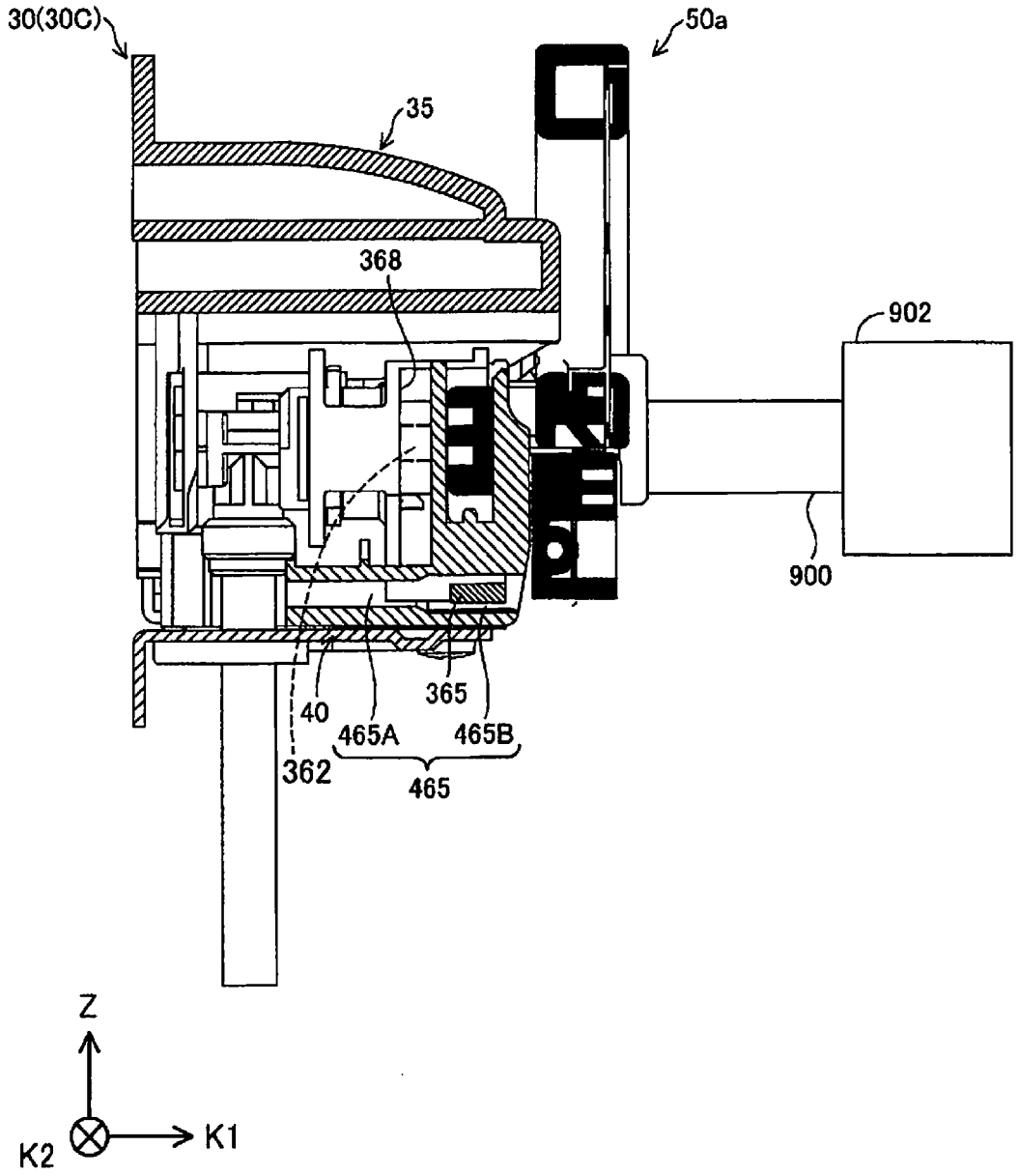
FIG. 47 is a drawing for describing the electrical connection body.

FIG. 47 is a drawing for describing the electrical connection body 50*a*. With the embodiment noted above, the liquid container 50 was equipped with the liquid containing bag 52 and the liquid supply part 57 (FIG. 7 and FIG. 9), but it is also possible to have the electrical connection body 50*a* that omits these. Specifically, the electrical connection body 50*a* is constituted with the liquid containing bag 52 and the liquid supply part 57 of the liquid container 50 omitted. The remainder of the constitution is the same as that of the liquid container 50. When using this electrical connection body 50*a*, ink is supplied to the printer 10 from a tank (liquid holding source) 902 that houses ink arranged at the exterior via a liquid flow tube (hose) 900 in communication with the tank 902 and the liquid introduction part 362. The liquid flow tube (hose) 900 can also be connected midway in the liquid flow tube connected to the liquid spray part of the printer 10 from the liquid introduction part 362. As shown in FIG. 47 as well, the same effects as those of the embodiment noted above are exhibited. For example, as shown in FIG. 17D, the contact surface TP is slanted so that the lower side is positioned further in the first direction (−K1 axis direction) than the upper side. By doing this, as shown in FIG. 24, it is possible to have the front surface 62*fa* of the terminal holding part 62 slanted so as to have the upper side project more to the direction side (+K1 axis direction side) opposite to the first direction than the lower side. Specifically, it is possible to arrange the front surface 62*fa* of the terminal holding part 62 so as to cover the top part of the contact part cp of the circuit substrate 582. By doing this, it is possible to reduce the possibility of impurities such as debris or the like from adhering to the electrical connection part 382 (e.g. the front surface 62*fa* or the device side terminal 381). Thus, it is possible to perform electrical connection of the electrical connection part 582 and the device side electrical connection part 382 even more successfully.

B-6. Sixth Modification Example

With this embodiment, the liquid container side electrical connection part had the circuit substrate 582, but the invention is not limited to this, and it is acceptable as long as it has a contact part cp that can contact the device side electrical connection part 382. For example, it is also possible for the liquid container side electrical connection part 58 to not be equipped with the storage device 583. For example, the liquid container side electrical connection part 58 can also be equipped with a contact part of terminals used for detection of attachment and detachment of the liquid container 50. Also, the liquid container side electrical connection part 58 can also be equipped with an overall circuit substrate that includes flexible cable such as a flexible printed board (FPC). This circuit substrate has a contact part that can contact the device side electrical connection part 382 at one end side. The other end side is connected to a reset device, for example. The modification example noted above can be used instead of the circuit substrate 582 or can be used together with the circuit substrate 582.

Here, the present invention is not limited to the embodiments, working examples, and modified examples described above, and the realization of various configurations is possible in a range which does not depart from the spirit of the present invention. For example, it is possible for the technical characteristics in the embodiments, working examples, and modified examples which correspond to the technical characteristics in each of the aspects according to the summary of the invention section to be replaced or combined as appropriate in order to solve a portion or all of the problems described above, or in order to achieve a portion of all of the effects described above. In addition, where a technical characteristic is not described as one which is essential in the present specifications, it is able to be removed as appropriate.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A liquid supply device configured to supply liquid to a liquid consumption device, the liquid supply device comprising:

a liquid container including a liquid containing part configured to house the liquid, at least a portion of the liquid containing part being flexible, and a liquid supply part in communication with an interior of the liquid containing part, facing a first direction that is a direction intersecting a gravity direction when supplying the liquid to the liquid consumption device;

a first support part supporting the liquid supply part of the liquid container such that the liquid supply part is positioned further to an upper side in the gravity direction than the liquid containing part, and such that the liquid supply part moves in the first direction and in a direction opposite to the first direction, with the liquid supply part being mounted to the first support part so as to be attachable and detachable;

a stationary member configured and arranged to house the first support part;

a liquid introduction part attached to the liquid consumption device and configured to be connected with the liquid supply part by the liquid supply part moving in the first direction by movement of the first support part; and a positioning part arranged at a periphery of the liquid introduction part and configured to position the liquid supply part in a direction intersecting the first direction when connecting with the liquid supply part, the first support part being switchable between a first state in which the first support part projects outward in relation to the stationary member and a second state in which the first support part is housed in the stationary member.

2. The liquid supply device according to claim 1, further comprising a second support part supporting the liquid introduction part, wherein the second support part supports the liquid introduction part displaceably in a direction intersecting the first direction.

3. The liquid supply device according to claim 1, wherein the liquid introduction part is urged toward the liquid supply part.

4. The liquid supply device according to claim 1, wherein the liquid supply part has a first side far from the liquid introduction part and a second side near the liquid introduction part, and the first support part supports the first side of the liquid supply part so as to be more greatly displaced in the direction intersecting the first direction than the second side.

5. The liquid supply device according to claim 1, further comprising a liquid flow tube that has flexibility, is in communication with the liquid introduction part, and is configured to supply the liquid of the liquid introduction part to the liquid consumption device, the liquid flow tube being positioned further to a lower side in the gravity direction than the liquid introduction part, wherein the liquid introduction part is insert-molded in a state with one end of the liquid flow tube inserted in a connection part of the liquid introduction part.

6. The liquid supply device according to claim 5, wherein the liquid introduction part has, in the direction of the liquid flow from the liquid container to the liquid consumption device, an upstream side introduction part for which a flow path parallel to the first direction is formed, including an upstream side end portion of the liquid introduction part, and a downstream side introduction part extending downward in the gravity direction from the upstream side introduction part, including a downstream side end portion of the liquid introduction part.

7. The liquid supply device according to claim 5, further comprising a holding member holding the liquid flow tube, wherein the holding member, in a flow direction of the liquid reaching from the liquid introduction part to the liquid consumption device, holds the liquid flow tube such that, of the liquid flow tube, an upstream end side part from an upstream end of the liquid flow tube to a part where the holding member is positioned extends along the gravity direction.

8. The liquid supply device according to claim 1, further comprising a liquid flow tube that has flexibility, is in communication with the liquid introduction part, and is configured to supply the liquid in the liquid introduction part to the liquid consumption device, the liquid flow tube being positioned further to a lower side in the gravity direction than the liquid introduction part, and a holding member holding the liquid flow tube, wherein the holding member, in a flow direction of the liquid reaching from the liquid introduction part to the liquid consumption device, holds the liquid flow tube such that, of the liquid flow tube, an upstream end side part from an upstream end of the liquid flow tube to a part where the holding member is positioned extends along the gravity direction.

9. The liquid supply device according to claim 1, wherein the first support part is movable with respect to the liquid supply device in the first direction and in the direction opposite to the first direction.

10. The liquid supply device according to claim 1, wherein the first support part is configured to abut against the liquid container.

* * * * *